US007046197B2

(12) United States Patent
Okado

(10) Patent No.: US 7,046,197 B2
(45) Date of Patent: May 16, 2006

(54) DIELECTRIC ANTENNA, ANTENNA-MOUNTED SUBSTRATE, AND MOBILE COMMUNICATION MACHINE HAVING THEM THEREIN

(75) Inventor: Hironori Okado, Tokyo (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 104 days.

(21) Appl. No.: 10/489,140

(22) PCT Filed: Jul. 4, 2003

(86) PCT No.: PCT/JP03/08516

§ 371 (c)(1),
(2), (4) Date: Mar. 10, 2004

(87) PCT Pub. No.: WO2004/006385

PCT Pub. Date: Jan. 15, 2004

(65) Prior Publication Data

US 2004/0246180 A1 Dec. 9, 2004

(30) Foreign Application Priority Data

| | | |
|---|---|---|
| Jul. 5, 2002 | (JP) | 2002-197984 |
| Aug. 9, 2002 | (JP) | 2002-233789 |
| Aug. 23, 2002 | (JP) | 2002-243227 |
| Aug. 26, 2002 | (JP) | 2002-245121 |
| Oct. 17, 2002 | (JP) | 2002-303101 |

(51) Int. Cl.
*H01Q 1/38* (2006.01)

(52) U.S. Cl. ..... 343/700 MS; 343/702; 343/846

(58) Field of Classification Search ..... 343/700 MS, 343/702, 745, 829, 846
See application file for complete search history.

(56) References Cited

U.S. PATENT DOCUMENTS

| | | | | |
|---|---|---|---|---|
| 5,696,517 | A * | 12/1997 | Kawahata et al. | 343/700 MS |
| 5,748,149 | A * | 5/1998 | Kawahata | 343/700 MS |
| 5,861,854 | A * | 1/1999 | Kawahata et al. | 343/702 |
| 5,903,240 | A * | 5/1999 | Kawahata et al. | 343/700 MS |
| 5,959,582 | A | 9/1999 | Kawahata et al. | |
| 6,614,398 | B1 * | 9/2003 | Kushihi et al. | 343/700 MS |
| 6,873,291 | B1 * | 3/2005 | Aoyama et al. | 343/700 MS |

FOREIGN PATENT DOCUMENTS

| | | |
|---|---|---|
| JP | 10-173427 A | 6/1998 |
| JP | 2002-100915 A | 4/2002 |
| JP | 2002-158529 A | 5/2002 |

* cited by examiner

*Primary Examiner*—Shih-Chao Chen
(74) *Attorney, Agent, or Firm*—Duane Morris LLP

(57) ABSTRACT

On an antenna forming face (9) in a rectangular shape which a dielectric base (7A) has, a linear element (11A) is provided adjacently only peripheries (9*a*, 9*b*, 9*c*, and 9*d*) of the antenna forming face (9). From the linear element (11A), a linear conductor (25) for matching impedance branches. Since the linear element is adjacent to only the peripheries (9*a*, 9*b*, 9*c*, and 9*d*) of the antenna forming face (9), portions of the linear element (11A) do not become adjacent to each other. Accordingly, mutual interference which easily occurs when the portions of the linear element (11A) are adjacent to each other does not occur, so that decrease of radiation efficiency of the dielectric antenna (1A) and hindrance to widening a band thereof can be eliminated as much as possible.

28 Claims, 36 Drawing Sheets

DIELECTRIC ANTENNA, ANTENNA-MOUNTED SUBSTRATE, AND MOBILE COMMUNICATION MACHINE HAVING THEM THEREIN

TECHNICAL FIELD

This application is a 371 of PCT/JP03/08516 filed on Jul. 4, 2003.

The present invention relates to a dielectric antenna, which is included in a mobile communication device represented by cellular phones, portable radio communication devices and the like, an antenna mounting substrate, and a mobile communication device including them.

BACKGROUND ART

In accordance with the popularization of mobile communication devices in recent years, miniaturization and weight reduction of them are desired for making them convenient for carrying or moving. Among electronic parts included in such a mobile communication device, miniaturization of semiconductor integrated circuit or the like is in rapid progress.

However, miniaturization of antenna is not being advanced, which hinders the miniaturization and weight reduction of mobile communication devices. Japanese Patent Laid-open No. 2000-196339 discloses an element formed in a spiral or a meander shape for miniaturizing an antenna. However, when an element is formed in the spiral or meander shape on a limited antenna forming face, portions of the element become adjacent to each other, which can cause mutual interference due to capacitive coupling or the like between the portions of the element. The mutual interference between the portions of the element decreases radiation efficiency of radio wave and hinders widening a band of radio wave, and thus it is preferred to be avoided as much as possible. The present invention is to solve the above-mentioned problems, and an object thereof is to provide a dielectric antenna which is, although being made in a small size, capable of eliminating the decrease of radiation efficiency of radio wave and the hindrance to widening the band of radio wave as much as possible by restraining the mutual interference between elements, an antenna mounting substrate and a mobile communication device including them.

DISCLOSURE OF THE INVENTION

To achieve the above-described object, the present invention includes structures, which will be explained below. It should be noted that definitions or the like of terms for explaining any invention also apply to other inventions within possible ranges of their nature.

A dielectric antenna according to a first invention includes: a dielectric base having an antenna forming face in a rectangular shape; a linear element extending on the antenna forming face adjacently only a periphery of the antenna forming face; at least one bending portion included in the linear element; a power supply terminal connected to a base end portion of the linear element; a linear conductor branching in the vicinity of the base end portion of the linear element on the antenna forming face; and a ground terminal connected to a tip of the linear conductor. The linear element is adjacent to only the periphery of the antenna forming face, so that a portion of the linear element does not become adjacent to other portions.

The dielectric antenna according to the first invention is a so-called reverse F-type antenna. The linear element extends adjacent to only the periphery of the antenna forming face in the rectangular shape, so that a region on the antenna forming face can be effectively utilized as much as possible. In other words, by arranging the bending portion included in the linear element at a corner of the antenna forming face, and by arranging a linear portion included in the linear element along a linear portion (side) of the antenna forming face, a length of the linear element can be set longer as compared to other linear elements having a different shape in the same dimension. By setting the length of the linear element longer, a resonance frequency of the linear element decreases, so that the antenna itself can be miniaturized accordingly. Further, the linear element is adjacent to only the periphery of the antenna forming face, so that portions of the linear element do not become adjacent to each other. Therefore, mutual interference which easily occurs when the portions of the linear element are adjacent to each other does not occur, so that decrease of radiation efficiency of radio wave and hindrance to widening a band of radio wave can be eliminated as much as possible.

A dielectric antenna according to a second invention is made by adding limitations to the structure of the dielectric antenna according to the first invention, wherein the bending portion comprises a first bending portion and a second bending portion which are located in order from the base end to a tip, wherein the linear element comprises a first portion located between the base end and the first bending portion, a second portion located between the first bending portion and the second bending portion, and a third portion located between the second bending portion and the tip, and wherein the first portion and the third portion oppose each other with the maximum length on the antenna forming face there between. In other words, only the first bending portion and the second bending portion are the bending portions, so that the shape of the linear element itself become similar to a U shape (reverse U shape), and the first portion and the third portion oppose each other with the maximum length there between.

By the dielectric antenna according to the second invention, in addition to the operational effect of the dielectric antenna according to the first invention, degree of interference between the opposing portions of the linear element to be caused by its bending can be decreased as much as possible. Specifically, the above-described first portion and the third portion oppose each other on the antenna forming face, but a distance between the both is set as far away as possible from each other, so that the mutual interference between the first portion and the third portion which oppose each other can be most effectively eliminated on the antenna forming face.

A dielectric antenna according to a third invention is made by adding limitations to the structure of the dielectric antenna according to the first invention, wherein the bending portion comprises a first bending portion, a second bending portion, and a third bending portion which are located in order from the base end to the tip, wherein the linear element comprises a first portion located between the base end and the first bending portion, a second portion located between the first bending portion and the second bending portion, a third portion located between the second bending portion and the third bending portion, and a fourth portion located between the third bending portion and the tip, wherein the first portion and the third portion oppose each other with the maximum length on the antenna forming face there between, and wherein the second portion and the fourth portion oppose each other with the maximum length on the antenna forming face there between. In other words, it is a structure made by adding the third bending portion to the linear element of the dielectric antenna according to the second invention. Consequently, the first portion and the third portion as well as the second portion and the fourth portion respectively oppose each other with the maximum length on the antenna forming face there between. The dielectric antenna according to the third invention is especially effective for resonating at a resonance frequency which is lower than that of the dielectric antenna according to the second invention on an antenna forming face having the same size, and for resonating at a frequency which is the same as the resonance frequency of the dielectric antenna according to the second invention on an antenna forming face having a smaller size.

By the dielectric antenna according to the third invention, in addition to the operational effect of the dielectric antenna according to the first invention, degree of interference between the opposing portions of the linear element to be caused by its bending can be decreased as much as possible. Specifically, the first portion and the third portion as well as the second portion and the fourth portion respectively oppose each other on the antenna forming face, but the distances between the both are set as far away as possible from each other, so that the mutual interference between the first portion and the third portion as well as the second portion and the fourth portion which respectively oppose each other can be most effectively eliminated on the antenna forming face.

A dielectric antenna according to a fourth invention is made by adding a limitation to the structure of the dielectric antenna according to any one of the first invention to third invention, in which at least a portion of the linear conductor bends or meanders.

By the dielectric antenna according to the fourth invention, in addition to the operational effect of the dielectric antenna according to any one of the first invention to third invention, a substantial length of the linear conductor can be lengthened on the same antenna forming face by bending or meandering at least a portion of the linear conductor. Since the linear conductor, which short-circuits to the ground, contributes to the resonance of the linear element but does not contribute to radiation of radio wave, it hardly causes mutual interference similar to that caused by the linear element even when portions of the conductor are adjacent to each other due to bending or meandering. Therefore, it becomes possible to bend or meander the linear conductor, so that the substantial length thereof can be made longer in a limited dimension, and thus the antenna can be miniaturized accordingly without affecting its characteristics.

A dielectric antenna according to a fifth invention is made by adding limitations to the structure of the dielectric antenna according to any one of the first invention to fourth invention, wherein the dielectric base has four end faces, wherein the power supply terminal is formed on any one of the four end faces, and wherein the ground terminal is formed on an end face which opposes the end face on which the power supply terminal is formed.

By the dielectric antenna according to the fifth invention, in addition to the operational effect of the dielectric antenna according to any one of the first inventions to fourth invention, a dielectric antenna can be provided in a form adapted to a condition of a mounting target. Specifically, there are various forms of the mounting targets, and among them, there may be a one, which requires the power supply terminal and the ground terminal to be arranged opposite to each other. The above-described dielectric antenna can be adapted to such a condition of the mounting target.

A dielectric antenna according to a sixth invention is made by adding a limitation to the structure of the dielectric antenna according to any one of the first invention to fifth invention, which further includes a linear sub-element branching from the linear element and capable of resonating at a second resonance frequency which is different from a first resonance frequency at which the linear element is capable of resonating. Since the linear element extends along the periphery of the antenna forming face, a portion, which is adjoined or surrounded by the linear element, becomes available for use. This available portion increases freedom of antenna design, and the linear sub-element can be formed using this portion.

By the dielectric antenna according to the sixth invention, in addition to the operational effect of the dielectric antenna according to any one of the first invention to fifth invention, the resonance frequency of the dielectric antenna itself can be widen in band or dual-banded by including the linear sub-element. Specifically, when a difference between the first resonance frequency and the second resonance frequency is set to such degree that the center frequencies of the both are slightly displaced, a resonance frequency of the whole dielectric antenna can be widen in band by combining the former and the latter. Further, by making the difference between the first resonance frequency and the second resonance frequency adequate to be independent, it becomes a dual-band dielectric antenna.

A dielectric antenna according to a seventh invention is made by adding a limitation to the structure of the dielectric antenna according to the sixth invention, in which the linear sub-element is set to be capable of resonating at a ½ wave length of the second resonance frequency.

By the dielectric antenna according to the seventh invention, in addition to the operational effect of the dielectric antenna according to the sixth invention, the linear sub-element resonates at the ½ wavelength of the second resonance frequency. It is not intended to eliminate other wavelengths such as one wavelength or a ¼-wave length.

A dielectric antenna according to an eighth invention is made by adding limitations to the structure of the dielectric antenna according to the sixth invention or the seventh invention, wherein the antenna forming face of the dielectric base comprises a first antenna forming face, and a second antenna forming face which is different from the first antenna forming face, wherein the linear element is formed on the first antenna forming face, and wherein the linear sub-element is formed on the second antenna forming face.

By the dielectric antenna according to the eighth invention, in addition to the operational effect of the dielectric antenna according to the sixth invention or the seventh invention, the antenna forming faces which are made different can provide a dimension which is substantially double as compared to the case that the both are the same, which can increase design freedom of the linear element and the linear sub-element.

A dielectric antenna according to a ninth invention is made by adding limitations to the structure of the dielectric antenna according to the eighth invention, in which a connecting portion is formed on the base end portion of the linear sub-element, and only the connecting portion is connected to a mid-portion of the linear element through a capacitor structure.

The dielectric antenna according to the ninth invention is a so-called reverse F-type antenna. The linear element extends adjacent to the periphery of the antenna forming face in the rectangular shape, so that a region on the antenna forming face can be effectively utilized as much as possible. In other words, by arranging the bending portion included in the linear element at a corner of the antenna forming face, and by arranging a linear portion included in the linear element along a linear portion (side) of the antenna forming face, a length of the linear element can be set longer as compared to other linear elements having a different shape in the same dimension. By setting the length of the linear element longer, a resonance frequency of the linear element decreases, so that the antenna itself can be miniaturized accordingly. Further, a portion, which is surrounded by the linear element, becomes available for use. This available portion increases freedom of antenna design, and the linear sub-element can be formed using this portion to avoid an unnecessary overlapping in a thickness direction of the dielectric base. The reason to avoid the unnecessary overlapping is to prevent the mutual interference between the linear element and the linear sub-element as much as possible. The linear sub-element is connected to the linear element by the connection through the capacitor structure. When a difference between the first resonance frequency and the second resonance frequency is set to such degree that the center frequencies of the both are slightly displaced, a resonance frequency of the whole dielectric antenna can be widen in band by combining the first resonance frequency and the second resonance frequency. Further, by making the difference between the first resonance frequency and the second resonance frequency adequate to be independent, it becomes a dual-band dielectric antenna.

A dielectric antenna according to a tenth invention is made by adding limitations to the structure of the dielectric antenna according to the eighth invention, in which a connecting portion is formed on the base end portion of the linear sub-element, and only the connecting portion opposes a mid-portion of the linear element through a part or the whole of a thickness direction of the dielectric base. The "only the connecting portion" means that portions other than the connecting portion of the linear sub-element do not oppose, in other words, do not overlap any portion of the linear element through the part or the whole of the thickness direction of the dielectric base.

The dielectric antenna according to the tenth invention is a so-called reverse F-type antenna. The linear element extends adjacent to the periphery of the antenna forming face in the rectangular shape, so that a region on the antenna forming face can be effectively utilized as much as possible. In other words, by arranging the bending portion included in the linear element at a corner of the antenna forming face, and by arranging a linear portion included in the linear element along a linear portion (side) of the antenna forming face, a length of the linear element can be set longer as compared to other linear elements having a different shape in the same dimension. By setting the length of the linear element longer, a resonance frequency of the linear element decreases, so that the antenna itself can be miniaturized accordingly. Further, a portion, which is surrounded by the linear element, becomes available for use. This available portion increases freedom of antenna design, and the linear sub-element can be formed using this portion to avoid an unnecessary overlapping in a thickness direction of the dielectric base. The reason to avoid the unnecessary overlapping is to prevent the mutual interference between the linear element and the linear sub-element as much as possible. The linear sub-element is connected to the linear element through the part or the whole of the thickness direction of the dielectric base. When a difference between the first resonance frequency and the second resonance frequency is set to such degree that the center frequencies of the both are slightly displaced, a resonance frequency of the whole dielectric antenna can be widen in band by combining the first resonance frequency and the second resonance frequency. Further, by making the difference between the first resonance frequency and the second resonance frequency adequate to be independent, it becomes a dual-band dielectric antenna.

A dielectric antenna according to an eleventh invention is made by adding limitations to the structure of the dielectric antenna according to any one of the eighth invention to tenth invention, which further includes a connecting conductor which connects the base portion of the linear sub-element and the mid-portion of the linear element, in which a part or the whole of the connecting conductor is arranged on any one of the four end faces. The connecting conductor composes a part of the linear sub-element. The reason of arranging "a part or the whole" is that, for example, when the linear element is adjacent to a periphery of the first antenna forming face without a margin, the connecting conductor is not needed to be extended onto the first antenna forming face, so that the whole of the connecting conductor is arranged on the end face of the periphery of the dielectric base, but when there is a margin therebetween, the connecting conductor is extended onto the first antenna forming face by an amount of the margin, so that only the part of the connecting conductor is arranged on the end face of the periphery.

The dielectric antenna according to the eleventh invention is a so-called reverse F-type antenna, which resonates at least at the first resonance frequency and at the second resonance frequency. Since the part or the whole of the connecting conductor is arranged on the end face of the periphery, a path leading from the linear element to the linear sub-element becomes longer than the case that, for example, the path penetrates a dielectric layer. By the length made longer, the length of the linear sub-element on the antenna forming face becomes shorter. By making the length of the linear sub-element shorter, although being made in a small size, mutual interference between elements can be restrained. Then, this restraint eliminates the decrease of radiation efficiency of radio wave and the hindrance to widening the band of radio wave as much as possible.

A dielectric antenna according to a twelfth invention is made by adding limitations to the structure of the dielectric antenna according to the eleventh invention, in which the first antenna forming face is formed in a rectangular shape, and the linear element is formed adjacent to the periphery of the first antenna forming face.

By the dielectric antenna according to the twelfth invention, in addition to the operational effect of the dielectric antenna according to the eleventh invention, the linear element extends adjacent to the periphery of the antenna forming face in the rectangular shape, so that a region on the antenna forming face can be effectively utilized as much as possible. In other words, the length of the linear element can be set longer as compared to other linear elements having a different shape in the same dimension, which lowers the resonance frequency accordingly, so that the first linear antenna itself can be miniaturized. Furthermore, the existence of the connecting conductor allows the length of the linear sub-element on the second antenna forming face to be shortened accordingly.

A dielectric antenna according to a thirteenth invention is made by adding limitations to the structure of the dielectric antenna according to the eighth invention, which further includes a connecting portion which connects the linear sub-element and the linear element, in which intersection between the linear element and the linear sub-element is only the connecting portion.

By the dielectric antenna according to the thirteenth invention, the linear element is adjacent to a periphery of the antenna forming face, so that a portion surrounded by the linear element in a thickness direction of the dielectric base becomes a blank space. When the linear sub-element is formed using this blank space, it is not necessary to intersect (overlap) the linear element except the connecting portion. Accordingly, mutual interference between elements due to an unnecessary intersection does not occur, so that it becomes a wide-band antenna with good radiation efficiency although it is small sized. The fact that the mutual interference does not occur simplifies to make adjustment of the linear element independent from adjustment with the linear sub-element. In other words, an influence of adjusting one side on adjusting the other side is decreased, thereby making the adjustment easy. A high-frequency current supplied to the power supply terminal flows straight in a direction of the tip of the linear element, or flows from the way through the connecting portion in a direction of the tip of the linear sub-element.

A dielectric antenna according to a fourteenth invention is made by adding a limitation to the structure of the dielectric antenna according to the thirteenth invention, in which the connecting portion is formed by a base end portion of the linear sub-element, which opposes the linear element with a part or the whole of the dielectric base in a thickness direction intervening there between.

By the dielectric antenna according to the fourteenth invention, in addition to the operational effect of the dielectric antenna according to the thirteenth invention, the connection between the linear element and the linear sub-element is made by the part or the whole of the dielectric base. Accordingly, the both elements are connected by capacitive coupling.

A dielectric antenna according to a fifteenth invention is made by adding limitations to the structure of the dielectric antenna according to the thirteenth invention, in which the connecting portion is formed by a connecting conductor which connects a base end portion of the linear sub-element and a mid-portion of the linear element, and a part or the whole of the connecting conductor is arranged on any one of the four end faces.

By the dielectric antenna according to the fifteenth invention, in addition to the operational effect of the dielectric antenna according to the thirteenth invention, the connection between the linear element and the linear sub-element is made by the base end portion of the latter and the connecting conductor.

A dielectric antenna according to a sixteenth invention is made by adding limitations to the structure of the dielectric antenna according to any one of the eighth invention to fifteenth invention, in which the dielectric base is formed of a single dielectric layer, the first antenna forming face is one face of the dielectric layer, and the second antenna forming face is the other face of the dielectric layer. In other words, both the front and back faces of the single dielectric layer are the antenna forming faces.

By the dielectric antenna according to the sixteenth invention, in addition to the operational effect of the dielectric antenna according to any one of the eighth invention to fifteenth invention, the dielectric layer forming the dielectric base can be used for the connection through a capacitor structure. Therefore, a special structure is not necessary for making the connection through the capacitor structure. Since the special structure is not necessary, the dielectric antenna can be miniaturized accordingly.

A dielectric antenna according to a seventeenth invention is made by adding limitations to the structure of the dielectric antenna according to any one of the eighth invention to fifteenth invention, in which the dielectric base is a multi-layered body composed of plural dielectric layers, and the first antenna forming face and the second antenna forming face are formed on the same dielectric layer or different dielectric layers. It is not intended to hinder the formation of the dielectric base in a single layer, but is intended to prevent a hindrance to the formation of the multi-layered body when it is advantageous to form multi-layered body, for example, for production of the dielectric base and for formation of elements.

By the dielectric antenna according to the seventeenth invention, in addition to the operational effect of the dielectric antenna according to any one of the eighth to fifteenth invention, the dielectric base formed by the multi-layered body can be simply produced as compared to the case of the single layer, and a thickness of the dielectric base itself can be easily adjusted by increasing/decreasing the number of layers.

A dielectric antenna according to an eighteenth invention includes: a dielectric base having an antenna forming face; a linear element extending on the antenna forming face adjacent to a periphery of the antenna forming face and is capable of resonating at a first resonance frequency; a power supply terminal connected to a base end portion of the linear element; a linear conductor branching in the vicinity of the base end portion of the linear element; a ground terminal connected to a tip of the linear conductor; and a linear sub-element formed on the antenna forming face and is capable of resonating at a second resonance frequency which is different from the first resonance frequency, in which a base end of the linear sub-element is connected to a mid-portion of the linear element through a capacitor structure. In other words, the linear sub-element is formed on the same antenna forming face on which the linear element is formed, and the both are connected through the capacitor structure.

The dielectric antenna according to the eighteenth invention is a so-called reverse F-type antenna. The linear element extends adjacent to the periphery of the antenna forming face in the rectangular shape, so that a region on the antenna forming face can be effectively utilized as much as possible. In other words, by arranging a bending portion included in the linear element at a corner of the antenna forming face, and by arranging a linear portion included in the linear element along a linear portion (side) of the antenna forming face, a length of the linear element can be set longer as compared to other linear elements having a different shape in the same dimension. By setting the length of the linear element longer, a resonance frequency of the linear element decreases, so that the antenna itself can be miniaturized accordingly. Further, a portion, which is surrounded by the linear element, becomes available for use. The linear sub-element is connected to the linear element by the connection through the capacitor structure. When a difference between the first resonance frequency and the second resonance frequency is set to such degree that the center frequencies of the both are slightly displaced, a resonance frequency of the whole dielectric antenna can be widen in band by combining the first resonance frequency and the second resonance frequency. Further, by making the difference between the first resonance frequency and the second resonance frequency adequate to be independent, it becomes a dual-band dielectric antenna.

A mobile communication device according to a nineteenth invention includes the dielectric antenna according to any one of the first to eighteenth inventions. Examples of this mobile communication device include a cellular phone, a small-sized computer having a communication function, and the like.

The mobile communication device according to the nineteenth invention includes the dielectric antenna of any one of the first invention to eighteenth invention, and this dielectric antenna is miniaturized as compared to the conventional one as described above. Accordingly, the mobile communication device including such the dielectric antenna can be miniaturized by the amount of miniaturization of the dielectric antenna, or the mobile communication device having the same size can have more space inside.

An antenna mounting substrate according to a twentieth invention includes: a mounting face which is laterally long and having a bottom side; and a chip antenna and a ground portion adjacent to each other along the bottom side on the mounting face, in which the mounting face between the chip antenna and the bottom side is provided with a linear conductor having a predetermined length, the linear conductor connecting one end thereof only to the ground portion. The bottom side refers to a side (edge) that faces an antenna mounting body (for example, a small-sized computer) when mounting the antenna mounting substrate on the antenna mounting body. The shape of the mounting face is not particularly limited as long as it has the bottom side, but it is generally a quadrangle (rectangle), which is laterally long. An antenna structure of the chip antenna is not particularly limited, but examples of which include a whip antenna, a reverse L antenna, a reverse F antenna, and other linear antennas or planar antennas. The linear conductor connects one end thereof only to the ground portion, and the linear conductor is structured not to be connected to other portions on the antenna mounting substrate or to portions other than the antenna mounting substrate (for example, the antenna mounting body) in order to avoid influence of the connection target. The linear conductor may be one, which is integrated with the ground portion, or may be one, which is separated. For example, it may be pattern-formed with the ground portion using a conductive paste or the like, or formed by a conducting wire provided on the mounting face. The thickness (height) of the linear conductor is not limited. It may be thinner or thicker than the thickness of the chip antenna.

By the antenna mounting substrate according to the twentieth invention, when mounted on the antenna mounting body, the chip antenna can decrease influence from the antenna mounting body by the operation of the linear conductor. Accordingly, a distance between the chip antenna and the antenna mounting body can be shortened, which contributes to miniaturization of the antenna mounting substrate. Further, since the influence of the antenna mounting body is low, the antenna mounting substrate can perform stably even when there is a change in a mounting environment.

An antenna mounting substrate according to a twenty-first invention is made by adding limitations to the structure of the antenna mounting substrate according to the twentieth invention, in which the chip antenna comprises one end face located on the ground portion side and the other end face located on the opposite side of the one end face, and one end of the linear conductor and the other end on the opposite side thereof are formed to cross a perpendicular line drawn along the other end face toward the bottom side. In other words, the antenna mounting substrate is structured in a state that there is only the linear conductor exist between the chip antenna and the bottom side.

By the antenna mounting substrate according to the twenty-first invention, in addition to the operational effect of the antenna mounting substrate according to the twentieth invention, the linear conductor is located between the chip antenna and the bottom side without having an insufficient length in a longitudinal direction, which assures prevention of the influence from the antenna mounting body when the antenna mounting substrate is mounted on it as compared to the case of not crossing the perpendicular line (insufficient or short).

An antenna mounting substrate according to a twenty-second invention is made by adding a limitation to the structure of the antenna mounting substrate according to the twentieth invention or the twenty-first invention, in which the linear conductor is integrated with the ground portion.

By the antenna mounting substrate according to the twenty-second invention, in addition to the operational effect of the antenna mounting substrate according to the twentieth invention or the twenty-first invention, the integral formation of the linear conductor and the ground portion reduces the number of steps than a separate formation thereof, thereby simplifying the production.

An antenna mounting substrate according to a twenty-third invention is made by adding a limitation to the structure of the antenna mounting substrate according to the twenty-second invention, in which the linear conductor and the ground portion are formed by a conductor pattern. The conductor pattern can be formed, for example, by applying a conductive paste or by removing unnecessary portions by etching.

By the antenna mounting substrate according to the twenty-third invention, in addition to the operational effect of the antenna mounting substrate according to the twenty-second invention, since the linear conductor and the ground portion are formed by the conductor pattern, the antenna forming substrate can be produced thinner without requiring much labor.

An antenna mounting substrate according to a twenty-fourth invention is made by adding limitations to the structure of the antenna mounting substrate according to any one of the twentieth invention to twenty-third invention, which further comprises an exposure portion for insulation formed by exposing in a predetermined shape the mounting face along the entire length of the bottom side. The shape of the exposure portion for insulation is not limited, and for example, the width thereof can be widened or narrowed according to the shape of the ground portion.

By the antenna mounting substrate according to the twenty-fourth invention, in addition to the operational effect of the antenna mounting substrate according to any one of the twentieth invention to twenty-third invention, the linear conductor and the ground portion do not face the bottom side of the mounting face due to the existence of the exposure portion for insulation. Consequently, when the antenna mounting substrate is brought into contact with the antenna mounting body that is a conductor, the linear conductor or the ground portion do not electrically short-circuit with the antenna mounting body, which contributes to stable operation of the entire antenna mounting substrate.

An antenna mounting substrate according to a twenty-fifth invention is made by adding a limitation to the structure of the antenna mounting substrate according to the twenty-fourth invention, in which the exposure portion for insulation is formed in a linear shape.

By the antenna mounting substrate according to the twenty-fifth invention, in addition to the operational effect of the antenna mounting substrate according to the twenty-fourth invention, the exposure portion for insulation is formed in the linear shape, so that the breadth (height) of the portion can be reduced as much as possible. As a result, a height of the entire antenna mounting substrate can be reduced, which contributes to the miniaturization thereof.

An antenna mounting substrate according to a twenty-sixth invention is made by adding a limitation to the structure of the antenna mounting substrate according to any one of the twentieth invention to twenty-fifth invention, in which the chip antenna is a dielectric antenna composed by forming an element on a dielectric layer.

By the antenna mounting substrate according to the twenty-sixth invention, in addition to the operational effect of the antenna mounting substrate according to any one of the twentieth invention to twenty-fifth invention, the dielectric antenna is adopted as the chip antenna, thereby realizing the further miniaturization of the antenna mounting substrate and an efficient production of the chip antenna. Specifically, the dielectric antenna is generally produced by forming an element by a conductive paste or the like on its dielectric layer, so that the antenna can be smaller as compared to the case of forming the element by a conductive wire. Further, the production of the dielectric antenna is generally performed by dividing an aggregate of dielectric antennas because it is more efficient than making the antenna one by one. The efficient production of the chip antenna facilitates efficient production of the antenna mounting substrate.

A communication device according to a twenty-seventh invention includes the antenna mounting substrate according to any one of the twentieth invention to twenty-sixth invention. Examples of the communication device include a small-sized computer, a PDA (Personal Digital Aid), a cellular phone, and a small-sized radio for amateur/professional use.

The communication device according to the twenty-seventh invention includes the antenna mounting substrate according to any one of the twentieth invention to twenty-sixth invention, and since the antenna mounting substrate is small, an installation space for the substrate can be relatively small. Further, the antenna mounting substrate is hardly affected by the communication device that is the antenna mounting body, so that communication, which is efficient and easily adjusted, can be performed.

A communication device according to a twenty-eighth invention is made by adding a limitation to the communication device according to the twenty-seventh invention, in which the communication device is a small-sized computer.

By the communication device according to the twenty-eighth invention, in addition to the operational effect of the communication device according to the twenty-seventh invention, since the antenna mounting substrate is small, it can be installed in the small-sized computer having a limited space, and the antenna mounting substrate is hardly affected by a metal frame of the small-sized computer when installed therein.

BEST MODE FOR CARRYING OUT THE INVENTION

Figure 1:
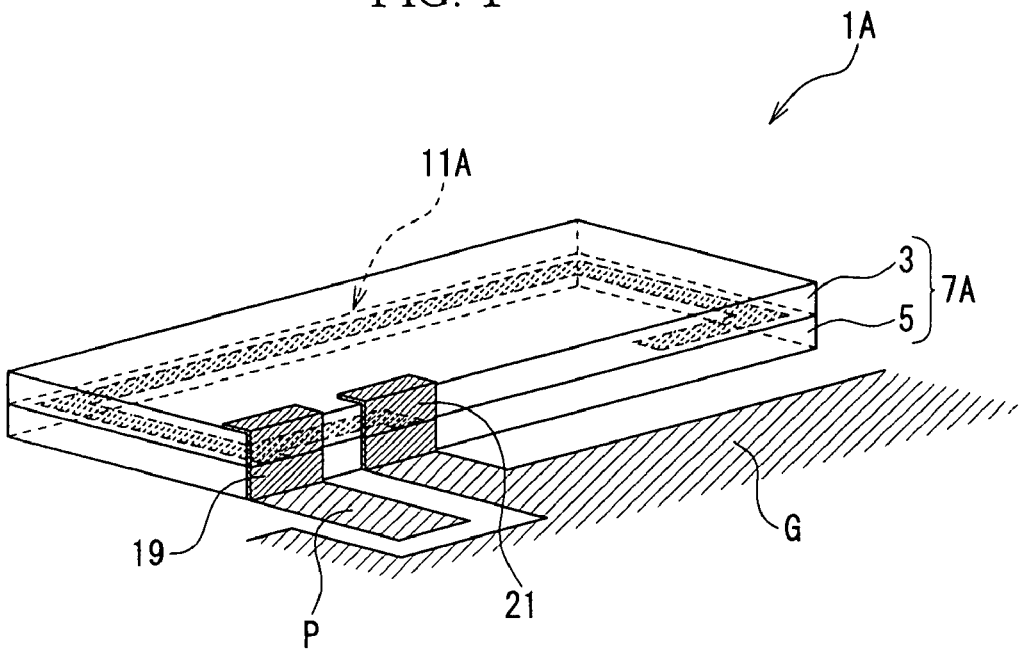
FIG. 1 is a perspective view of a dielectric antenna according to a first embodiment.

A dielectric antenna according to a first embodiment will be explained based on FIGS. 1 to 3. A dielectric antenna 1A has a dielectric base 7A formed by layering an upper substrate 3 and a lower substrate 5, which are insulating and composed of a dielectric ceramic material. The upper substrate 3 and the lower substrate 5 are formed in a rectangle (quadrangle) having the same size when observed in a plan view, so that the dielectric base 7A formed by layering the both becomes a rectangular parallelepiped shape. A front face of a top face (a face opposing the upper substrate 3) of the lower substrate 5 forms an antenna forming face 9 for forming an antenna. Since the lower substrate 5 is a rectangle, the antenna forming face 9 is also a rectangle (quadrangle). The reason of forming the dielectric base 7A by a multi-layered body is that an element and so on (described later) to be formed on the lower substrate 5 are preferred to be covered by the upper substrate 3 for protection. The dielectric base 7A is formed as a two-layer structure, but may be formed as a single layer structure omitting the upper substrate 3. Further, the dielectric base 7A may be structured as three-layer, four-layer or more by further layering other substrates. Further, each of the substrate may be a single layer body or a multi-layered body. The reason of forming the dielectric base 7A in the rectangular parallelepiped shape is to facilitate a multi-getting by so-called die cutting or the like. Needless to say, the dielectric base may be formed in other shapes.

Figure 2:
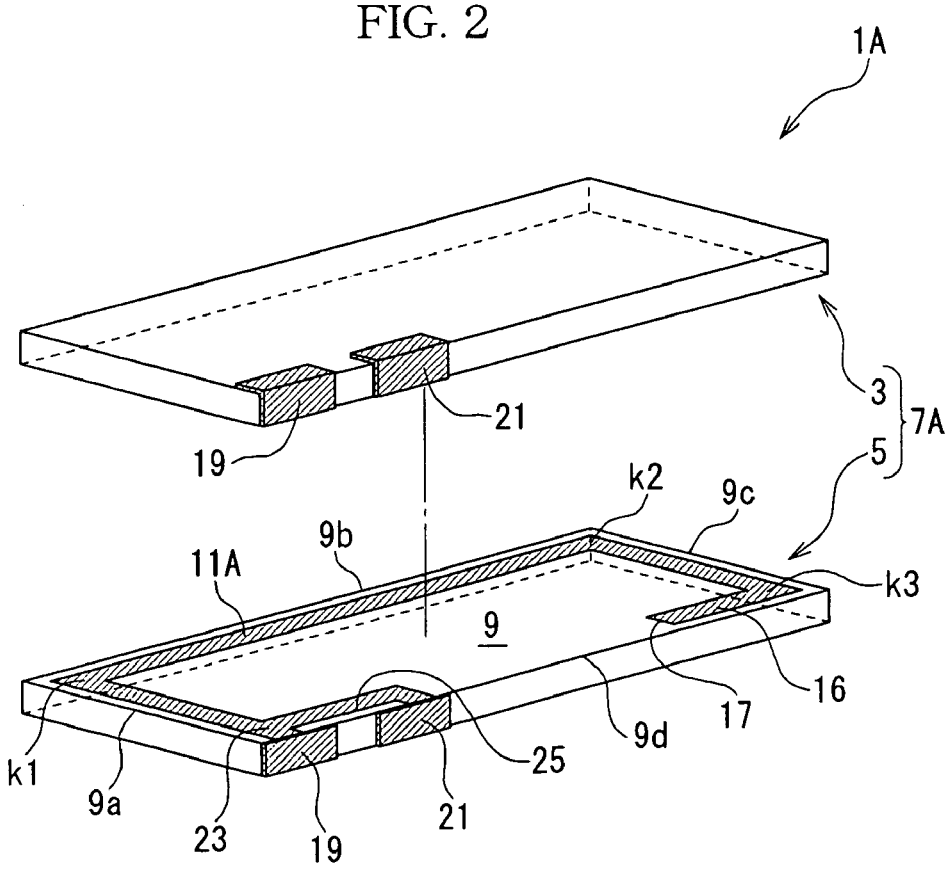
FIG. 2 is an exploded perspective view of the dielectric antenna shown in FIG. 1.
Figure 3:
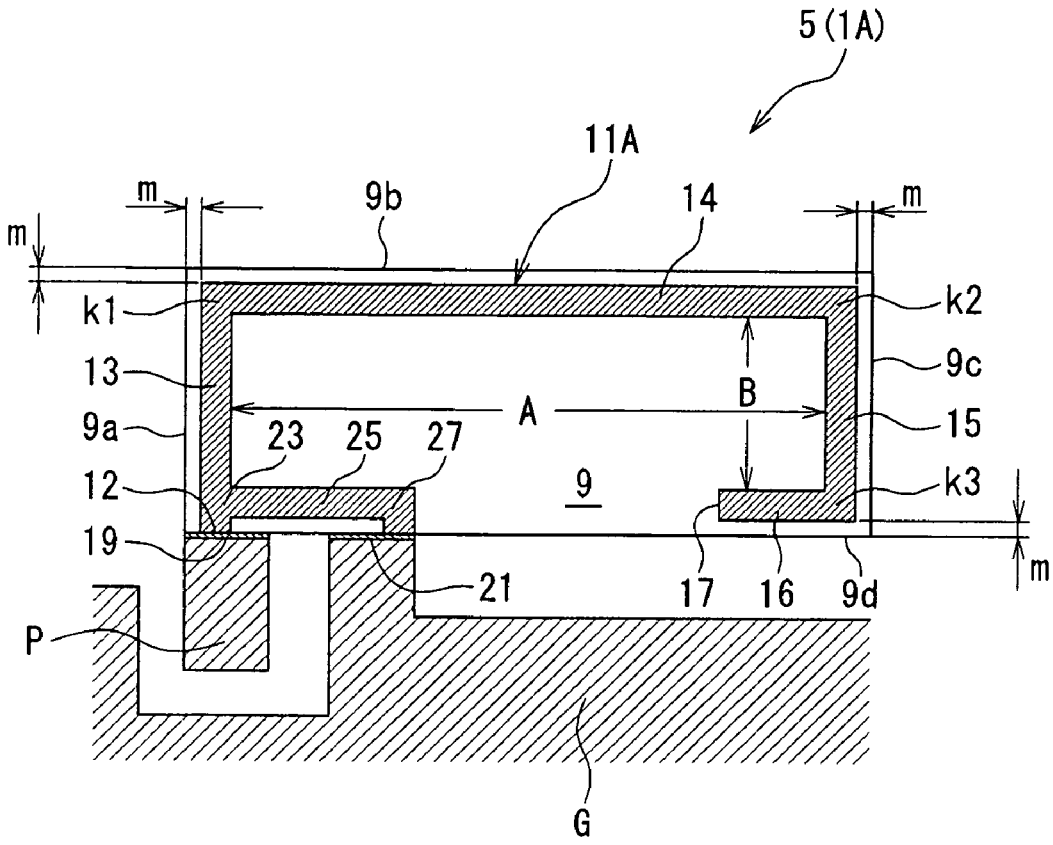
FIG. 3 is a plan view of the dielectric antenna shown in FIG. 1 in a state that an upper substrate thereof is omitted.

As shown in FIGS. 2 and 3, on the antenna forming face 9, there is formed a linear element 11A which is only adjacent to (parallel to) peripheries (9*a*, 9*b*, 9*c*, and 9*d*) of the antenna forming face 9. Formation of the linear element 11A is convenient to be carried out by printing a conductive paste, and margins m, m (refer to FIG. 3) are preferred to be left between the linear element and the peripheries 9*a*, 9*b*, 9*c*, and 9*d* for absorbing a printing displacement during printing. The margins may be omitted when it will not be a problem to have a small printing displacement, or when the margins themselfs are not necessary.

As shown in FIGS. 2 and 3, the linear element 11A is composed of a first portion 13, a second portion 14, a third portion 15 and a fourth portion 16. The first portion 13 of the linear element 11A is a portion located between a base end 12 and a first bending portion k1, and the second portion 14 of the linear element is a portion located between the first bending portion k1 and a second bending portion k2. Further, the third portion 15 of the linear element is a portion located between the second bending portion k2 and a third bending portion k3, and the fourth portion 16 of the linear element is a portion located between the third bending portion k3 and an open end 17. That is to say, the first portion 13 is adjacent to the periphery 9*a*, the second portion 14 is adjacent to the periphery 9*b*, the third portion 15 is adjacent to the periphery 9*c*, and the fourth portion 16 is adjacent to the periphery 9*d* respectively. In addition, the bending portions k1, k2, and k3 are located at respective corners of the antenna forming face 9, so that the linear element 11A extends in an outside curling shape along the peripheries 9*a*, 9*b*, 9*c*, and 9*d* on the antenna forming face 9. The base end 12 of the linear element 11A is connected to a power supply terminal 19 formed on an end face of the dielectric base 7A as shown in FIGS. 1 to 3. Formation of the power supply terminal 19 is generally performed by applying a conductive paste on the end face of the dielectric base 7A.

The reason of forming the linear element 11A in the outside curling shape as described above is that, when formed on an antenna forming face having the same dimension, it takes a circuitous route as compared to the linear element in a different shape which is not formed in the outside curling shape, so that the length of the linear element can be lengthened by the length of the circuitous route. When the length of the linear element becomes longer, a resonance frequency lowers accordingly, so that the linear element can resonate at a low frequency in the same dimension. In other words, the same frequency can resonate in a smaller dimension, so that the antenna itself is miniaturized as a result. Further, by forming the linear element 1A in the outside curling shape, a distance A (refer to FIG. 3) between the first portion 13 and the third portion 15 and a distance B between the second portion 14 and the fourth portion 16, both of which oppose each other, respectively become the maximum on the antenna forming face 9. Since the distances are the maximum, it becomes possible to effectively eliminate mutual interference between the first portion 13 and the third portion 15 and between the second portion 14 and the fourth portion 16 on the same antenna forming face 9.

On the other hand, in order to miniaturize the dielectric base 7A itself by reducing the dimension of the antenna forming face 9, it is conceivable, for example, that the second bending portion k2 and the third bending portion k3 are moved, by shortening the second portion 14 in FIG. 3, toward the left side from its position shown in the drawing, and the fourth portion 16 is lengthened by an equal length to the shortened length of the second portion 14, and a right portion of the dielectric base shown in the drawing which becomes unnecessary is erased. When this method is adopted, the antenna forming face 9 (the dielectric base 7A) itself becomes small, but since the fourth portion 16 is lengthened, there may be a case that the entire length which is lengthened may not fall into the antenna forming face 9.

In this case, there rises a need for bending a part of the fourth portion 16 in an upward direction (a direction where the second portion 14 exists). The bent part of the fourth portion 16 becomes a parallel portion adjacent to the first portion 13. Accordingly, interference can easily occur between the first portion 13 and the bent part of the fourth portion 16. When the interference occurs, it may cause a bad effect on antenna characteristics. Further, as another method for falling a long element into a small dimension, it is conceivable to partly meander (to form in a meander shape) the linear element 11A. However, such a meandering makes portions of the element to be adjacent to each other to generate the mutual interference, which may also cause the bad effect on the antenna characteristics. Therefore, in this embodiment, the above-mentioned structures are not adopted.

The linear element 11A is formed to have a length (¼ wave length) capable of resonating at a 2.4 GHz band, which is a first frequency (first frequency band), and the resonance frequency is adjusted by displacing the position of the open end 17 in the right/left direction in FIG. 3, in other words, by adjusting the entire length of the linear element 11A. For resonating at a frequency higher than the 2.4 GHz band, the open end is moved in a direction, which shortens an effective length of the linear element 11A. On the other hand, for resonating at a frequency band lower than the first frequency, the open end is moved in a direction, which lengthens the effective length of the linear element. The reason of setting the 2.4 GHz band as the first frequency is that the frequency is currently used for cellular phones and the like, and is not to hinder setting of other frequencies (such as 2.0 GHz or 5.0 GHz) as necessary.

A linear conductor will be explained based on FIGS. 1 to 3. A linear conductor 25 provided on the antenna forming face 9 is a conductor for matching impedance at the power supply terminal 19 which is a power supply point. The linear conductor 25 branches on the antenna forming face at a branch point 23 in the vicinity of the base end 12 of the linear element, and a tip thereof is connected through a bending portion 27 to a ground terminal 21 provided on an end face of the dielectric base 7A. The linear conductor 25 can be formed in a separate step from the linear element 11A, but it is convenient to simultaneously print and form with the linear element 11A using a conductive paste. Adjustment of the power supply point impedance can be carried out by displacing a position of the branch point 23 in a longitudinal direction of the linear element 11A. Further, since the linear conductor 25 is also a part, which contributes to the resonance of the linear element 11A, the resonance frequency of the linear element 11A can be adjusted by adjusting the length of the linear conductor 25. On the other hand, since the linear conductor 25 does not contribute to a radiation of radio wave, it does not cause the mutual interference even when it is located adjacent to the linear element 11A. Further, since it does not cause the mutual interference, the length of the linear conductor 25 can be lengthened on the same antenna forming face 9 by partly bending or meandering the linear conductor 25. Incidentally, formation of the ground terminal 21 is, similarly to the power supply terminal 19, convenient to be performed by applying a conductive paste on the end portion of the dielectric base 7A.

On the back face of the lower substrate 5 (a face of backside of FIG. 3), a dummy electrode (not shown) for firmly soldering the dielectric antenna 1A on a parent substrate (not shown) is provided. When mounting on the parent substrate (not shown), the power supply terminal 19 is connected to a power supply portion P of the parent substrate and the ground terminal 21 is connected to a ground portion G thereof respectively by soldering.

Figure 4:
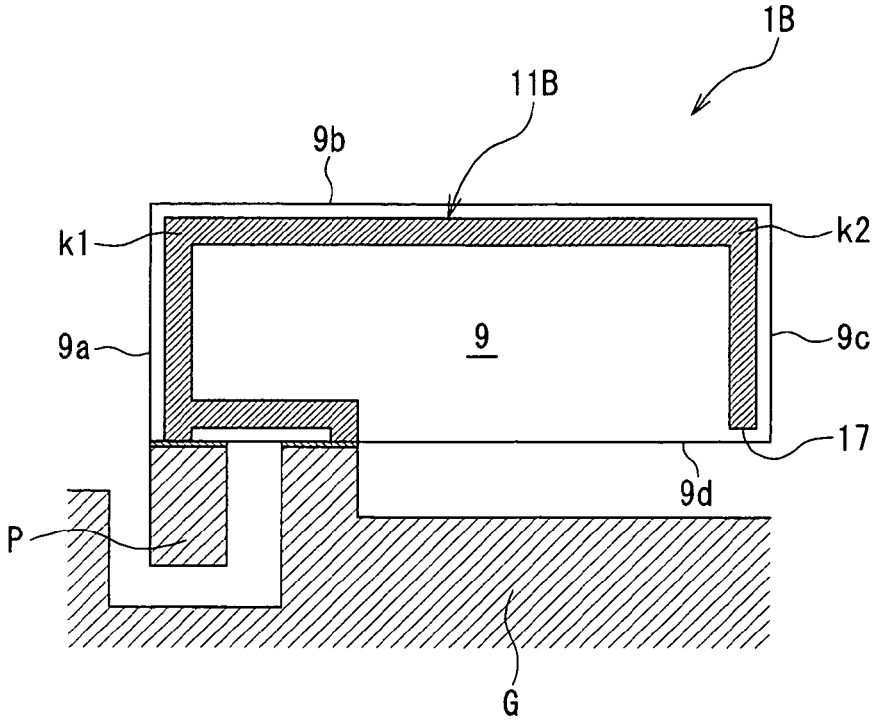
FIG. 4 is a plan view of a dielectric antenna according to a first modification example of the first embodiment in a state that an upper substrate thereof is omitted.

A first modification example of the first embodiment will be explained with reference to FIGS. 4 and 5. Specifically, a dielectric antenna 1B shown in FIG. 4 has basically the same structure as that of the dielectric antenna 1A (refer to FIGS. 1 to 3) described above. A difference between the both is that the entire length of a linear element 11B of the dielectric antenna 1B is shorter than the entire length of the linear element 11A of the dielectric antenna 1A shown in FIG. 3, in other words, the former has a resonance frequency higher than that of the latter. The linear element 11B has the same structure as that of the linear element 11A shown in FIG. 3 with the third bending portion k3 and the subsequent portions thereof being omitted, which thus includes only the two bending portions, the first bending portion k1 and the second bending portion k2. Specifically, the linear element 11B extends in an outside curling shape on the antenna forming face 9 along its peripheries 9*a*, 9*b*, and 9*c*, and its open end 17 is located at an opposite position to the periphery 9*d*. The operational effect of the dielectric antenna 1B is the same as the operational effect of the above-explained dielectric antenna 1A except that the resonance frequency is different.

Figure 5:
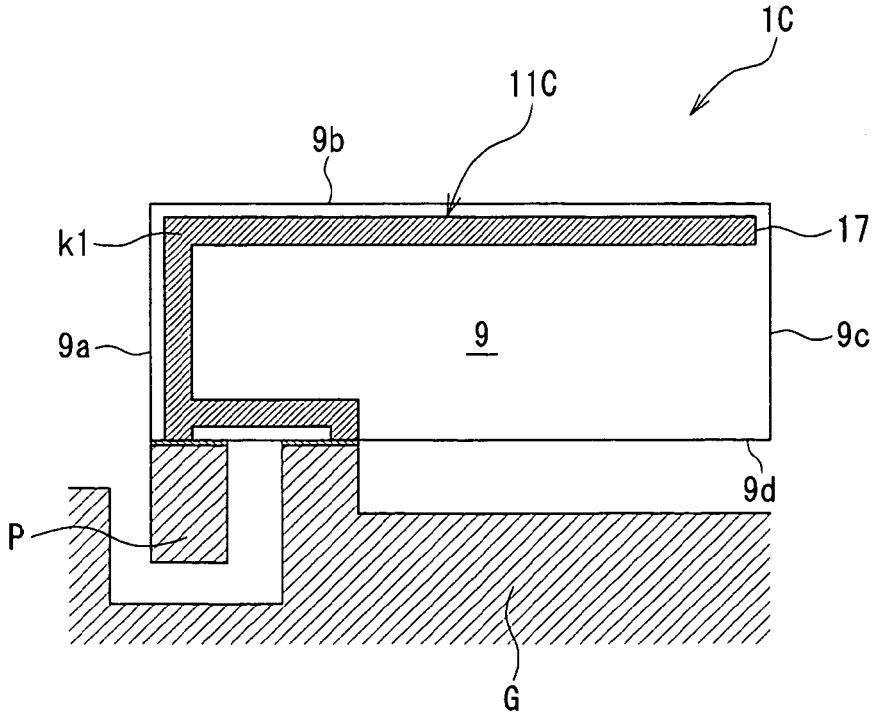
FIG. 5 is a plan view of the dielectric antenna according to the first modification example of the first embodiment in the state that the upper substrate thereof is omitted.

A dielectric antenna 1C shown in FIG. 5 also has basically the same structure as that of the dielectric antenna 1A (refer to FIGS. 1 to 3) described above. A difference between the both is that the entire length of a linear element 11C of the dielectric antenna 1C is further shortened than the entire length of the linear element 11B of the dielectric antenna 1B shown in FIG. 4. To produce an antenna, which resonates at a higher frequency than the dielectric antenna 1B, a structure similar to the dielectric antenna 1C can be adopted. The linear element 11C has the same structure as that of the linear element 11B shown in FIG. 4 with the second bending portion k2 and the subsequent portions thereof being omitted, and the bending portion included therein is only the first bending portion k1. Specifically, the linear element 11C extends in an outside curling shape on the antenna forming face 9 along its peripheries 9*a* and 9*b*, and its open end 17 is located at an opposite position to the periphery 9*c*. The operational effect of the dielectric antenna 1C is also the same as the operational effect of the above-explained dielectric antenna 1A (dielectric antenna 1B) except that the resonance frequency is different.

Figure 6:
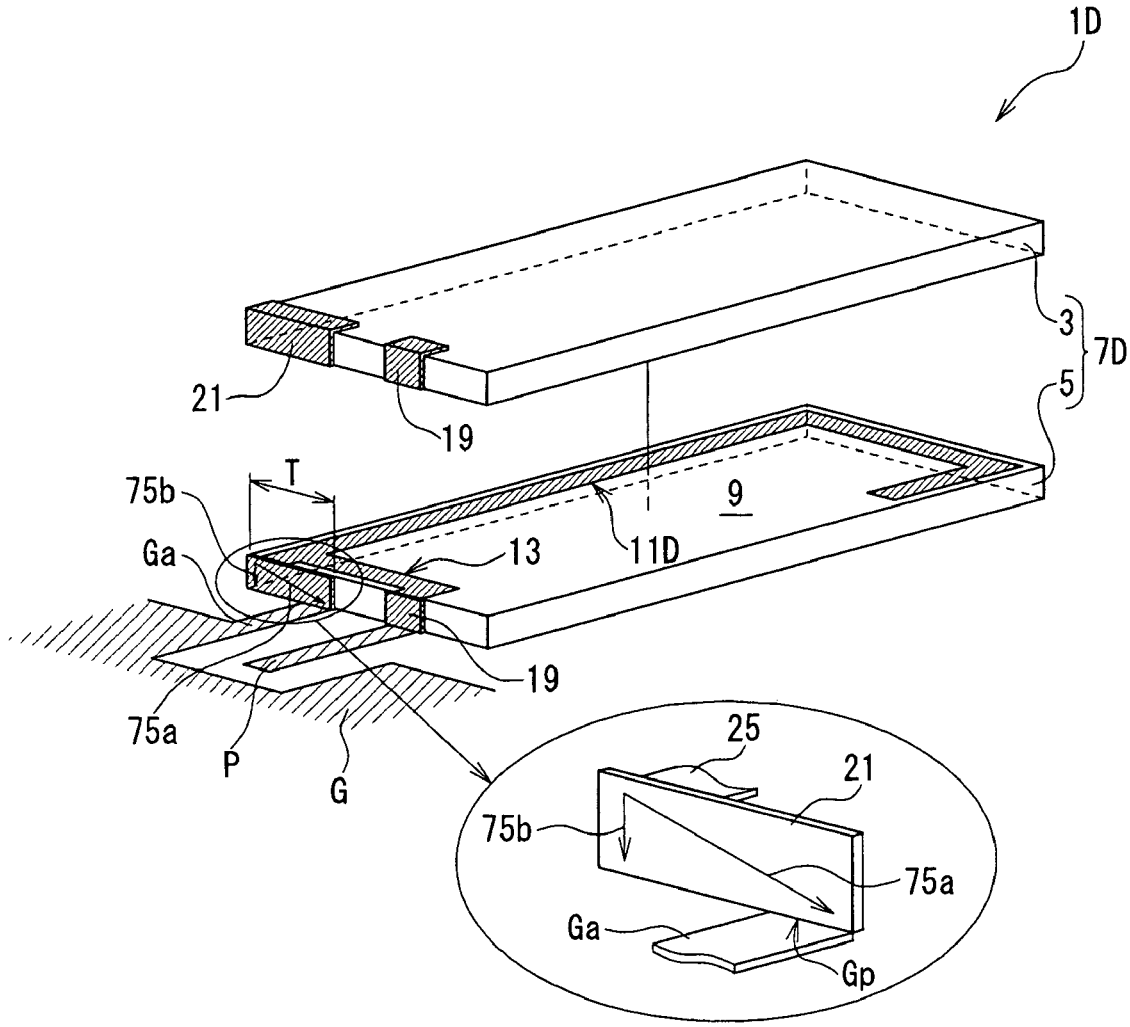
FIG. 6 is an exploded perspective view of a dielectric antenna according to a second modification example of the first embodiment.
Figure 7:
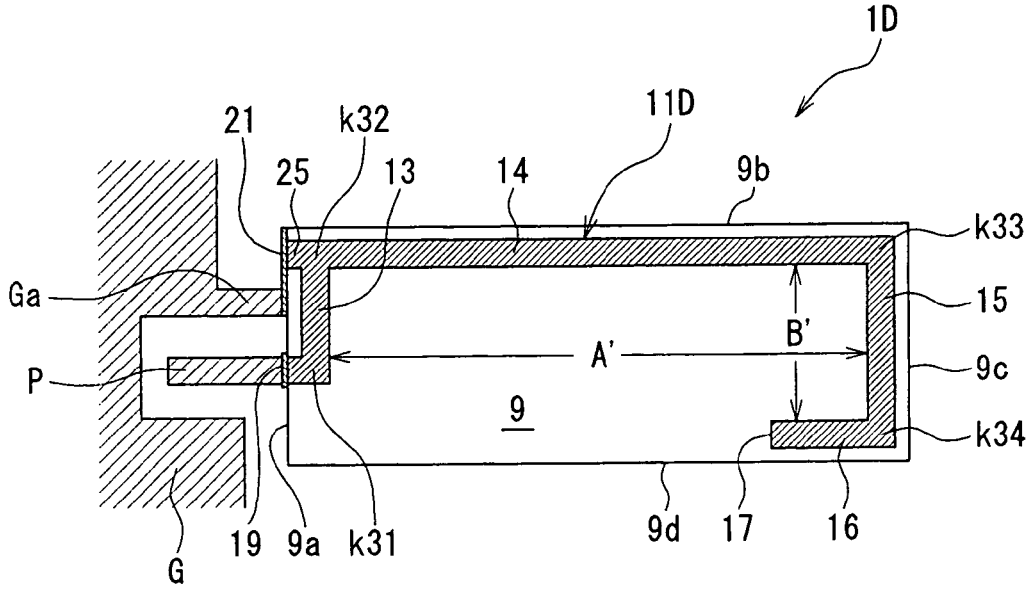
FIG. 7 is a plan view of the dielectric antenna according to the second modification example of the first embodiment in a state that an upper substrate thereof is omitted.

A second modification example of the first embodiment will be explained with reference to FIGS. 6 and 7. The second modification example is different from the above-described embodiment in that the power supply terminal is replaced with the ground terminal. Specifically, a dielectric antenna 1D has a dielectric base 7D formed by an upper substrate 3 and a lower substrate 5, and the whole dimension of a top face of the lower substrate 5 forms the antenna forming face 9. A linear element 11D is formed on the antenna forming face 9, and the linear element 11D has its base end on the periphery 9*a* of the antenna forming face 9. The linear element 11D beginning at the base end extends, as shown in FIG. 7, in an upward direction in the drawing through a first bending portion k31, and extends along the periphery 9*b* of the antenna forming face 9 through a second bending portion k32. Further, a third bending portion k33 changes the course of the linear element 11D in a downward direction in the drawing, and a fourth bending portion k34 changes the course in a leftward direction in the drawing. Consequently, the linear element 11D extends along the peripheries 9*c* and 9*d* of the antenna forming face 9. The open end 17 is the end point of the linear element 11D. As a result, the first portion 13 and the third portion 15 oppose each other on the antenna forming face 9 with the maximum length A' spaced, and similarly the second portion 14 and the fourth portion 16 oppose each other with the maximum length B' spaced. Since the opposing distances are the maximum, the mutual interference between the first portion 13 and the third portion 15 and between the second portion 14 and the fourth portion 16 on the same antenna forming face 9 can be most effectively eliminated on the antenna forming face 9. The operational effect as this effective elimination of interference is the same as the operational effect achieved by this embodiment, which is explained above.

As shown in FIG. 7, the second bending portion k32 also has a role of a branch point where a linear conductor 25 branches from the linear element 11D, and from this second bending portion k32, the linear element 11D extends in a rightward direction in the drawing, and the linear conductor 25 extends in the leftward direction in the drawing. A tip of the linear conductor 25 observed from the second bending portion k32 is formed to be connectable to the ground portion G through a ground terminal 21. On the other hand, the base end of the linear element 11D (first portion 13) is formed to be connectable to the power supply portion P through a power supply terminal 19. Adjustment of length of the linear conductor 25 is performed in such a manner that a connection terminal Ga of the ground portion G shown in FIG. 6 is formed in a leaf shape, and the ground terminal 21 is formed to be wide, and a connection point Gp of the former and the latter is slid in a direction of a double arrow T shown in the drawing. In other word, as shown in FIG. 6, when the connection point Gp is set at the right end position of the ground terminal 21, an electric current path flowing through the ground terminal 21 takes a direction shown by an arrow 75*a*, but when it is set at the left end position thereof, the electric current path takes a direction shown by an arrow 75*b*. As is clear from the drawing, the arrow 75*a* is longer than the arrow 75*b*. Specifically, the length of the electric current path becomes adjustable by changing the set position of the connection point Gp, so that the connection point Gp can be set at the best point using this adjustment.

Figure 8:
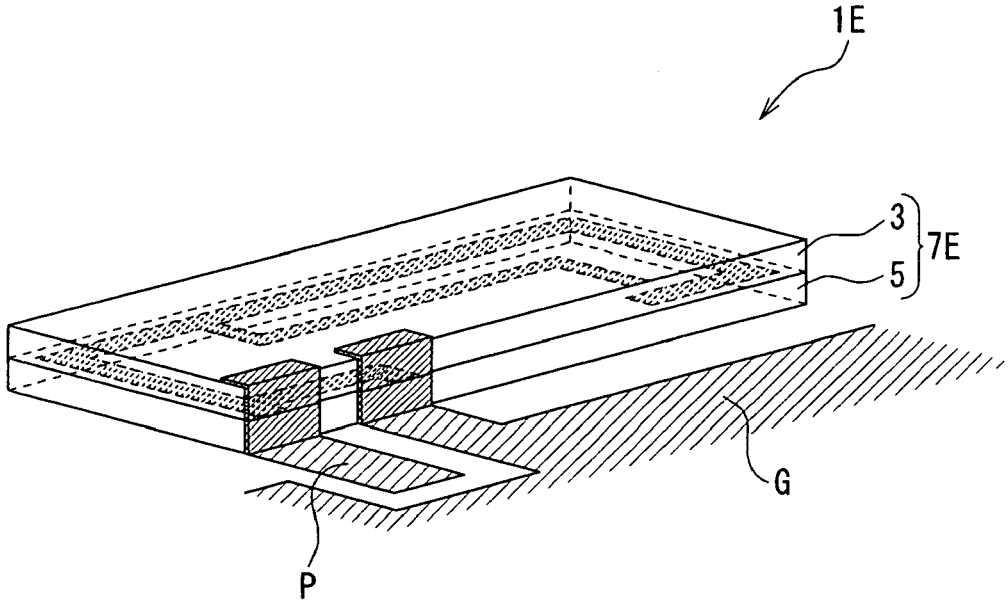
FIG. 8 is a perspective view of a dielectric antenna according to a second embodiment.
Figure 9:
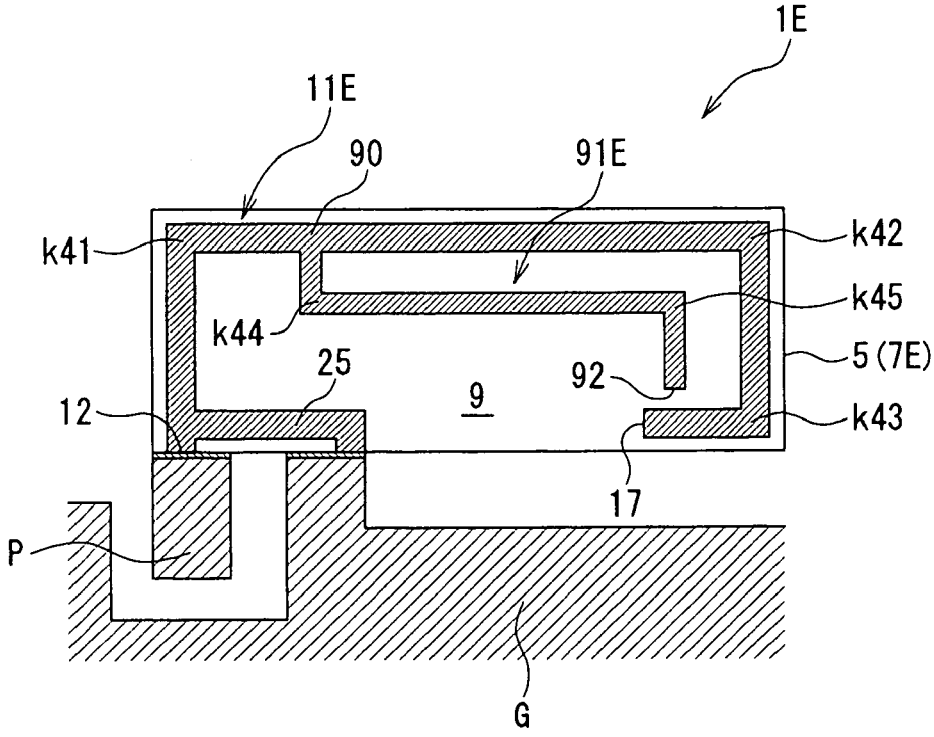
FIG. 9 is a plan view of the dielectric antenna shown in FIG. 8 in a state that an upper substrate thereof is omitted.

A second embodiment will be explained with reference to FIGS. 8 to 10. Note that, in the second embodiment and below, for members, which are common to those in the above-described first embodiment, the same reference numerals as those used in the first embodiment will be used. A dielectric antenna 1E according to the second embodiment is different from the dielectric antenna 1A shown in FIGS. 1 to 3 in that the former has a linear sub-element, which the latter does not have. The dielectric antenna 1E has a dielectric base 7E as its primary member. The dielectric base 7E is formed of two layers, an upper substrate 3 and a lower substrate 5, and the whole dimension of atop face of the lower substrate 5 forms an antenna forming face 9. A point that each of the substrates may be a single layer body or a multi-layered body is the same as in the first embodiment. On the antenna forming face 9, a linear element (first linear element) 11E formed to have a length (¼ wave length) capable of resonating at a first frequency (first frequency band) is formed. The structure up to this point is the same as that of the linear element 11A of the dielectric antenna 1A shown in FIGS. 1 to 3. The linear element 1E has a linear sub-element (second linear element) 91E in a linear shape which branches at a branch point 90 on its mid-portion. On the antenna forming face 9, the linear sub-element 91E branches and protrudes in a direction perpendicular to the linear element 11E, and thereafter extends through a fourth bending portion k44 and a fifth bending portion k45 to an open end 92. The linear element 11E on the antenna forming face 9 is, as described in the section which explains the first embodiment, formed on the antenna forming face 9 in an outside curling shape along the periphery thereof. Accordingly, the antenna forming face 9 has a portion, which is surrounded by the linear element 11E and is blank like a courtyard, which provides high freedom of design. The linear sub-element 91E can be formed in a free shape using the blank courtyard portion. However, bending or meandering can often cause the interference between adjacent elements as described above, so that the linear element is preferred to be formed only by linear portions and bending portions as far as possible.

Here, a high frequency current supplied from the power supply portion P sequentially flows from a base end 12 of the linear element 11E to a first bending portion k41, a second bending portion k42, a third bending portion k43, and an open end 17. On the other hand, a high frequency current flowing on the linear sub-element 91E sequentially flows from the base end 12 through the first bending portion 41 and the branch point 90 to the linear sub-element 91E, the fourth bending portion k44, the fifth bending portion k45, and the open end 92. The linear sub-element 91E is set to have a length capable of resonating at a second frequency, which is different from the first frequency. Matching of impedance and adjustment of a resonance frequency are performed by moving the branch point 90 in a longitudinal direction of the linear element 11E. Formation of the linear sub-element 91E is convenient to be carried out together with formation of the linear element 11E and the linear conductor 25 by applying a conductive paste. Incidentally, the shape of the linear element 11E may be the shapes shown in FIGS. 4 and 5 depending on its resonance frequency. Further, the power supply terminal and the ground terminal may be provided at positions shown in FIGS. 6 and 7.

Figure 10A:
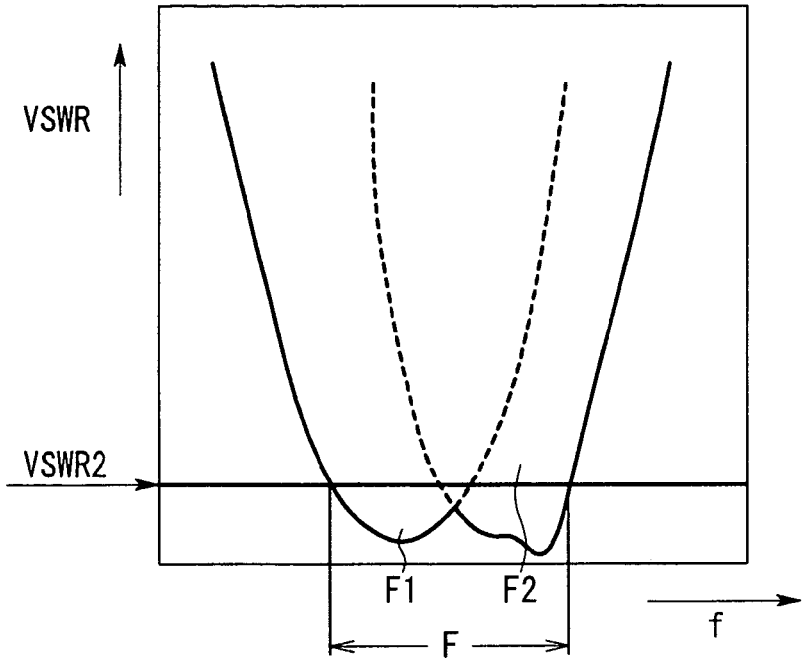
FIGS. 10*a* and 10*b* are graphic charts showing frequency characteristics of the dielectric antenna according to the second embodiment.
Figure 10B:
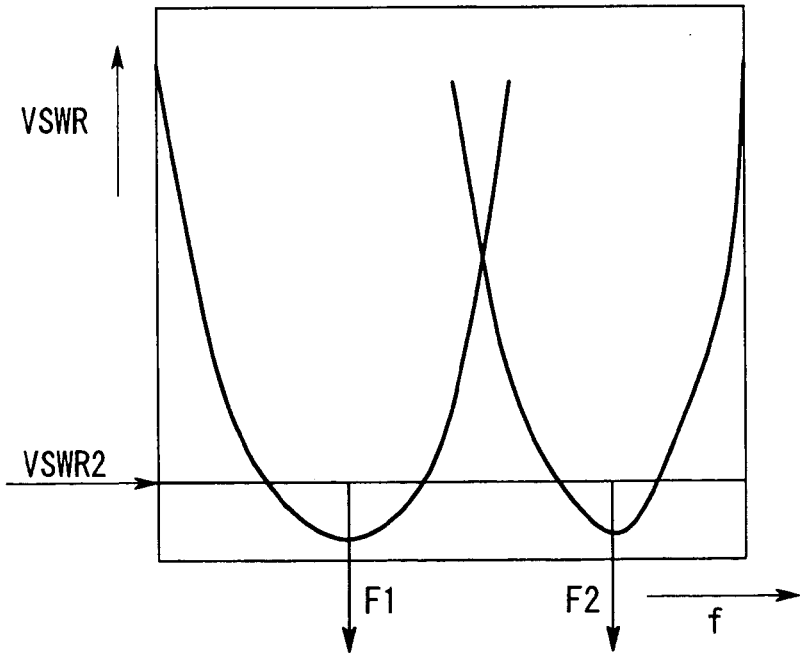

The linear element 11E in the second embodiment is formed to have the length (¼ wave length) capable of resonating at the first frequency (first frequency band) as described above, and the linear sub-element 91E is formed to have the length capable of resonating at the second frequency (second frequency band) which is different from the first frequency. A relationship between the first frequency and the second frequency is determined according to an intended purpose of the dielectric antenna 1E. Specifically, as shown in FIG. 10*a*, when the resonance frequency F1 of the linear element 11E and the resonance frequency F2 of the linear sub-element 91E are set close to each other so as to obtain, for example, a band F at VSWR2 or lower, formation of the linear sub-element 91E can make the frequency band of the entire dielectric antenna 1E to be a wider band as compared to the case of not forming the linear sub-element 91E. Further, as shown in FIG. 10*b*, by moderately separating the first resonance frequency F1 and the second resonance frequency F2, the dielectric antenna 1E becomes capable of resonating at two frequencies, that is, a dual band. According to an experiment performed by the inventor, when the first resonance frequency F1 in the former case was set to, for example, 1.98 GHz, and the second resonance frequency was set to 2.10 GHz, the band at VSWR2 or lower became a wider band such as 1.92 GHz to 2.17 GHz. Similarly, in the latter case, the dual band was realized in which the first resonance frequency F1 was 2.45 GHz, which is used for wireless communication such as in notebook computer or LAN card, and similarly the second resonance frequency F2 was 5.25 GHz.

Figure 11:
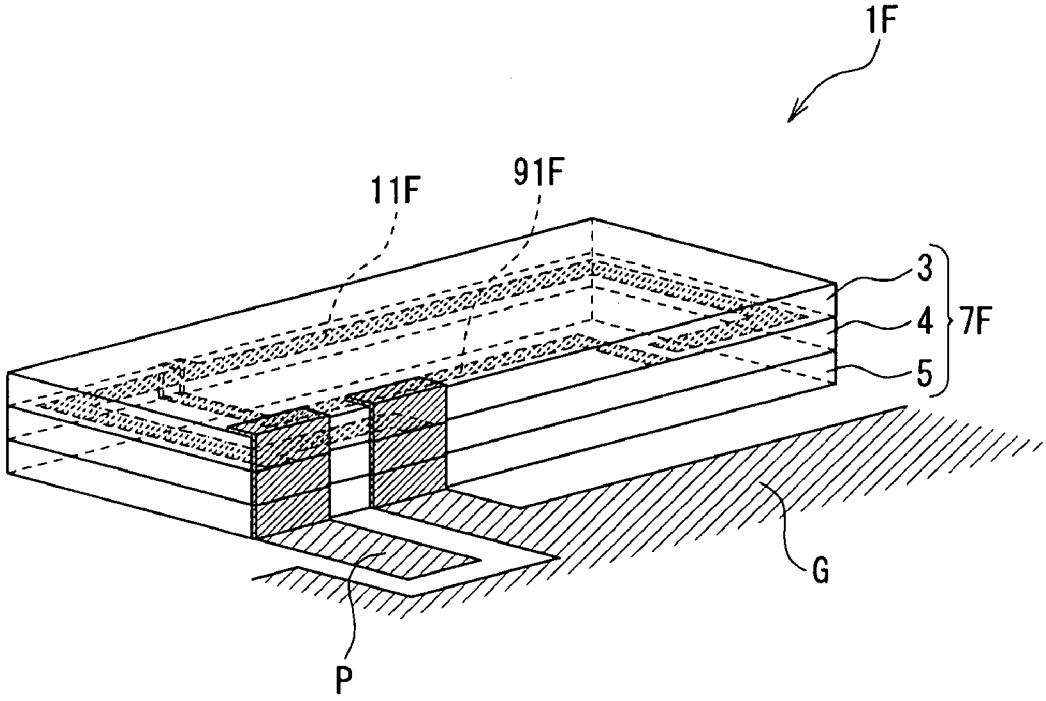
FIG. 11 is a perspective view showing a dielectric antenna according to a modification example of the second embodiment.
Figure 12:
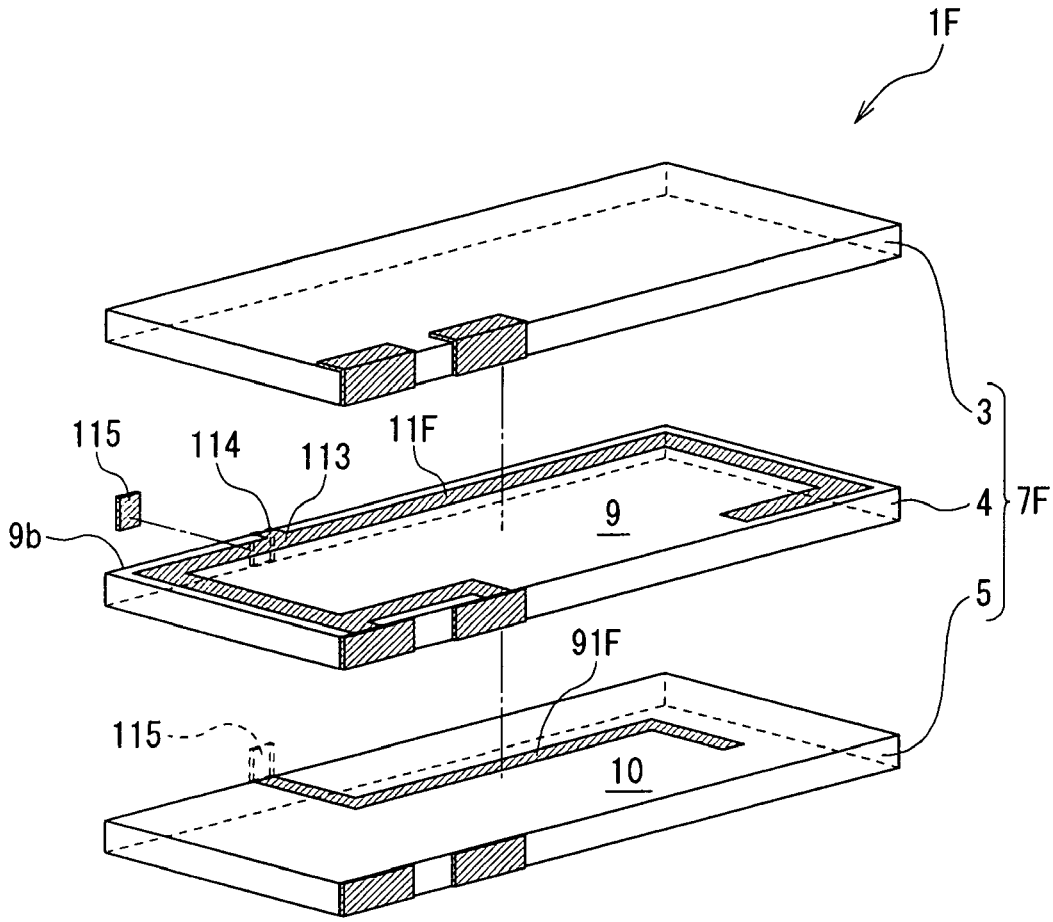
FIG. 12 is an exploded perspective view of the dielectric antenna shown in FIG. 11.
Figure 13:
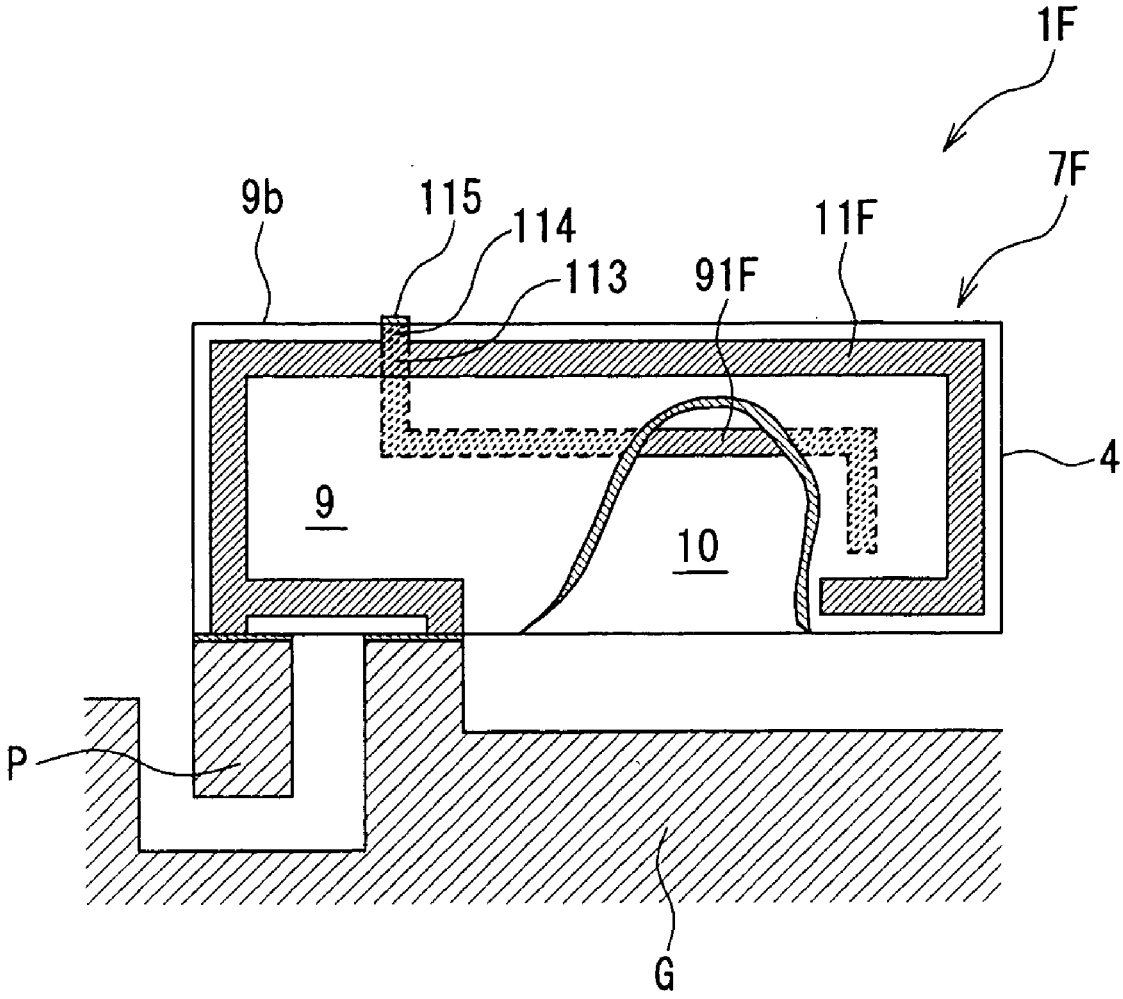
FIG. 13 is a plan view of the dielectric antenna shown in FIG. 11 in a state that an upper substrate thereof is omitted.

A modification example of the second embodiment will be explained with reference to FIGS. 11 to 13. This modification example is different from the second embodiment in a position of forming the linear sub-element. Specifically, in the above-described second embodiment, both the linear element 11E and the linear sub-element 91E are formed on one antenna forming face 9. On the other hand, in this modification example, these are formed on separate forming faces. Specifically, a dielectric antenna 1F in this modification example has a dielectric base 7F as its primary portion. The dielectric base 7F is formed of three layers, an upper substrate 3, a middle substrate 4, and a lower substrate 5. The whole dimension of a top face of the middle substrate 4 forms an antenna forming face (first antenna forming face) 9, and the whole dimension of a top face of the lower substrate 5 forms a sub-antenna forming face (second antenna forming face) 10. A linear element 11F is formed on the antenna forming face 9, and a linear sub-element 91F is formed on the sub-antenna forming face 10 respectively. Basic structures of the linear element 11F and the linear sub-element 91F are mostly the same as those of the linear element 11E and the linear sub-element 91E according to the second embodiment. However, the linear sub-element 11F is different in that it has a projecting portion 114 projecting from its branch point 113 in a direction of periphery 9*b*, and the projecting portion 114 is connected to the linear sub-element 91F through a connecting conductor 115 formed on an end face of the middle substrate 4.

That is to say, the linear sub-element 91F merges the branch point 113 through the connecting conductor 115 and the projecting portion 114, so that an element length thereof is longer correspondingly. In other words, the element length can be shortened by the longer length thereof. This is particularly advantageous when the antenna forming face 9 does not have a sufficient size so that formation of the linear sub-element 91F thereon is difficult, or when the formation on the sub-antenna forming face 10 is possible but the length thereof is preferred to be formed as short as possible in a purpose of preventing interference with other elements.

A third embodiment will be explained with reference to FIGS. 14 to 18. First, the schematic structure of a dielectric antenna according to the third embodiment will be explained based on FIGS. 14 to 16. A dielectric antenna 1G has a dielectric base 7G formed by layering an upper substrate 3, a middle substrate 4, and a lower substrate 5, which are insulating and composed of a dielectric ceramic material. The upper substrate 3, the middle substrate 4, and the lower substrate 5 are formed in a rectangle (quadrangle) having the same size when observed in a plan view, so that the dielectric base 7G formed by layering them becomes a rectangular parallelepiped shape. On a top face (a face opposing a bottom face of the upper substrate 3) of the middle substrate 4, a first antenna forming face 9 for forming an antenna is formed. Further, on a top face (a face opposing a bottom face of the middle substrate 4) of the lower substrate 5, a second antenna forming face 10, which is an antenna forming face different from the first antenna forming face 9 is formed. The first antenna forming face 9 may be formed on the bottom face (the face opposite to the top face of the middle substrate 4) of the middle substrate 4 or may be formed on a bottom face of the lower substrate 5 instead of the top face of the middle substrate 4. It is also possible to form the first antenna forming face 9 on the lower substrate 5, and the second antenna forming face 10 on the middle substrate 4. Since the lower substrate 5 and the middle substrate 4 are rectangles, the first antenna forming face 9 and the second antenna forming face 10 respectively become a rectangle (quadrangle). The reason to have the upper substrate 3 is that an element and so on (described later) to be formed on the first antenna forming face 9 are preferred to be covered for protection. The dielectric base 7G is formed as a three-layer structure, but may be formed as a two-layer structure omitting the upper substrate 3. The dielectric base 7G may be structured as four-layer, five-layer or more by further layering other substrates. The reason of forming the dielectric base 7G in the rectangular parallelepiped shape is to facilitate a multi-getting by so-called die cutting or the like. Needless to say, the dielectric base may be formed in other shapes.

Figure 15:
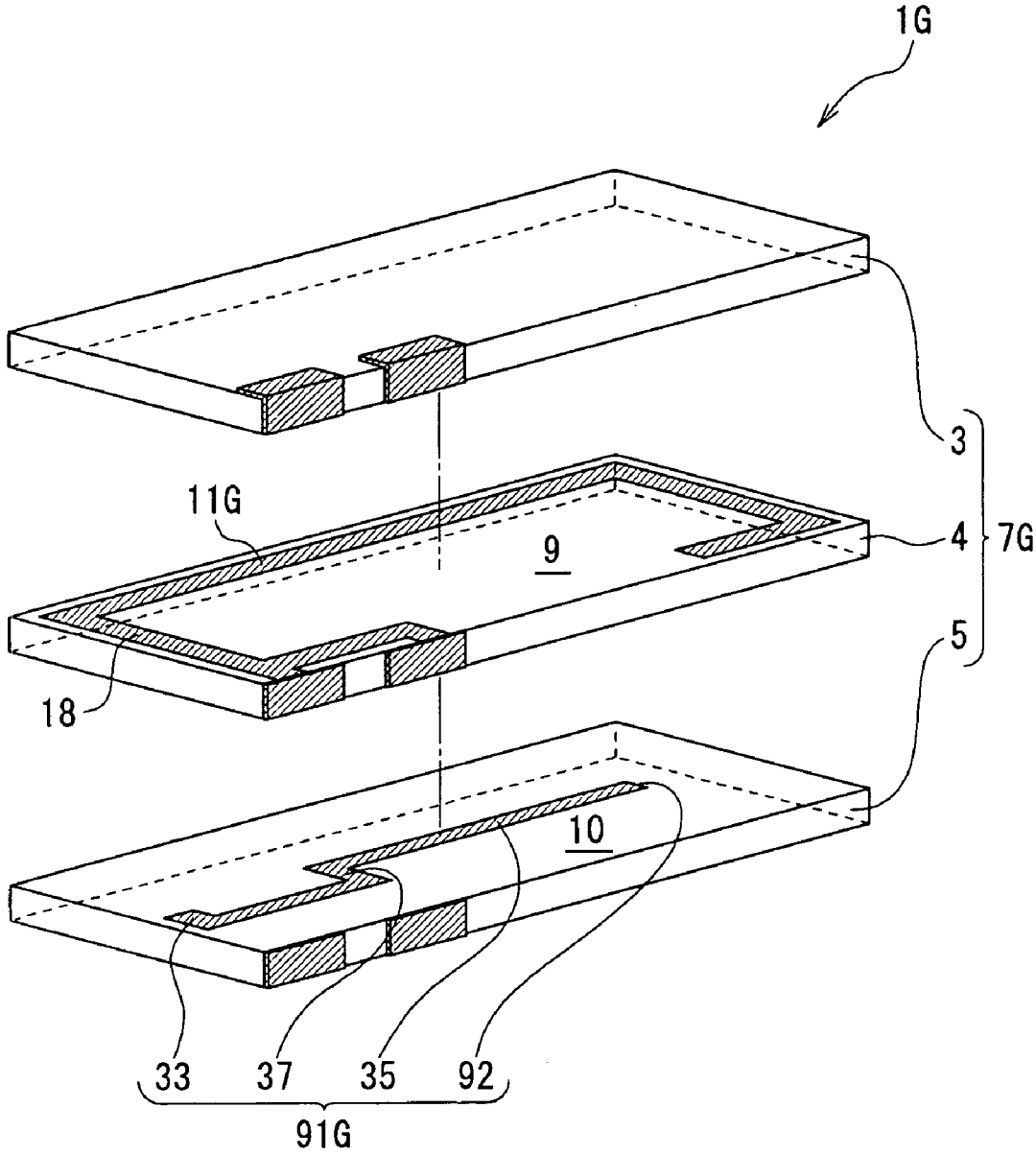
FIG. 15 is an exploded perspective view of the dielectric antenna shown in FIG. 14.
Figure 16:
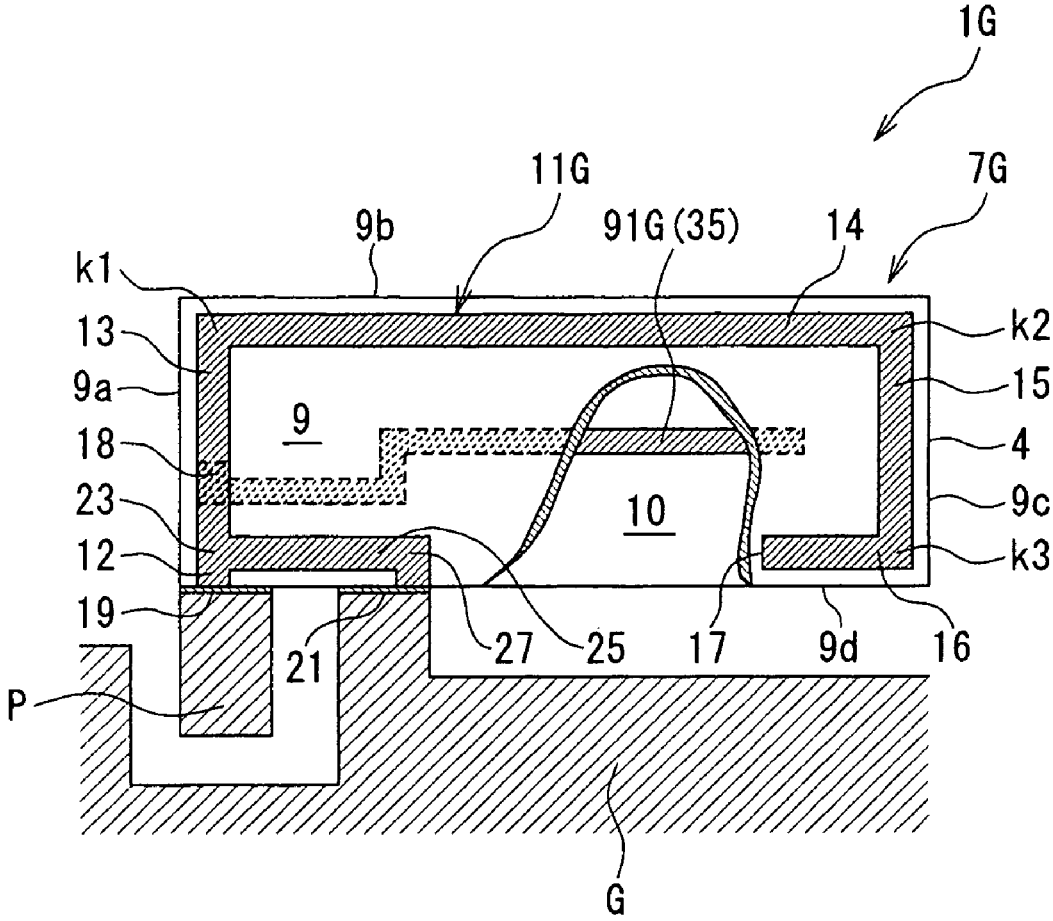
FIG. 16 is a plan view of the dielectric antenna shown in FIG. 14 in a state that an upper substrate thereof is omitted.

As shown in FIGS. 15 and 16, on the first antenna forming face 9, there is formed a first linear element 11G in a linear (strip) shape which is adjacent to (parallel to) peripheries (9*a*, 9*b*, 9*c*, and 9*d*) of the first antenna forming face 9. It is convenient to carry out the formation of the first linear element 11G by printing a conductive paste, and margins are preferred to be left between the linear element and the peripheries 9*a*, 9*b*, 9*c*, and 9*d* for absorbing a printing displacement during printing.

Figure 14:
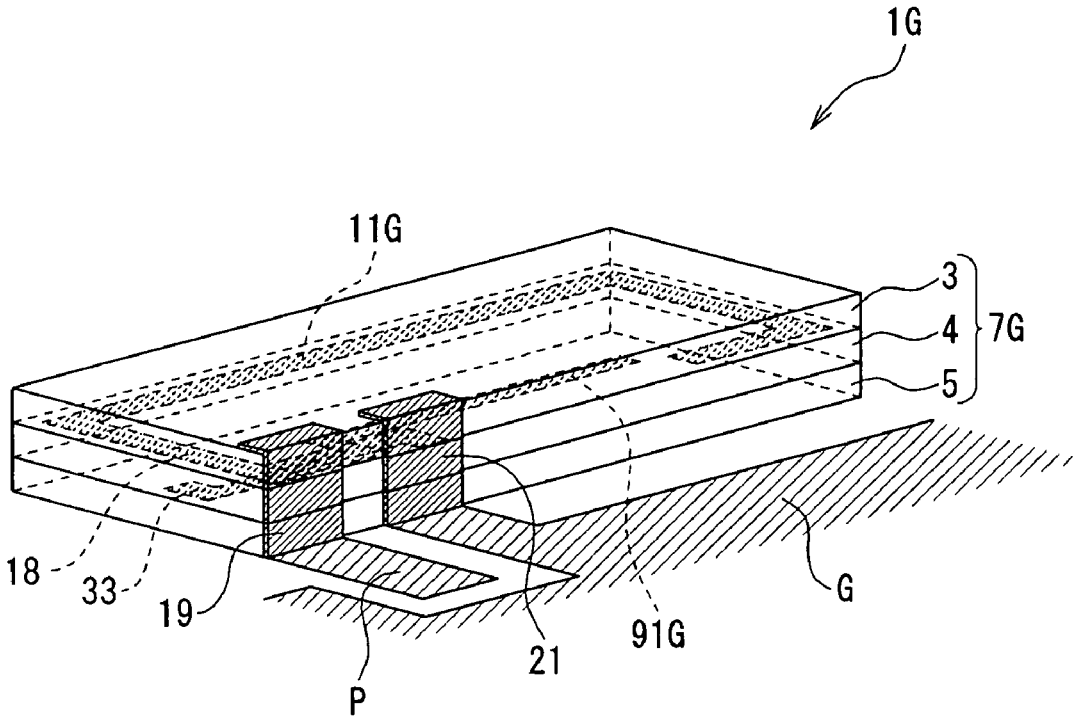
FIG. 14 is a perspective view of a dielectric antenna according to a third embodiment.

As shown in FIGS. 15 and 16, the first linear element 11G is composed of a first portion 13, a second portion 14, a third portion 15 and a fourth portion 16. The first portion 13 of the first linear element 11G is a portion located between a base end portion 12 and a first bending portion k1, and the second portion 14 of the first linear element is a portion located between the first bending portion k1 and a second bending portion k2. Further, the third portion 15 of the first linear element is a portion located between the second bending portion k2 and a third bending portion k3, and the fourth portion 16 of the first linear element is a portion located between the third bending portion k3 and an open end 17. That is to say, the first portion 13 is adjacent to the periphery 9*a*, the second portion 14 is adjacent to the periphery 9*b*, the third portion 15 is adjacent to the periphery 9*c*, and the fourth portion 16 is adjacent to the periphery 9*d* respectively. In addition, the bending portions k1, k2, and k3 are located at respective corners of the first antenna forming face 9, so that the first linear element 11G extends in an outside curling shape along the peripheries 9*a*, 9*b*, 9*c*, and 9*d* on the first antenna forming face 9. The base end portion 12 of the first linear element 11G is connected to a power supply terminal 19 formed on an end face of the dielectric base 7G as shown in FIG. 14 to FIG. 16. Formation of the power supply terminal 19 is generally performed by applying a conductive paste on the end face of the dielectric base 7G.

The reason of forming the first linear element 11G in the outside curling shape as described above is that, when formed on an antenna forming face having the same dimension, it takes a circuitous route as compared to the first linear element in a different shape which is not formed in the outside curling shape, so that the length of the first linear element can be lengthened by the length of the circuitous route. When the length of the first linear element becomes longer, a resonance frequency lowers accordingly, so that the first linear element can resonate at a low frequency in the same dimension. In other words, the same frequency can resonate in a smaller dimension, so that the antenna itself is miniaturized as a result. Further, by forming the first linear element 11G in the outside curling shape, a distance between the first portion 13 and the third portion 15 and a distance between the second portion 14 and the fourth portion 16, both of which oppose each other, respectively become the maximum on the first antenna forming face 9. Since the distances are the maximum, it becomes possible to effectively eliminate mutual interference between the first portion 13 and the third portion 15 and between the second portion 14 and the fourth portion 16 on the same first antenna forming face 9.

On the other hand, in order to miniaturize the dielectric base 7G itself by reducing the dimension of the first antenna forming face 9, it is conceivable, for example, that the second bending portion k2 and the third bending portion k3 are moved, by shortening the second portion 14 in FIG. 16, toward the left side from its position shown in the drawing, and the fourth portion 16 is lengthened by an equal length to the shortened length of the second portion 14, and a portion of the dielectric base which becomes unnecessary is erased. When this method is adopted, the first antenna forming face 9 (the dielectric base 7G) itself becomes small, but since the fourth portion 16 is lengthened, the entire length which is lengthened does not fall into the first antenna forming face 9. Accordingly, there rises a need for bending a part of the fourth portion 16 in an upward direction (a direction where the second portion 14 exists). The bent part of the fourth portion 16 becomes a parallel portion adjacent to the first portion 13. Accordingly, interference can easily occur between the first portion 13 and the bent part. When the interference occurs, it may cause a bad effect on antenna characteristics. Further, as another method for falling a long element into a small dimension, it is conceivable to partly meander (to form in a meander shape) the first linear element 11G. However, such a meandering makes portions of the element to be adjacent to each other to generate the mutual interference, which may also cause the bad effect on the antenna characteristics. Therefore, in this embodiment, the above-mentioned structures are not adopted.

The first linear element 11G is formed to have a length (¼ wave length) capable of resonating at a 2.4 GHz band, which is a first frequency (first frequency band), and the resonance frequency is adjusted by displacing the position of the open end portion 17 in the right/left direction in FIG. 16, in other words, by adjusting the entire length of the first linear element 11G. For resonating at a frequency higher than the 2.4 GHz band, the open end is moved in a direction, which shortens an effective length of the first linear element 11G. On the other hand, for resonating at a frequency band lower than the first frequency, the open end is moved in a direction, which lengthens the effective length of the first linear element. The reason of adopting the 2.4 GHz band as the first frequency is that the frequency is currently used for a wireless LAN and the like, and is not to hinder setting of other frequencies (such as 2.0 GHz, or 5.0 GHz) as necessary.

A linear conductor will be explained based on FIGS. 14 to 16. A linear conductor 25 provided on the first antenna forming face 9 is a conductor for matching impedance at the power supply terminal 19 which is a power supply point. The linear conductor 25 branches on the first antenna forming face 9 at a branch point 23 in the vicinity of a base end portion 12 of the first linear element, and a tip thereof is connected through a bending portion 27 to a ground terminal 21 formed on an end face of the dielectric base 7G. The linear conductor 25 can be formed in a separate step from the first linear element 11G, but it is convenient to simultaneously print and form with the first linear element 11G using a conductive paste, which eliminates much labor. Adjustment of the power supply point impedance can be carried out by displacing a position of the branch point 23 in a longitudinal direction of the first linear element 11G. Further, since the linear conductor 25 is also a part, which contributes to the resonance of the first linear element 11G, the resonance frequency of the first linear element 11G can be adjusted by adjusting the length of the linear conductor 25. On the other hand, since the linear conductor 25 does not contribute to a radiation of radio wave, it does not cause the mutual interference even when it is located adjacent to the first linear element 11G. Accordingly, the length of the linear conductor 25 can be substantially lengthened on the same first antenna forming face 9 by partly bending or meandering the linear conductor 25. Incidentally, formation of the ground terminal 21 is, similarly to the power supply terminal 19, generally performed by applying a conductive paste on the end portion of the dielectric base 7G.

On the back face (a face of backside of FIG. 15) of the lower substrate 5, a dummy electrode (not shown) for firmly soldering the dielectric antenna 1G itself on a parent substrate (not shown) or the like is formed. When mounting on the parent substrate (not shown), the power supply terminal 19 is connected to the power supply portion P of the parent substrate, and the ground terminal 21 is connected to a ground portion G thereof respectively by soldering.

Figure 17:
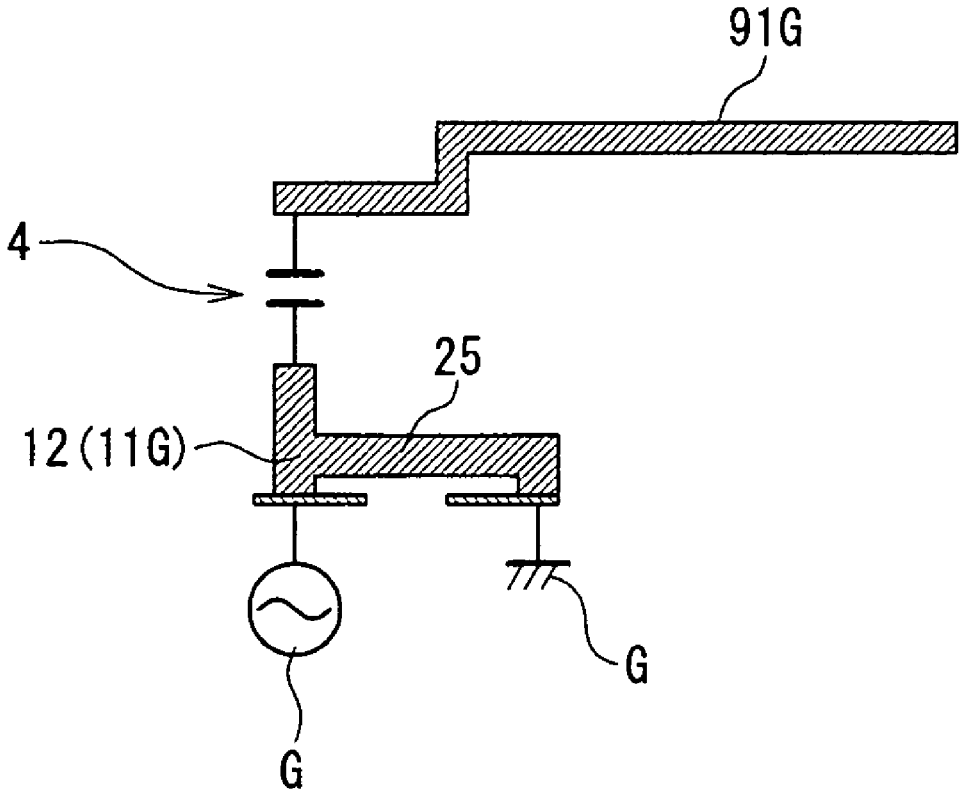
FIG. 17 is a view showing an equivalent circuit of a second linear element shown in FIG. 14.

As shown in FIGS. 14 to 16, on the second antenna forming face 10 of the lower substrate 5, a second linear element 91G in a linear (strip) shape is formed. The second linear element (linear sub-element) 91G has a connecting portion 33 and a main body 35 of the second linear element which is sequential to the connecting portion 33, and the second linear element 91G has a step portion 37 on its mid-portion. The reason of providing the step portion 37 is mainly to gain a length of the second linear element 91G. The connecting portion 33 is arranged so as to oppose a connecting portion 18, which is a mid-portion of the first linear element 11G, over a predetermined length (dimension) through the middle substrate 4. Consequently, the connecting portion 33 forms a capacitor structure with the connecting portion 18 of the first linear element 11G through the middle substrate 4 that is a dielectric. An equivalent circuit of the second linear element 91G is shown in FIG. 17. On the equivalent circuit shown in FIG. 17, a slight reactance may occur in parallel or series with the capacitor structure, but these are omitted here to avoid complication. The size of an opposing dimension between the connecting portion 33 of the second linear element 91G and the connecting portion 18 of the first linear element 11G affects matching of the both because these form the capacitor structure with the middle substrate 4. This point will be described later.

Here, a high frequency current supplied from the power supply portion P sequentially flows from the base end portion 12 of the first linear element 11G to the first bending portion k1, the second bending portion k2, the third bending portion k3, and the open end 17. On the other hand, a high frequency current flowing on the second linear element 91G sequentially flows from the base end portion 12 through the connecting portion 18, the middle substrate 4, the connecting portion 33, and to the open end 92. The second linear element 91G is set to have a length (½ wave length in this embodiment) capable of resonating at a second frequency which is different from the first frequency. When the second linear element is set to have the length capable of resonating at the ½ wavelength of the second frequency, voltage in the vicinity of the power supply portion P becomes the maximum. In this case, the power supply point impedance becomes much larger than 50 Ω. The reason of forming the capacitor structure between the second linear element 91G and the first linear element 11G is to make the large power supply point impedance close to 50 Ω for matching. Matching of the impedance is performed by adjusting the opposing dimension of the connecting portion 33 of the second linear element 91G to the connecting portion 18 of the first linear element 11G. Together with this adjustment or instead of this adjustment, the matching may be performed by changing a thickness of the middle substrate 4.

Adjustment of the resonance frequency of the second linear element 91G is carried out by moving the positions of the connecting portions 18 and 33 in a longitudinal direction, for example, at the first portion 13 on the first linear element 11G. As a length from the base end portion 12 to the connecting portion 18 is lengthened, the substantial length of the second linear element 91G becomes longer. On the other hand, as the length is shortened, the substantial length of the second linear element 91G becomes shorter. Formation of the second linear element 91G is convenient to be carried out together with formation of the first linear element 11G and the linear conductor 25 by applying a conductive paste. Incidentally, the second linear element 91G may be formed on the first antenna forming face 9 instead of the second antenna forming face 10, and the first linear element 11G and the linear conductor 25 may be formed on the second antenna forming face 10 because this is merely a change of design and has no substantial difference.

Figure 18A:
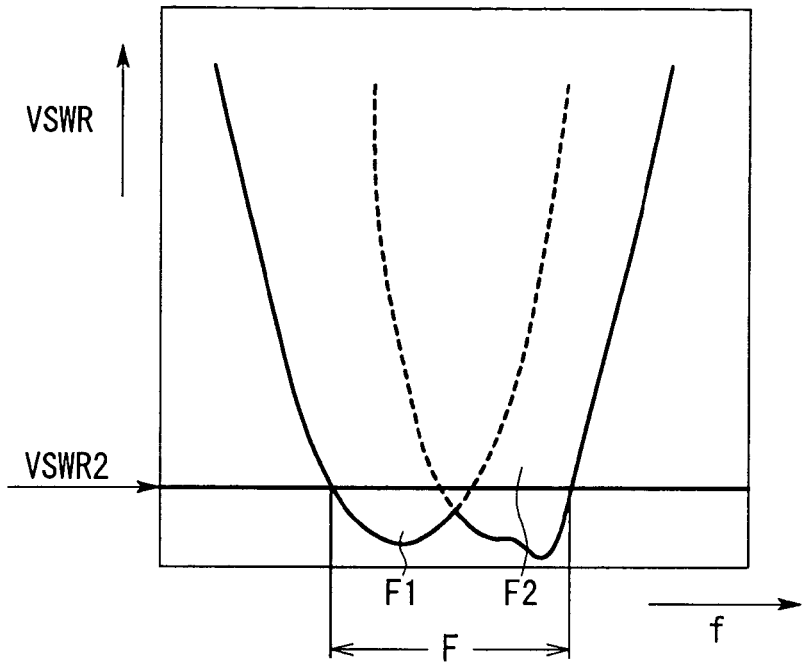
FIGS. 18*a* and 18*b* are graphic charts showing frequency characteristics of the dielectric antenna according to the third embodiment.
Figure 18B:
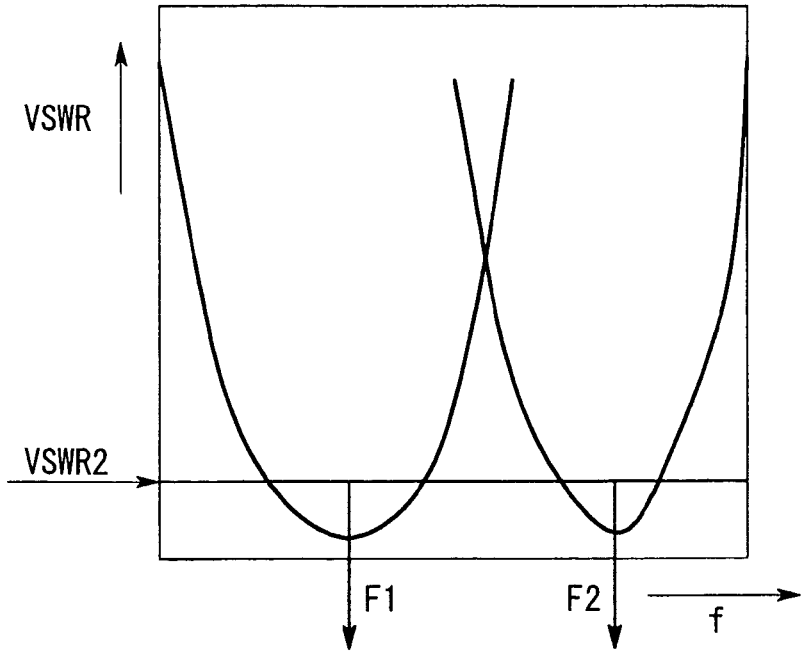

A relationship between the first frequency and the second frequency is determined according to an intended purpose of the dielectric antenna 1G. Specifically, as shown in FIG. 18*a*, when a resonance frequency F1 of the first linear element 11G and a resonance frequency F2 of the second linear element 91G are set close to each other so as to obtain, for example, a band F at VSWR2 or lower, provision of the second linear element 91G can make the frequency band of the entire dielectric antenna 1G to be a wider band as compared to the case of not providing the second linear element 91G. Further, as shown in FIG. 18*b*, by moderately separating the first resonance frequency F1 and the second resonance frequency F2, the dielectric antenna 1G becomes capable of resonating at two frequencies, that is, a dual band. According to an experiment performed by the inventor, when the first resonance frequency F1 in the former case was set to, for example, 1.98 GHz and the second resonance frequency was set to 2.10 GHz, the band at VSWR2 or lower became a wider band such as 1.92 GHz to 2.17 GHz. Similarly, in the latter case, the dual band was realized in which the first resonance frequency F1 was 2.45 GHz, which is used for wireless communication such as in notebook computer or LAN card, and similarly the second resonance frequency F2 was 5.25 GHz.

A first modification example of the third embodiment will be explained based on FIG. 19. The first modification example is different from the third embodiment mainly in the shapes of elements. Hereinafter, the difference will be explained, and explanation of common points in both is omitted. A dielectric antenna 1H shown in FIG. 19 has a dielectric base 7H formed by layering an upper substrate (not shown), a lower substrate 5, and a middle substrate 4, which are insulating and composed of a dielectric ceramic material. The dielectric base 7H is formed in a rectangular parallelepiped shape. On a top face of the lower substrate 5 and on a top face of the middle substrate 4, antenna-forming faces 9 and 10 for forming an antenna are formed respectively. The dielectric base 7H is formed as a three-layer structure, but may be formed as a two-layer structure omitting the upper substrate. The dielectric base 7H may be structured as four-layer, five-layer or more by further layering other substrates. The dielectric base 7H has a power supply terminal 19 and a ground terminal 21 on its end faces. The end face (end face on the periphery 9*b* side) on which the power supply terminal 19 is provided is arranged opposite to the end face (end face on the periphery 9*d* side) on which the ground terminal 21 is provided. As a result, on a bottom side of the dielectric antenna 1H, only the ground terminal 21 is arranged.

Figure 43:
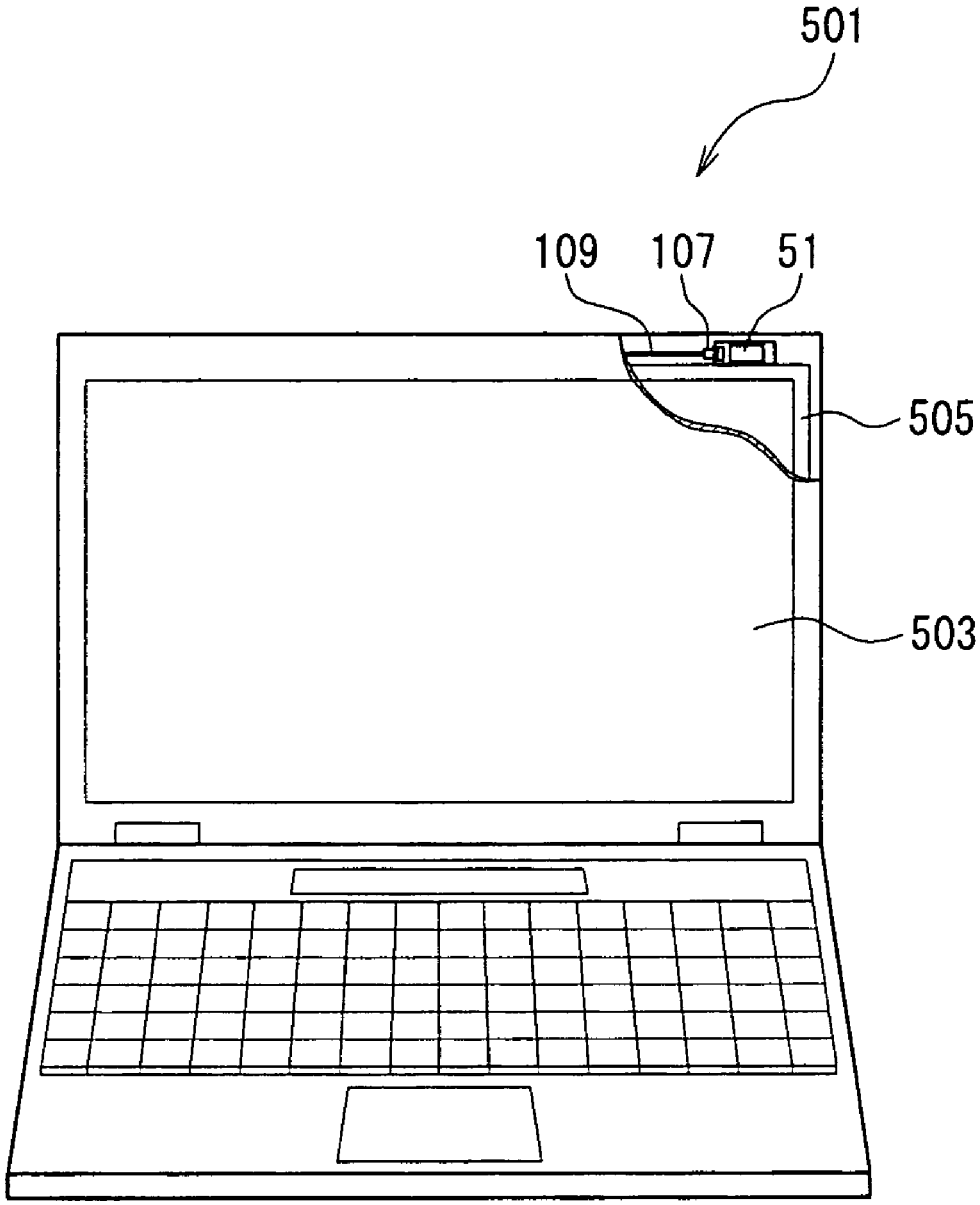
FIG. 43 is a front view of a small-sized computer that is an example of a mobile communication device.

The reason of arranging only the ground terminal 21 on the bottom side is to adapt the dielectric antenna 1H to the condition of a mounting target. An example of the mounting target is a small-sized computer 501 shown in FIG. 43. The small-sized computer 501 has an LCD 503, and a frame 505 is built into this LCD 503. A case of mounting the dielectric antenna 1H on an upper right position of the frame 505 in a mounting direction shown in FIG. 19 is considered. A condition demanded from the small-sized computer 501 for the antenna is to make a protruding amount from the frame 505 in an upward direction on the drawing as small as possible in order to miniaturize the LCD 503 itself. In this point, a connector 107 and a cable 109 for high frequency are connected to the power supply terminal 19 of the dielectric antenna 1H shown in FIG. 19, but these may be arranged on a side (left side in FIG. 43) of the dielectric antenna 1H so as not to directly affect the projecting amount in the upward direction. On the other hand, the ground terminal 21 is only needed to be connected to the ground G, which requires a relatively small space. There may be a case of using the frame 505 as the ground. As can be understood from this example, the dielectric antenna 1H requires a small protruding amount in its width direction, and is thus optimum as the antenna to be mounted on the above-described small-sized computer 501 or the like.

Figure 19:
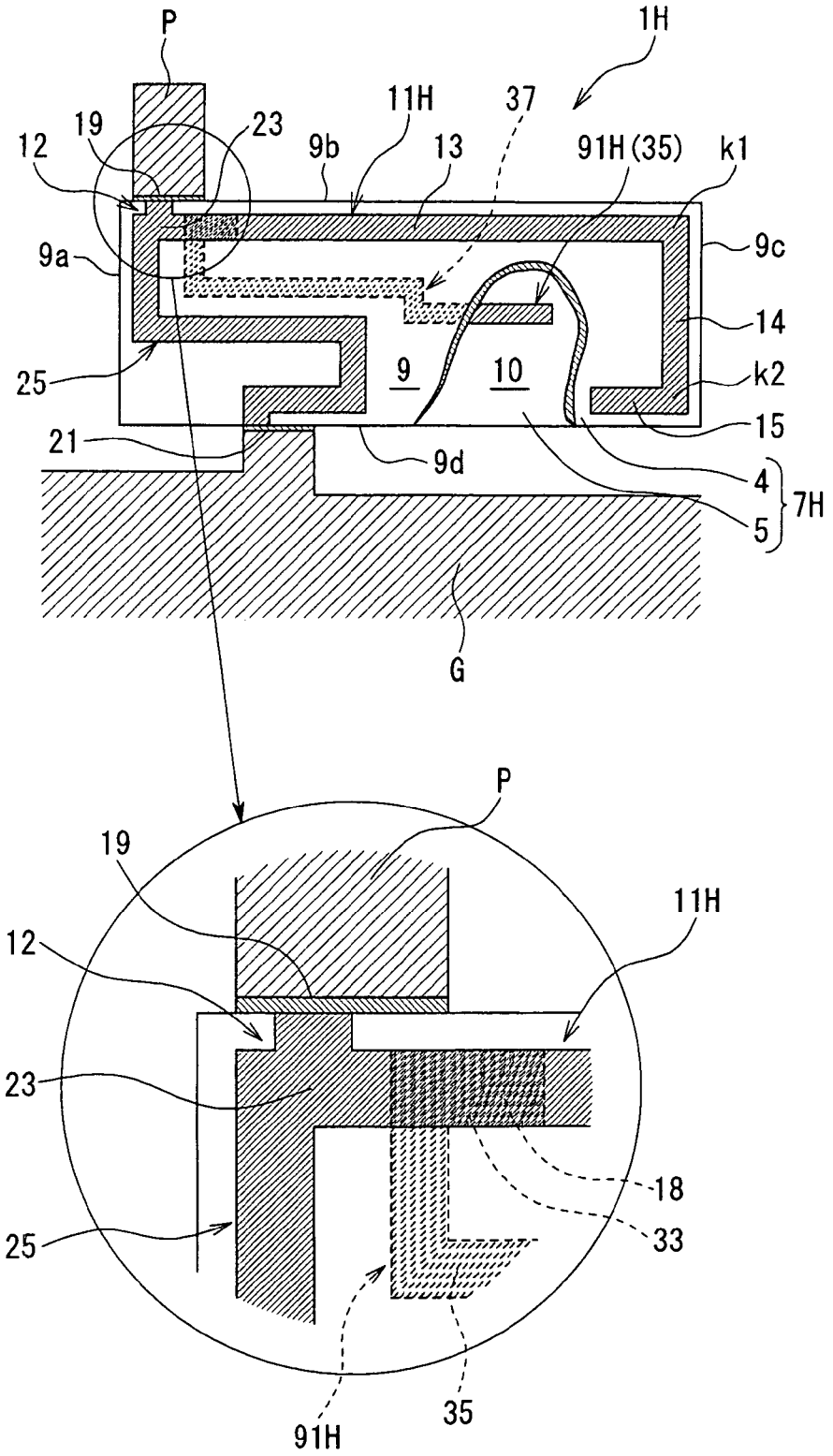
FIG. 19 is a plan view of a dielectric antenna according to a first modification example of the third embodiment in a state that an upper substrate thereof is omitted.

As shown in FIG. 19, on the antenna forming face 9, there is formed a linear (strip-shaped) element 11H which is adjacent to (parallel to) peripheries (9*b*, 9*c*, and 9*d*) of the antenna forming face 9. It is convenient to carry out the formation of the first linear element 11H by printing a conductive paste, and margins are preferred to be left between the linear element and the peripheries 9*b*, 9*c*, and 9*d* for absorbing a printing displacement during printing.

The first linear element 11H has the first portion 13 extending along the periphery 9*b* from the base end portion 12 connected to the power supply terminal 19, the second portion 14 extending along the periphery 9*c* through the bending portion k1, and the third portion 15 extending along the periphery 9*d* through the bending portion k2. The reason of forming the first linear element 11H in an outside curling shape along the peripheries 9*b* to 9*d* of the antenna forming face is that, similarly to the case of aforementioned first linear element 11G (refer to FIG. 16), when formed on an antenna forming face having the same dimension, it takes a circuitous route as compared to the first linear element in a different shape which is not formed in the outside curling shape, so that the length of the first linear element can be lengthened by the length of the circuitous route. The first linear element 11H is formed to have a length (¼ wave length) capable of resonating at a first frequency (for example, 2.4 GHz band).

A reference numeral 25 in FIG. 19 denotes a linear conductor for impedance matching. The linear conductor 25 branches at the branch point 23 in the vicinity of the base end portion 12 of the first linear element 11H, and is connected to the ground terminal 21. A portion of the linear conductor 25 is adjacent to a periphery 9*a* of the antenna forming face 9, and other portions thereof are formed in a meander shape. The reason of forming in the meander shape is to gain a length in a limited dimension, and thus it may be formed in a linear shape when there is a sufficient dimension. The linear conductor 25 may be formed in a separate step from the linear element 11H, but it is better to be printed and formed simultaneously with the first linear element 11H using a conductive paste because this manner eliminates the labor of formation. Adjustment of power supply point impedance is carried out by displacing the position of the branch point 23. Further, since the linear conductor 25 is also a part which contributes to the resonance of the first linear element 11H, the resonance frequency of the first linear element 11H can be adjusted by adjusting the length of the linear conductor 25.

On the back face of the lower substrate 5 (a face of backside of FIG. 19), a dummy electrode (not shown) for firmly soldering the dielectric antenna 1H on a parent substrate (not shown) is formed. When mounting on the parent substrate (not shown), the power supply terminal 19 is connected to the power supply portion P of the parent substrate and the ground terminal 21 is connected to a ground portion G thereof respectively by soldering.

As shown in FIG. 19, on the second antenna forming face 10 of the lower substrate 5, a second linear element 91H in a linear (strip) shape is formed. This second linear element (linear sub-element) 91H has a connecting portion 33, the main body 35 of the second linear element which is sequential to the connecting portion 33, and a step portion 37 on its mid-portion. The reason of providing the step portion 37 is mainly to substantially lengthen a length of the second linear element 91H. The connecting portion 33 is arranged so as to oppose the connecting portion 18 of the first linear element 11H over a predetermined length (dimension). In other words, the connecting portion 33 forms a capacitor structure with the connecting portion 18 of the first linear element 11H through the middle substrate 4 that is a dielectric. The size of an opposing dimension between the connecting portion 33 of the second linear element 91H and the connecting portion 18 of the first linear element 11H affects matching of the both. Specifically, since the impedance changes by increasing/decreasing the length (dimension) of the connecting portion 33 of the former, it is matched by setting the length to the appropriate value.

Figure 20:
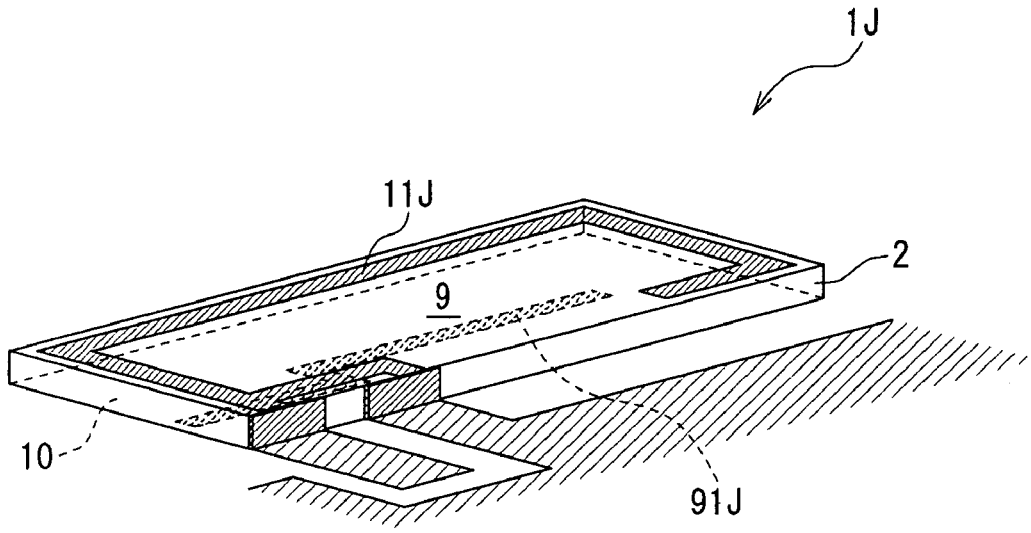
FIG. 20 is a perspective view of a dielectric antenna according to a second modification example of the third embodiment.

A second modification example of the third embodiment will be explained with reference to FIGS. 20 and 21. The second modification example is different from the third embodiment mainly in the connecting means for connecting the first linear element and the second linear element. Hereinafter, the difference will be explained, and explanation of common points in both is omitted. A dielectric antenna 1J shown in FIG. 20 is different from the dielectric antenna 1G shown in FIG. 16 in that one face of a dielectric layer 2 that is a dielectric base is set as a first antenna forming face 9 and a first linear element 11J is formed thereon, and the other face is set as a second antenna forming face 10 and a second linear element 91J is formed thereon. The first linear element 11J forms a capacitor structure with the second linear element 91J through the dielectric layer 2, and the former and latter are structured to resonate at a first resonance frequency and a second resonance frequency respectively. The dielectric layer 2 shown in FIG. 20 is a dingle layer, but the dielectric layer 2 itself may be formed as a multi-layer, or a layer other than the dielectric layer 2 may be provided thereon.

Figure 21:
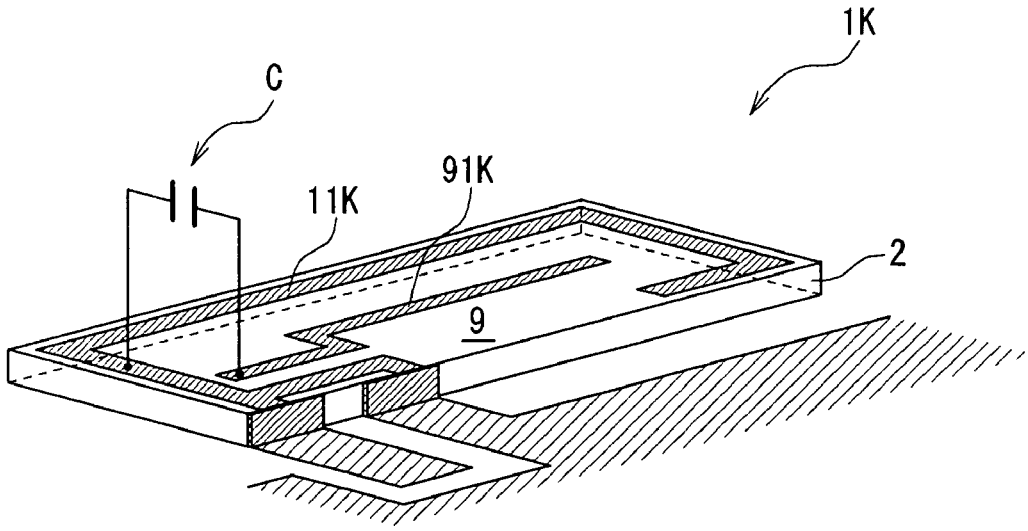
FIG. 21 is a perspective view of the dielectric antenna according to the second modification example of the third embodiment.

In a dielectric antenna 1K shown in FIG. 21, one face of a dielectric layer 2 that is a dielectric base is set as the antenna forming face 9, and a first linear element 11K and a second linear element 91K are both formed thereon. A base end of the second linear element 91K is connected to a mid-portion of the first linear element 11K through a capacitor (capacitor structure) C. Adjustment of degree of the connection is convenient to be carried out by changing a value of the capacitor C. The first linear element 11K and the second linear element 91K are structured to resonate at the first resonance frequency and the second resonance frequency respectively. The dielectric layer 2 itself may be formed as a multi-layer, or a layer other than the dielectric layer 2 may be provided.

A fourth embodiment will be explained with reference to FIGS. 22 to 25. First, the schematic structure of a dielectric antenna according to the fourth embodiment will be explained based on FIGS. 22 to 24. A dielectric antenna 1L has a dielectric base 7L in a rectangular parallelepiped shape formed by layering an upper substrate 3, a middle substrate 4, and a lower substrate 5, which are insulating and composed of a dielectric ceramic material. Each of these substrates may be a single layer body or a multi-layered body. On the drawings, each of the substrates is drawn as a single layer body for the convenience of drawing. All of the upper substrate 3, the middle substrate 4, and the lower substrate 5 are formed in a rectangle (quadrangle) having the same size when observed in a plan view, so that the dielectric base 7L formed by layering these three substrates becomes the rectangular parallelepiped shape. An upper face (a face opposing the middle substrate 4) of the lower substrate 5 is set as a second antenna forming face 10 for forming a second linear element (linear sub-element) which is described later. Further, an upper face (a face opposing the upper substrate 3) of the middle substrate 4 is set as a first antenna forming face 9 for forming a first linear element which is described later similarly. The upper substrate 3 is not for forming the antenna, but is a dielectric layer having a primary purpose of protecting the first linear element and the like formed on the first antenna forming face 9. The dielectric base 7L is formed as a three-layer structure, but may be formed as a two-layer structure omitting the upper substrate 3. Further, it may be structured as four-layer, five-layer or more by further layering other substrates. The reason of forming the dielectric base 7L in the rectangular parallelepiped shape is to facilitate a multi-getting by so-called die cutting or the like. Needless to say, the dielectric base may be formed in other shapes.

Figure 23:
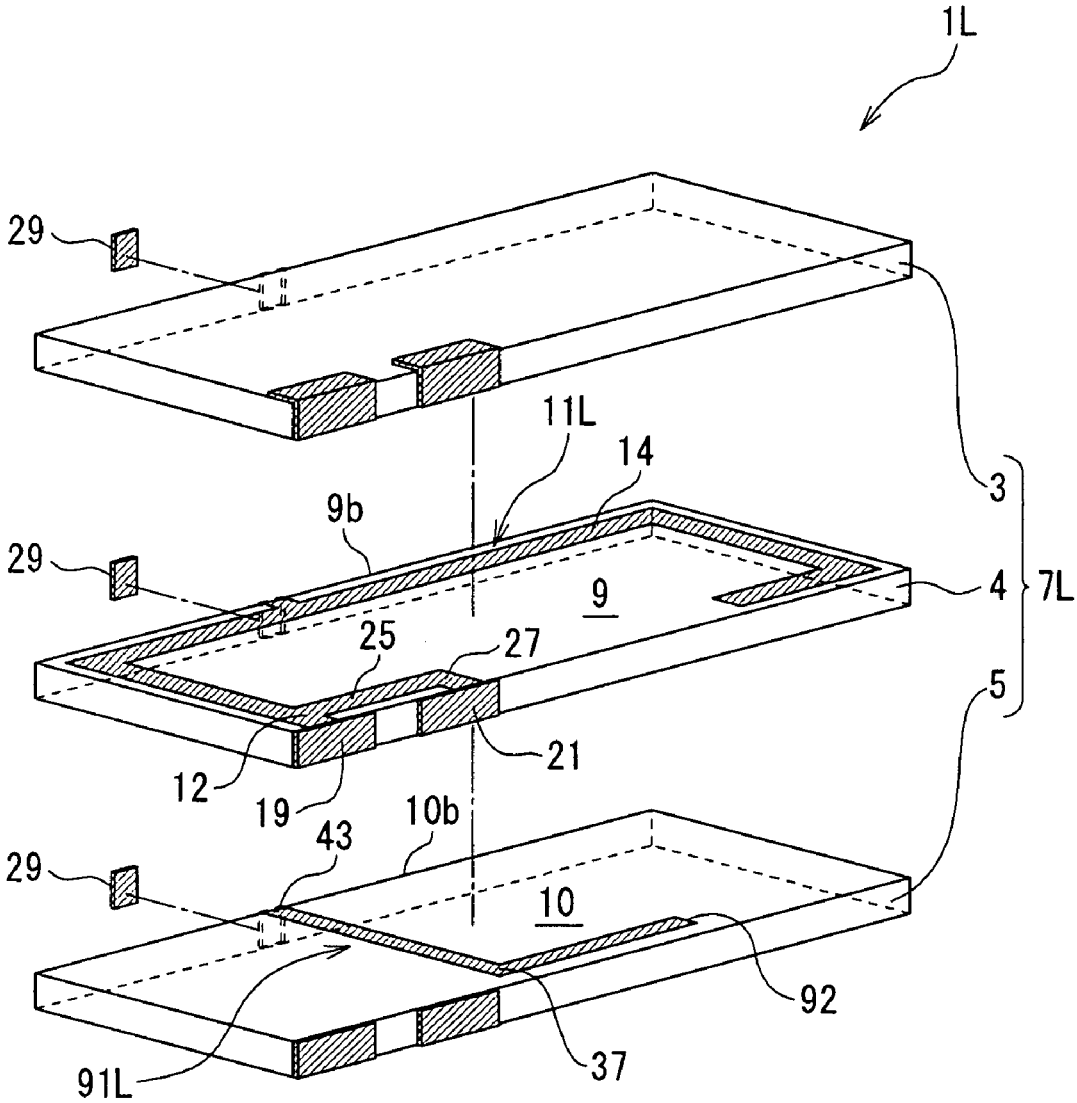
FIG. 23 is an exploded perspective view of the dielectric antenna shown in FIG. 22.
Figure 24:
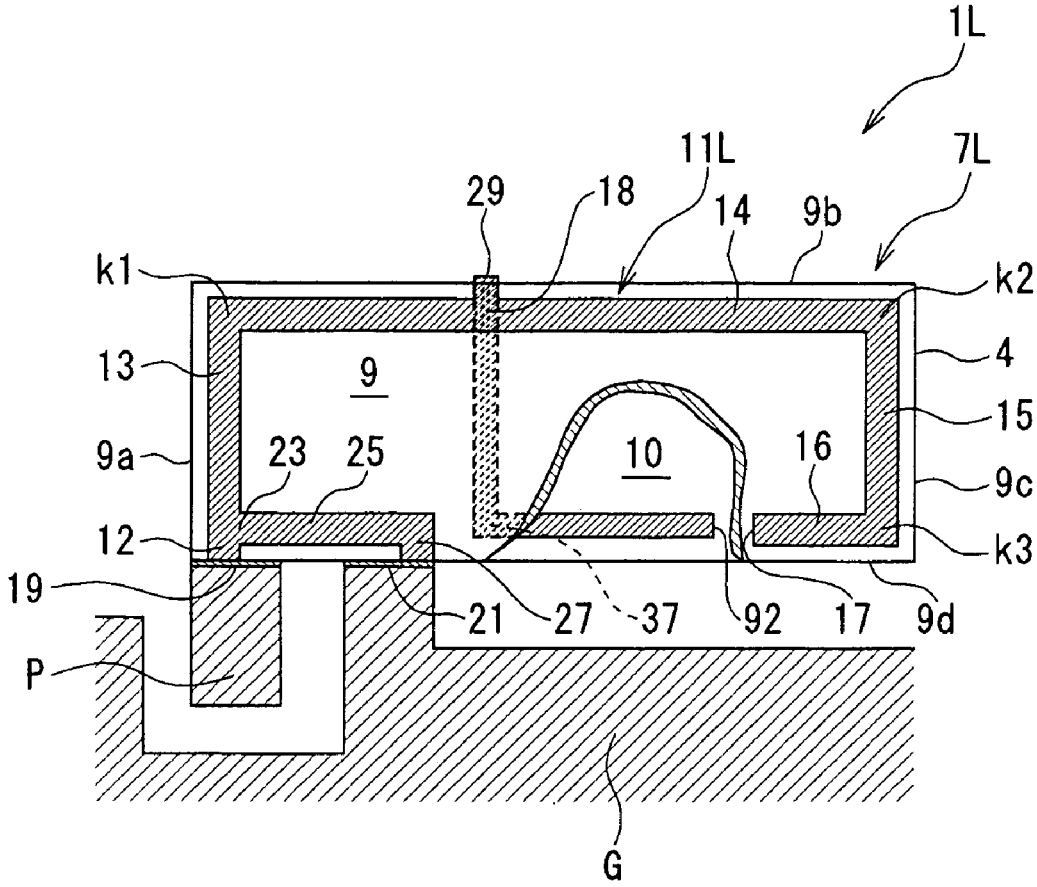
FIG. 24 is a plan view of the dielectric antenna shown in FIG. 22 in a state that an upper substrate thereof is omitted.

As shown in FIGS. 23 and 24, on the first antenna forming face 9, there is formed a first linear element 11L which is only adjacent to (parallel to) peripheries (9*a*, 9*b*, 9*c*, and 9*d*) of the first antenna forming face 9. It is convenient to carry out the formation of the first linear element 11L by printing a conductive paste, and margins are preferred to be left between the first linear element and the peripheries 9*a*, 9*b*, 9*c*, and 9*d* for absorbing a printing displacement during printing. On the other hand, the margins may be omitted when it will not be a problem to have a small printing displacement, or when the margins themselves are not necessary.

Figure 22:
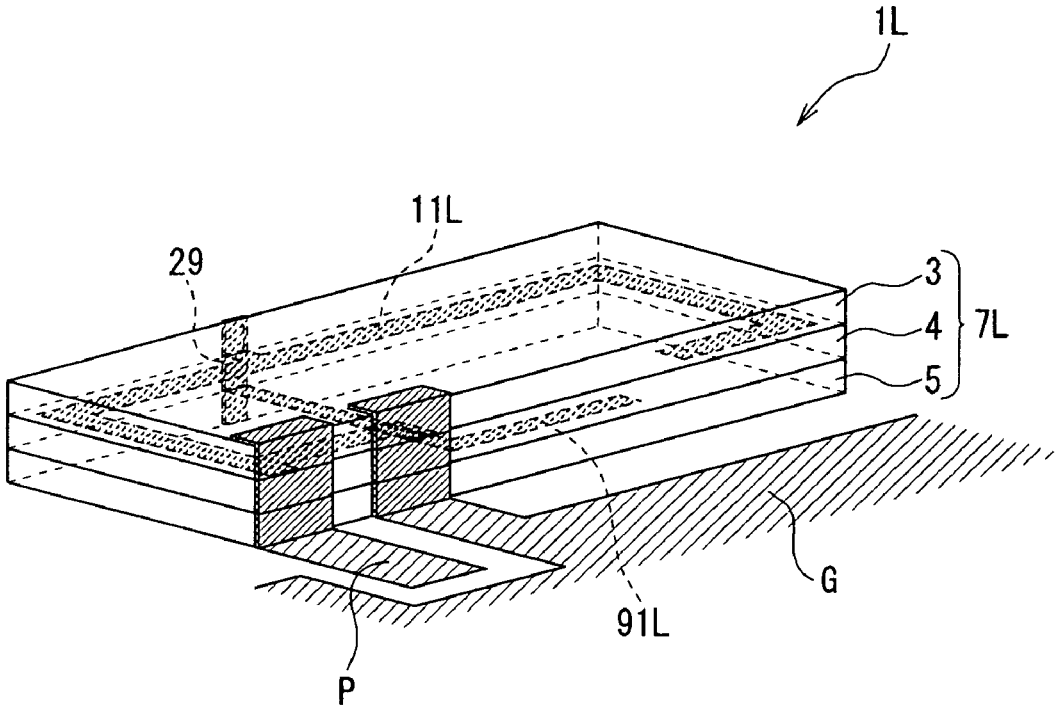
FIG. 22 is a perspective view of a dielectric antenna according to a fourth embodiment.

As shown in FIGS. 23 and 24, the first linear element 11L is formed of a first portion 13, a second portion 14, a third portion 15 and a fourth portion 16. The first portion 13 of the first linear element 11L is a portion located between a base end portion 12 and a first bending portion k1, and the second portion 14 of the first linear element is a portion located between the first bending portion k1 and a second bending portion k2. Further, the third portion 15 of the first linear element is a portion located between the second bending portion k2 and a third bending portion k3, and the fourth portion 16 of the first linear element is a portion located between the third bending portion k3 and an open end 17. That is to say, the first portion 13 is adjacent to the periphery 9*a*, the second portion 14 is adjacent to the periphery 9*b*, the third portion 15 is adjacent to the periphery 9*c*, and the fourth portion 16 is adjacent to the periphery 9*d* respectively. In addition, the bending portions k1, k2, and k3 are located at respective corners of the first antenna forming face 9, so that the first linear element 11L extends in an outside curling shape along the peripheries 9*a*, 9*b*, 9*c*, and 9*d* on the first antenna forming face 9. The base end portion 12 of the first linear element 11L is connected to a power supply terminal 19 formed on an end face of the dielectric base 7L as shown in FIGS. 22 to 24. Formation of the power supply terminal 19 is generally performed by applying a conductive paste on the end face of the dielectric base 7L.

The reason of forming the first linear element 11L in the outside curling shape as described above is that when formed on an antenna forming face having the same dimension, it takes a circuitous route as compared to the first linear element in a different shape which is not formed in the outside curling shape, so that the length of the first linear element can be lengthened by the length of the circuitous route. When the length of the first linear element becomes longer, a resonance frequency lowers accordingly, so that the first linear element can resonate at a low frequency in the same dimension. In other words, the same frequency can resonate in a smaller dimension, so that the antenna itself is miniaturized as a result. Further, by forming the first linear element 11L in the outside curling shape, a distance between the first portion 13 and the third portion 15, and a distance between the second portion 14 and the fourth portion 16, both of which oppose each other, respectively become the maximum on the first antenna forming face 9. Since the distances are the maximum, it becomes possible to effectively eliminate mutual interference between the first portion 13 and the third portion 15 and between the second portion 14 and the fourth portion 16 on the same first antenna forming face 9.

A linear conductor will be explained based on FIGS. 22 to 24. A linear conductor 25 provided on the first antenna forming face 9 is a conductor for matching impedance at the power supply terminal 19 which is a power supply point. The linear conductor 25 branches on the first antenna forming face 9 at a branch point 23 in the vicinity of the base end portion 12 of the first linear element 11L, and a tip thereof is connected through a bending portion 27 to a ground terminal 21 formed on an end face of the dielectric base 7L. The linear conductor 25 can be formed in a separate step from the first linear element 11L, but it is convenient to simultaneously print and form with the first linear element 11L using a conductive paste. Adjustment of the power supply point impedance can be carried out by displacing the position of the branch point 23 in a longitudinal direction of the first linear element 11L. Further, since the linear conductor 25 is also a part which contributes to the resonance of the first linear element 11L, the resonance frequency of the first linear element 11L can be adjusted by adjusting the length of the linear conductor 25. On the other hand, since the linear conductor 25 does not contribute to radiation of radio wave, it does not cause the mutual interference even when it is located adjacent to the first linear element 11L. Further, since it does not cause the mutual interference, the length of the linear conductor 25 can be lengthened on the same first antenna forming face 9 by partly bending or meandering the linear conductor 25. Incidentally, formation of the ground terminal 21 is, similarly to the power supply terminal 19, convenient to be performed by applying a conductive paste on the end portion of the dielectric base 7L.

As shown in FIGS. 22 to 24, on the second antenna forming face 10, a second linear element 91L protrudes inward from a base end portion 43 perpendicularly to a periphery 10*b* (refer to FIG. 23), and thereafter extends to an open end 92 through a bending portion 37. Since the first linear element 11L is, as described above, formed on the first antenna forming face 9 in the outside curling shape along the periphery thereof, the first antenna forming face 9 has a portion which is surrounded by the first linear element 11L and is blank like a courtyard. The second linear element 91L can be formed in a free shape using the blank courtyard portion, and thus it is not limited to the above-described shape. However, bending or meandering can often cause interference between adjacent elements as described above, so that the linear element is preferred to be formed only by linear portions and bending portions as far as possible.

The first linear element 11L has a connecting portion 18 on its mid-portion, and to the connecting portion 18, one end of a connecting conductor 29 in a strip shape is connected. The other end of the connecting conductor 29 is connected to the base end portion 43 of the second linear element 91L through an end face of a periphery of the middle substrate 4. The connecting conductor 29 shown in FIG. 23 extends, not only to the middle substrate 4, but also to end faces of peripheries of the lower substrate 5 and the upper substrate 3. The reason of this extension is merely that the connecting conductor 29 in this embodiment is formed by application of a conductive paste, and the application is easier for forming also on the other substrates than forming only on the middle substrate 4. When it is possible to perform the application only for, among portions of the connecting conductor 29, a portion related to the middle substrate 4, or to perform the formation by other means, the other portions besides the related portion may be omitted. Among portions of the connecting conductor 29, the portion related to the middle substrate 4 forms a part of the second linear element 91L. Accordingly, by the length of the formed portion of the connecting conductor 29, the length of the second linear element 91L on the second antenna forming face 10 becomes shorter.

Here, a high frequency current supplied from the power supply portion P to the first linear element 11L passes the power supply terminal 19 and sequentially flows from the base end portion 12 to the first bending portion k1, the second bending portion k2, the third bending portion k3, and the open end 17. On the other hand, a high frequency current flowing on the second linear element 91L sequentially flows from the base end portion 12 to the first bending portion k1, further enters from the connecting portion 18 to the connecting conductor 29, flows through the base end portion 43 and the bending portion 37 to the open end 92. The second linear element 91L is set to have a length capable of resonating at a second frequency that is different from the first frequency. Matching of impedance and adjustment of the resonance frequency are carried out by moving the connecting portion 18 in a longitudinal direction of the first linear element 11L.

Figure 25A:
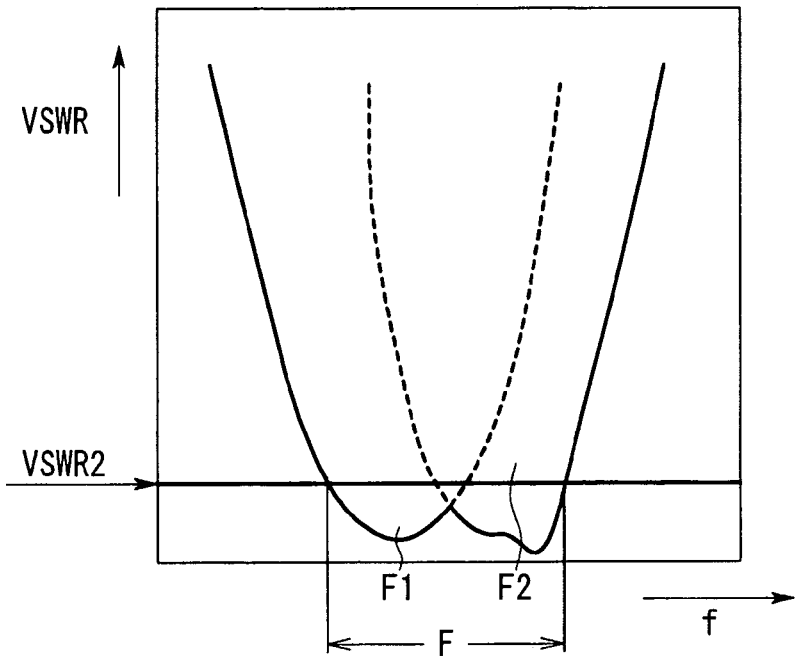
FIGS. 25*a* and 25*b* are graphic charts showing frequency characteristics of the dielectric antenna according to the fourth embodiment.
Figure 25B:
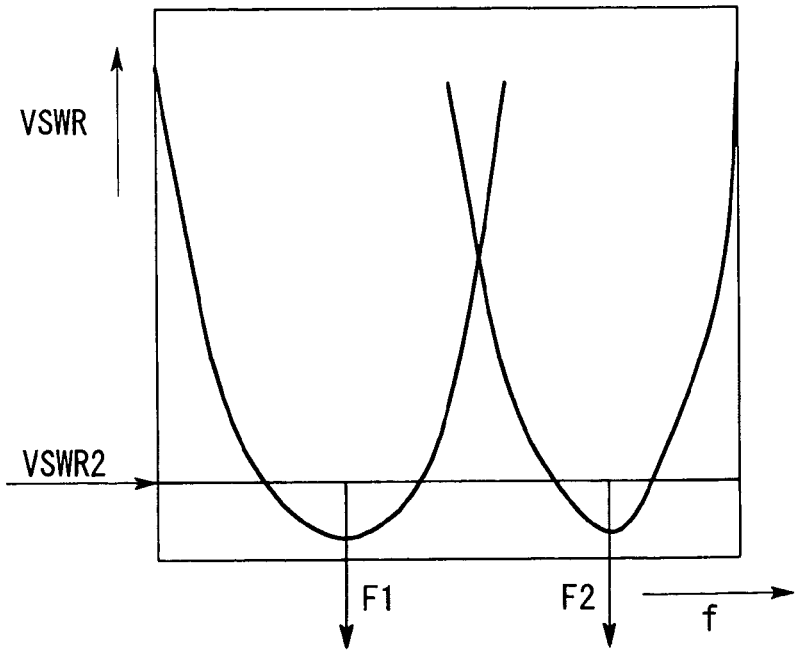

The second linear element 91L is formed to have the length capable of resonating at the second frequency (second frequency band) that is different from the first frequency. A relationship between the first frequency and the second frequency is determined according to an intended purpose of the dielectric antenna IL. Specifically, as shown in FIG. 25*a*, when a resonance frequency F1 of the first linear element 11L and a resonance frequency F2 of the second linear element 91L are set close to each other so as to obtain, for example, a band F at VSWR2 or lower, formation of the second linear element 91L can make the frequency band of the entire dielectric antenna 1L to be a wider band as compared to the case of not forming the second linear element 91L. Further, as shown in FIG. 25*b*, by moderately separating the first resonance frequency F1 and the second resonance frequency F2, the dielectric antenna 1L becomes capable of resonating at two frequencies, that is, a dual band. According to an experiment performed by the inventor, when the first resonance frequency F1 in the former case was set to, for example, 1.98 GHz and the second resonance frequency was set to 2.10 GHz, the band at VSWR2 or lower became a wider band such as 1.92 GHz to 2.17 GHz. Similarly, in the latter case, the dual band was realized in which the first resonance frequency F1 was 2.45 GHz, which is used for wireless communication such as in notebook computer or LAN card, and similarly the second resonance frequency F2 was 5.25 GHz.

Incidentally, on the back face of the lower substrate 5 (a face of backside of FIG. 24), a dummy electrode (not shown) for firmly soldering the dielectric antenna 1L on a parent substrate (not shown) is formed. When mounting on the parent substrate (not shown), the power supply terminal 19 is connected to a power supply portion P of the parent substrate and the ground terminal 21 is connected to a ground portion G thereof respectively by soldering.

Figure 26:
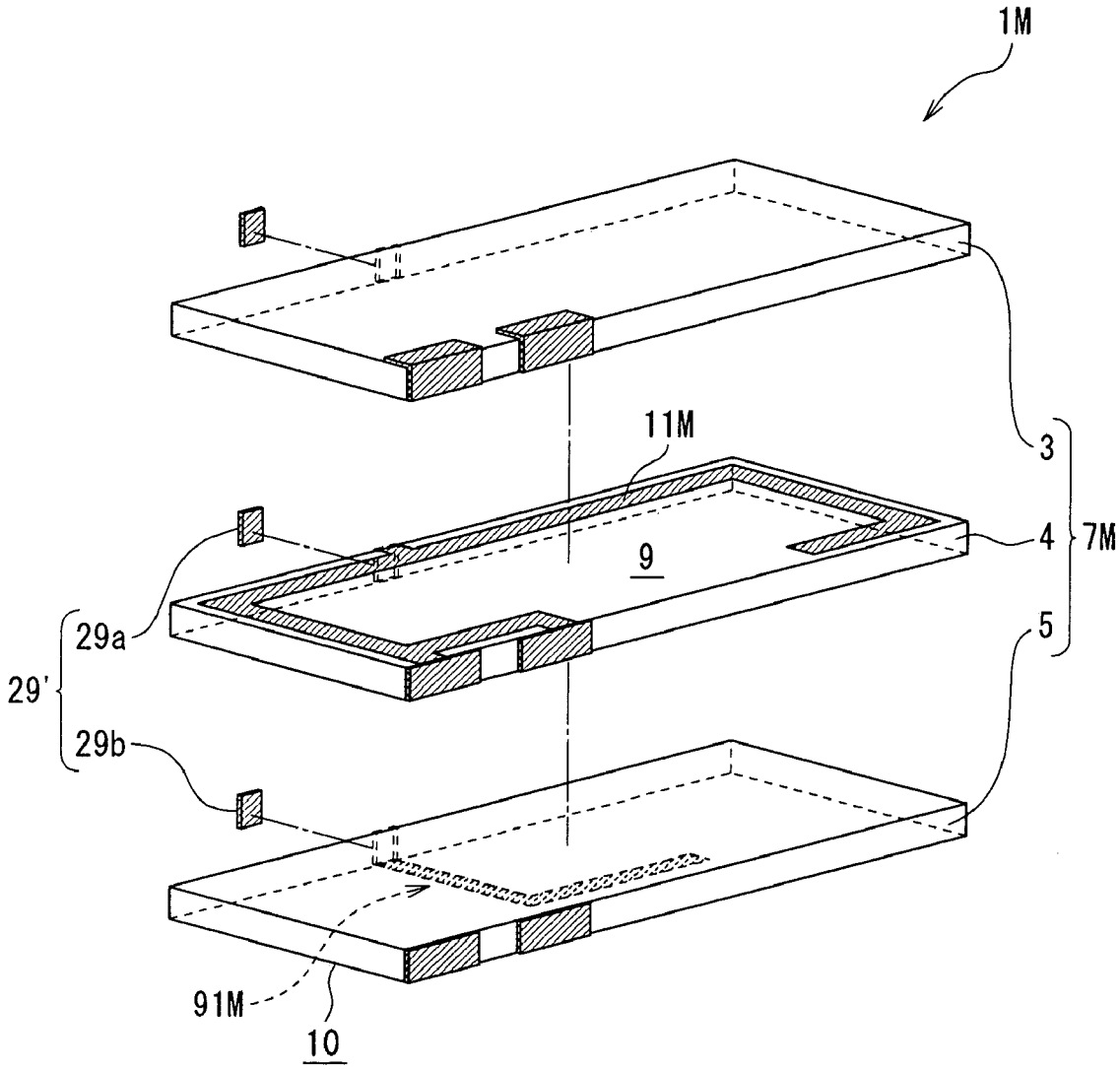
FIG. 26 is an exploded perspective view of a dielectric antenna according to a first modification example of the fourth embodiment.

A first modification example of the fourth embodiment will be explained with reference to FIG. 26. A dielectric antenna 1M in the first modification example is different from the dielectric antenna 1L shown in FIG. 23 in a position of forming the second linear element (linear sub-element) 91M. Hereinafter, the difference will be explained, and explanation of common points in both is omitted. Specifically, the dielectric antenna 1M shown in FIG. 26 is formed by layering an upper substrate 3, a middle substrate 4, and a lower substrate 5, which is common to the dielectric antenna 1L according to the fourth embodiment. A first linear element 11M is formed on an antenna forming face 9 of the middle substrate 4, which is also common thereto. The lower substrate 5 shown in FIG. 26 has a back face formed as an antenna forming face 10, and the second linear element 91M is formed on the antenna forming face 10. As a result, a connecting conductor 29' has a length in which 29*a* and 29*b* are combined. In other words, the length becomes approximately the double of the length of the connecting conductor 29 explained above. Accordingly, a length of the second linear element 91M on the second antenna forming face 10 can be further shortened. The lower substrate 5 itself may be structured as a multi-layered body, or another substrate (not shown) may be further provided under the lower substrate 5. On the other hand, the upper substrate 3 may be omitted in order to thin the dielectric antenna 1M itself, which is the same as in the case of the dielectric antenna 1L. Without forming the lower substrate 5, a backside of the middle substrate 4 may be the antenna forming face.

A second modification example of the fourth embodiment will be explained based on FIG. 27. This modification example is different from the fourth embodiment mainly in the shapes of elements. Hereinafter, the difference will be explained, and explanation of common points in both is omitted. Specifically, on a first antenna forming face 9 of a dielectric antenna 1N, there is formed a first linear element 11N which is adjacent to (parallel to) peripheries (9*b*, 9*c*, and 9*d*) of the first antenna forming face 9. It is convenient to carry out the formation of the first linear element 11N by printing a conductive paste, and margins are preferred to be left between the first linear element and the peripheries 9*b*, 9*c*, and 9*d* for absorbing a printing displacement during printing.

The first linear element 11N has a first portion 13 extending along the periphery 9*b* from a base end portion 12 connected to a power supply terminal 19, a second portion 14 extending along the periphery 9*c* through a bending portion k1, and a third portion 15 extending along the periphery 9*d* through a bending portion k2. The reason of forming the first linear element 11N in an outside curling shape along the peripheries 9*b* to 9*d* of the antenna forming face is that, similarly to the case of the aforementioned first linear element 11L (refer to FIG. 24), when formed on an antenna forming face having the same dimension, it takes a circuitous route as compared to the first linear element in a different shape which is not formed in the outside curling shape, so that the length of the first linear element can be lengthened by the length of the circuitous route. The first linear element 11N is formed to have a length (¼ wave length) capable of resonating at a first frequency (for example, a 2.4 GHz band).

Figure 27:
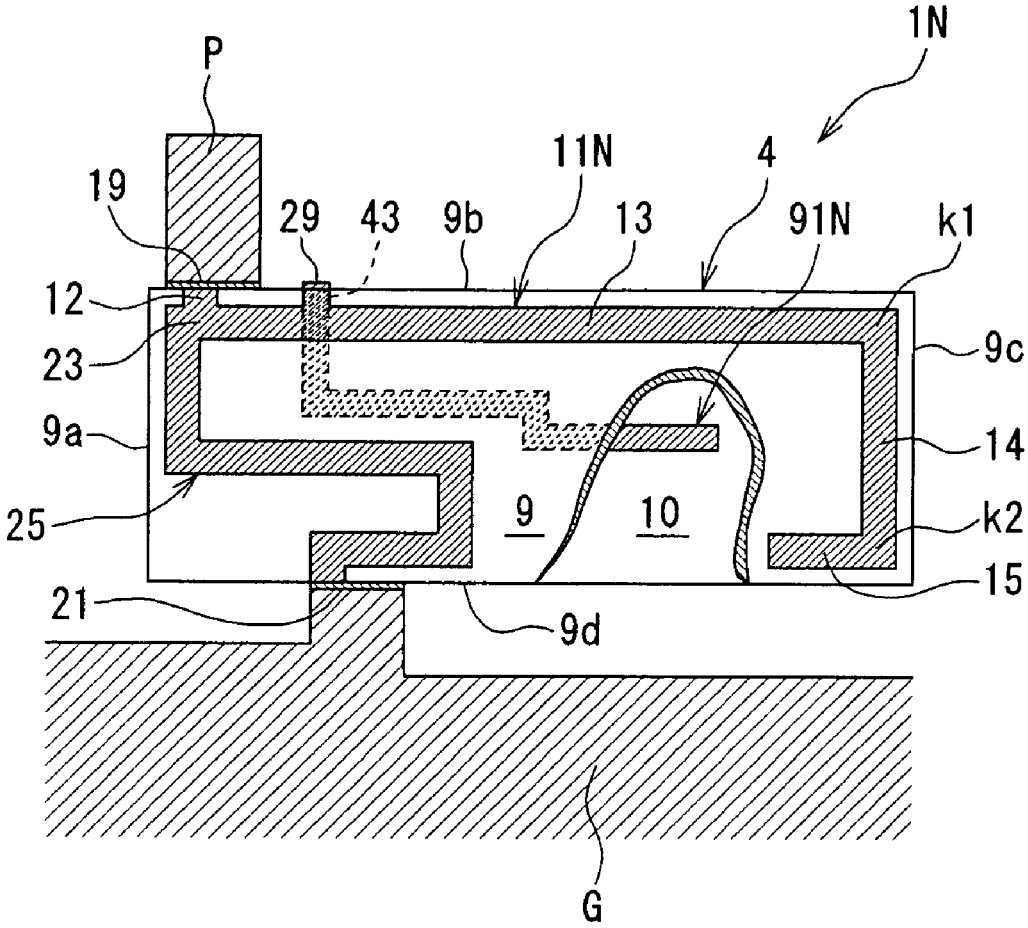
FIG. 27 is a plan view of a dielectric antenna according to a second modification example of the fourth embodiment in a state that an upper substrate thereof is omitted.

A reference numeral 25 in FIG. 27 denotes a linear conductor for impedance matching. The linear conductor 25 branches at a branch point 23 in the vicinity of the base end portion 12 of the first linear element 11N, and is connected to a ground terminal 21. A portion of the linear conductor 25 is adjacent to a periphery 9*a* of the first antenna forming face 9, and other portions thereof are formed in a meander shape. The reason of forming in the meander shape is to gain a length in a limited dimension, and thus it may be formed in a linear shape when there is a sufficient dimension. The linear conductor 25 may be formed in a separate step from the linear element 11N, but it is better to be printed and formed simultaneously with the first linear element 11N using a conductive paste because this manner eliminates the labor of formation. Adjustment of power supply point impedance is carried out by displacing the position of the branch point 23. Further, since the linear conductor 25 is also a part which contributes to the resonance of the first linear element 11N, the resonance frequency of the first linear element 11N can be adjusted by adjusting the length of the linear conductor 25.

As shown in FIG. 27, on a second antenna forming face 10 which the lower substrate 5 has, a second linear element 91N bending stepwise is formed. The reason of bending stepwise is to avoid contact in high frequency with the linear conductor 25, and not to form a capacitor structure having the middle substrate 4 intervening therebetween. A base end portion 43 of the second linear element 91N is connected to a mid-portion of the first linear element 11N through a connecting conductor 29 formed on an end face of a periphery of the middle substrate 4. The connecting conductor 29 forms a part of the second linear element 91N, so that the second linear element 91N can be shortened by a length of the part.

A fifth embodiment will be explained with reference to FIGS. 28 to 31. First, the schematic structure of a dielectric antenna according to the fifth embodiment will be explained based on FIGS. 28 to 30. A dielectric antenna 1P has a dielectric base 7P in a rectangular parallelepiped shape formed by layering an upper substrate 3, a middle substrate 4, and a lower substrate 5, which are insulating and composed of a dielectric ceramic material. All of the upper substrate 3, the middle substrate 4, and the lower substrate 5 are formed in a rectangle (quadrangle) having the same size when observed in a plan view, so that the dielectric base 7P formed by layering these three substrates becomes the rectangular parallelepiped shape. Each of the substrates may be a single layer body or a multi-layered body. An upper face (a face opposing the upper substrate 3) of the middle substrate 4 is set as a first antenna forming face 9 for forming a first linear element which is described later. Further, an upper face (a face opposing the middle substrate 4) of the lower substrate 5 is set as a second antenna forming face 10 for forming a second linear element (linear sub-element) which is described later similarly. The upper substrate 3 is not for forming the antenna, but is a dielectric layer having a primary purpose of protecting the first linear element and the like formed on the first antenna forming face 9. The dielectric base 7P is formed as a three-layer structure, but may be formed as a two-layer structure omitting the upper substrate 3. Further, it may be structured as four-layer, five-layer or more by further layering other substrates. The reason of forming the dielectric base 7P in the rectangular parallelepiped shape is to facilitate a multi-getting by so-called die cutting or the like. Needless to say, the dielectric base may be formed in other shapes.

Figure 29:
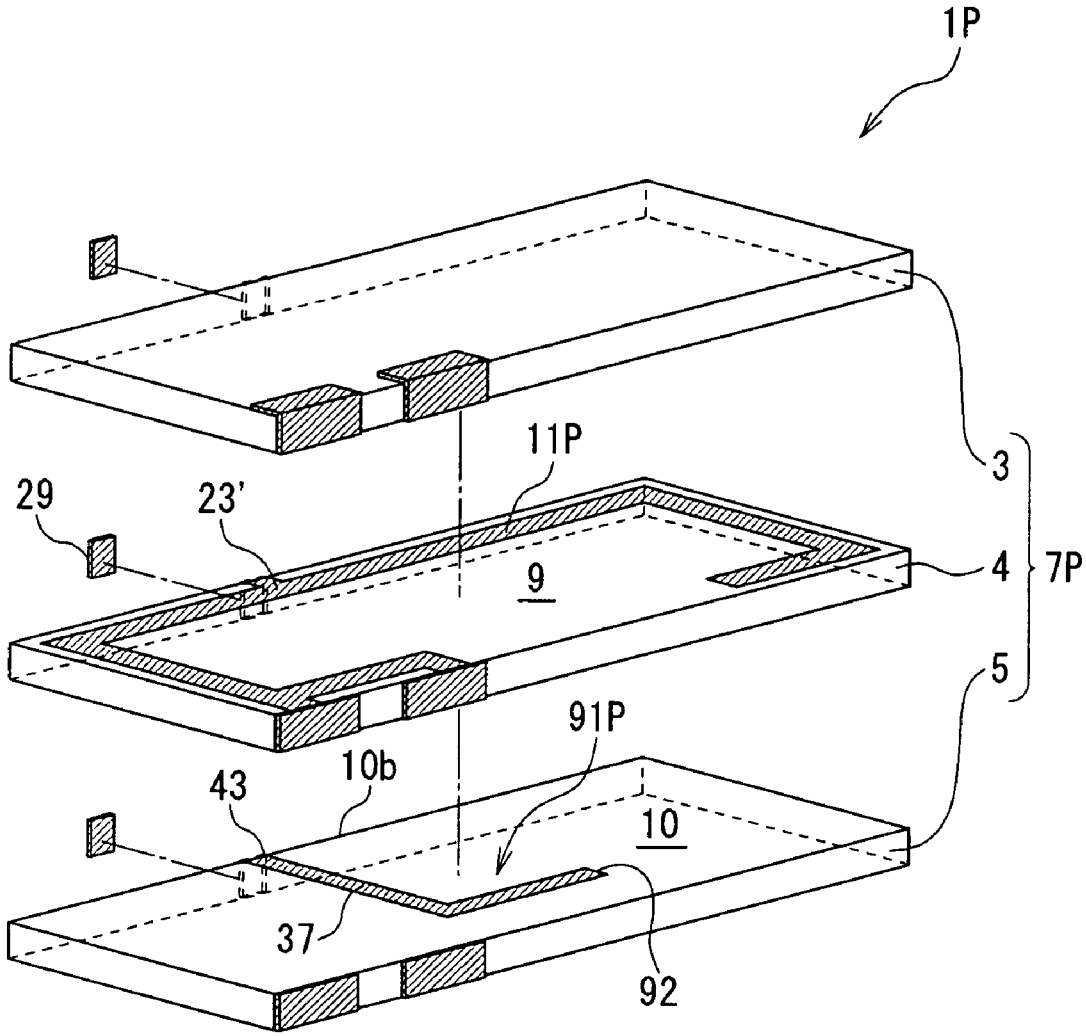
FIG. 29 is an exploded perspective view of the dielectric antenna shown in FIG. 28.
Figure 30:
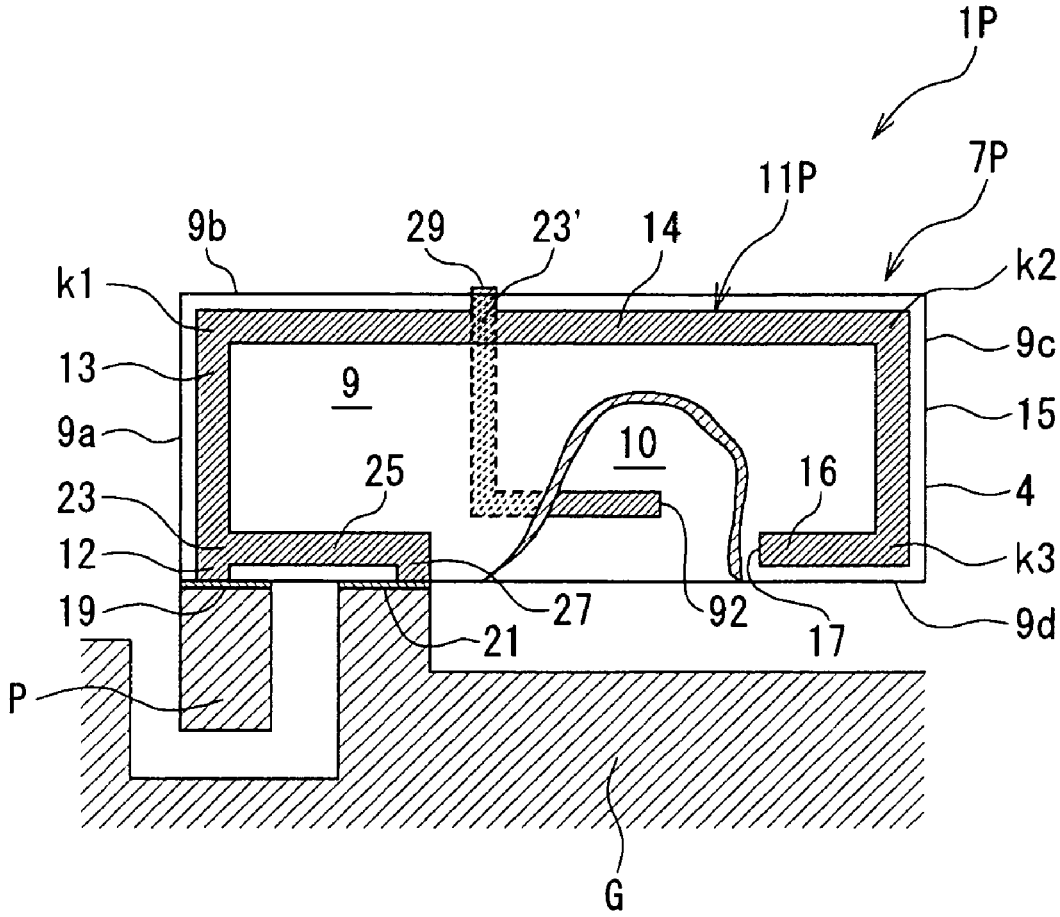
FIG. 30 is a plan view of the dielectric antenna shown in FIG. 28 in a state that an upper substrate thereof is omitted.

As shown in FIGS. 29 and 30, on the first antenna forming face 9, there is formed a first linear element 11P which is adjacent to (parallel to) peripheries (9*a*, 9*b*, 9*c*, and 9*d*) of the first antenna forming face 9. It is convenient to carry out the formation of the first linear element 11P by printing a conductive paste, and margins are preferred to be left between the first linear element and the peripheries 9*a*, 9*b*, 9*c*, and 9*d* for absorbing a printing displacement during printing.

As shown in FIGS. 29 and 30, the first linear element 11P is formed of a first portion 13, a second portion 14, a third portion 15 and a fourth portion 16. The first portion 13 of the first linear element 11P is a portion located between a base end portion 12 and a first bending portion k1, and the second portion 14 of the first linear element is a portion located between the first bending portion k1 and a second bending portion k2. Further, the third portion 15 of the first linear element is a portion located between the second bending portion k2 and a third bending portion k3, and the fourth portion 16 of the first linear element is a portion located between the third bending portion k3 and an open end 17. That is to say, the first portion 13 is adjacent to the periphery 9*a*, the second portion 14 is adjacent to the periphery 9*b*, the third portion 15 is adjacent to the periphery 9*c*, and the fourth portion 16 is adjacent to the periphery 9*d* respectively. In addition, the bending portions k1, k2, and k3 are located at respective corners of the first antenna forming face 9, so that the first linear element 11P extends in an outside curling shape along the peripheries 9*a*, 9*b*, 9*c*, and 9*d* on the first antenna forming face 9. The base end portion 12 of the first linear element 11P is connected to a power supply terminal 19 formed on an end face of the dielectric base 7P as shown in FIGS. 29 and 30. Formation of the power supply terminal 19 is generally performed by applying the conductive paste on the end face of the dielectric base 7P.

The reason of forming the first linear element 11P in the outside curling shape as described above is that, when formed on an antenna forming face having the same dimension, it takes a circuitous route as compared to the first linear element in a different shape which is not formed in the outside curling shape, so that the length of the first linear element can be lengthened by the length of the circuitous route. Further, another reason thereof is that a blank portion surrounded by the first linear element formed in the outside curling shape can be effectively utilized. Regarding the former reason, when the length of the first linear element becomes longer, a resonance frequency lowers accordingly, so that the first linear element can resonate at a low frequency in the same dimension. In other words, the same frequency can resonate in a smaller dimension, so that the antenna itself is miniaturized as a result. Regarding the latter reason, by forming the first linear element 11P in the outside curling shape, a distance between the first portion 13 and the third portion 15, and a distance between the second portion 14 and the fourth portion 16, both of which oppose each other, respectively become the maximum on the first antenna forming face 9. Since the distances are the maximum, it becomes possible to effectively eliminate mutual interference between the first portion 13 and the third portion 15 and between the second portion 14 and the fourth portion 16 on the same first antenna forming face 9. Further, mutual interference with a second linear element which is described later is also eliminated.

A linear conductor will be explained based on FIGS. 28 to 30. A linear conductor 25 provided on the first antenna forming face 9 is a conductor for matching impedance at the power supply terminal 19 which is a power supply point. The linear conductor 25 branches on the first antenna forming face 9 at a branch point 23 in the vicinity of the base end portion 12 of the first linear element, and a tip thereof is connected through a bending portion 27 to a ground terminal 21 provided on an end face of the dielectric base 7P. The linear conductor 25 can be formed in a separate step from the first linear element 11P, but it is convenient to simultaneously print and form with the first linear element 11P using a conductive paste. Adjustment of the power supply point impedance can be carried out by displacing the position of the branch point 23 in a longitudinal direction of the first linear element 11P. Further, since the linear conductor 25 is also a part which contributes to the resonance of the first linear element 11P, the resonance frequency of the first linear element 11P can be adjusted by adjusting the length of the linear conductor 25. On the other hand, since the linear conductor 25 does not contribute to radiation of radio wave, it does not often cause the mutual interference even when it is located adjacent to the first linear element 11P. Incidentally, formation of the ground terminal 21 is, similarly to the power supply terminal 19, convenient to be performed by applying the conductive paste on the end portion of the dielectric base 7P.

Figure 28:
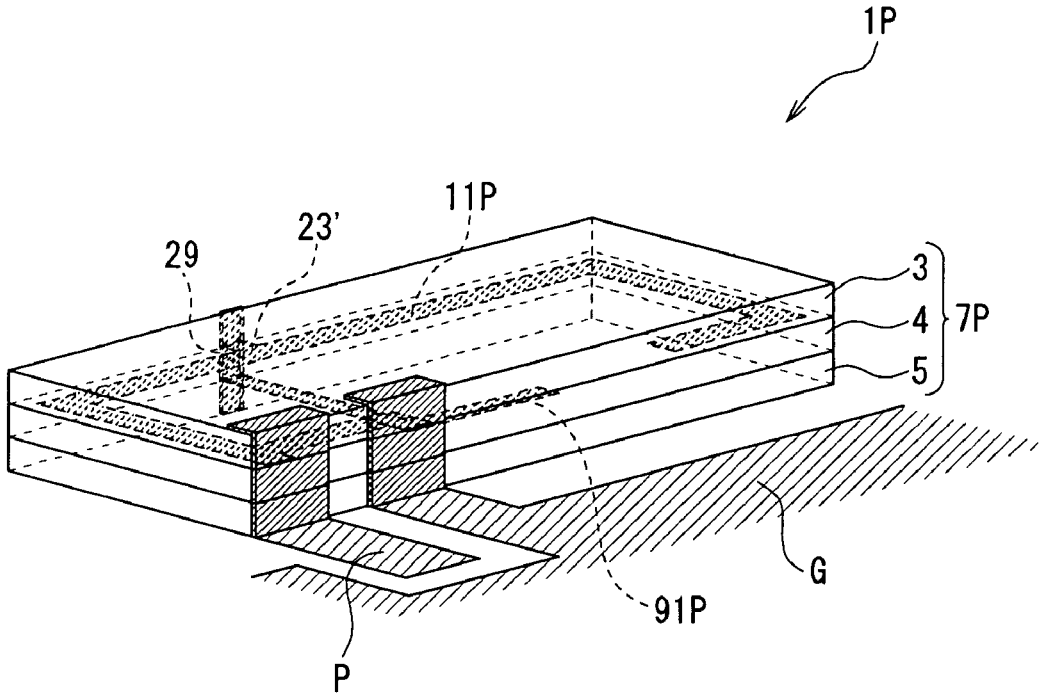
FIG. 28 is a perspective view of a dielectric antenna according to a fifth embodiment.

As shown in FIGS. 28 to 30, on the second antenna forming face 10, a second linear element 91P protrudes inward from a base end portion 43 perpendicularly to a periphery 10*b* (refer to FIG. 29), and thereafter extends to an open end 92 through a bending portion 37. Since the first linear element 11P is, as described above, formed on the first antenna forming face 9 in the outside curling shape along the periphery thereof, the first antenna forming face 9 has a portion which is surrounded by the first linear element 11P and is blank like a courtyard. The second linear element 91P can be formed in a free shape using the blank courtyard portion, but it is formed not to intersect the first linear element 11P when observed (in a plan view) in a thickness direction of the dielectric base 7P (in a perpendicular direction in FIG. 30) in order to eliminate interference between the first linear element 11P and the second linear element. By this elimination of the interference, radiation efficiency of the dielectric antenna 1P is increased, and a wide band can be realized. Further, the first linear element 11P becomes independently adjustable from the second linear element 91P. On the other hand, when adjusting the second linear element 91P, it becomes independently adjustable from the first linear element 11P. This capability of independent adjustment simplifies adjustment of the dielectric antenna 1P itself. Incidentally, it is needless to say that the shape of the second linear element 91P may be selected from shapes other than that shown in FIG. 30 as long as its portion except the connecting portion does not overlap the first linear element 11P.

The first linear element 11P has a connecting portion 23' on its mid-portion, and to this connecting portion 23', one end of a connecting conductor 29 in a strip shape is connected. The other end of the connecting conductor 29 is connected to the base end portion 43 of the second linear element 91P through an end face of a periphery of the middle substrate 4. The connecting conductor 29 shown in FIG. 29 extends, not only to the middle substrate 4, but also to end faces of peripheries of the lower substrate 5 and the upper substrate 3. The reason of this extension is merely that the connecting conductor 29 in this embodiment is formed by printing a conductive paste, and the printing is easier for forming also on the other substrates than forming only on the substrate 4. When it is possible to perform the application only for, among portions of the connecting conductor 29, a portion related to the middle substrate 4, or to perform the formation by other means, the other portions besides the related portion may be omitted. Among portions of the connecting conductor 29, the portion related to the middle substrate 4 forms a part of the second linear element 91P. Accordingly, by the length of the partly formed portion of the connecting conductor 29, the length of the second linear element 91P on the second antenna forming face 10 becomes shorter. The base end portion 43 of the second linear element 91P and the connecting conductor 29 correspond to the connecting portion of the second linear element 91P in this embodiment.

Here, a high frequency current supplied from the power supply portion P flows sequentially from the base end portion 12 of the first linear element 11P to the first bending portion k1, the second bending portion k2, the third bending portion k3, and the open end 17. The first linear element 11P resonates at a first resonance frequency. On the other hand, a high frequency current flowing on the second linear element 91P sequentially flows from the base end portion 12 to the first bending portion k1, further enters from the connecting portion 23' to the connecting conductor 29, flows through the base end portion 43 and the bending portion 37 to the open end 92. The second linear element 91P is set to have a length capable of resonating at a second resonance frequency that is different from the first resonance frequency. Matching of impedance and adjustment of the resonance frequency are carried out by moving the connecting portion 23' in a longitudinal direction of the first linear element 11P. The second linear element 91P resonates at the second resonance frequency that is different from the first resonance frequency.

Figure 31A:
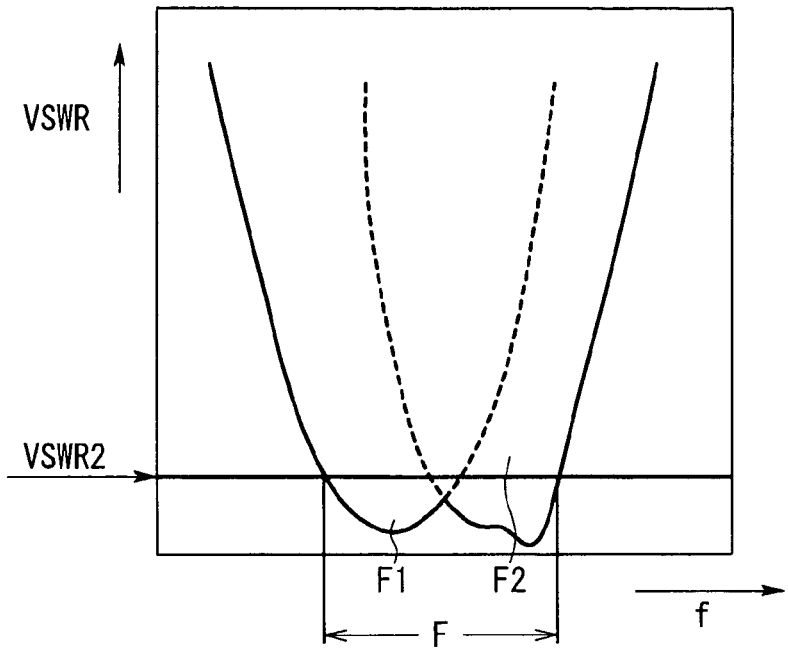
FIGS. 31*a* and 31*b* are graphic charts showing frequency characteristics of the dielectric antenna according to the fifth embodiment.
Figure 31B:
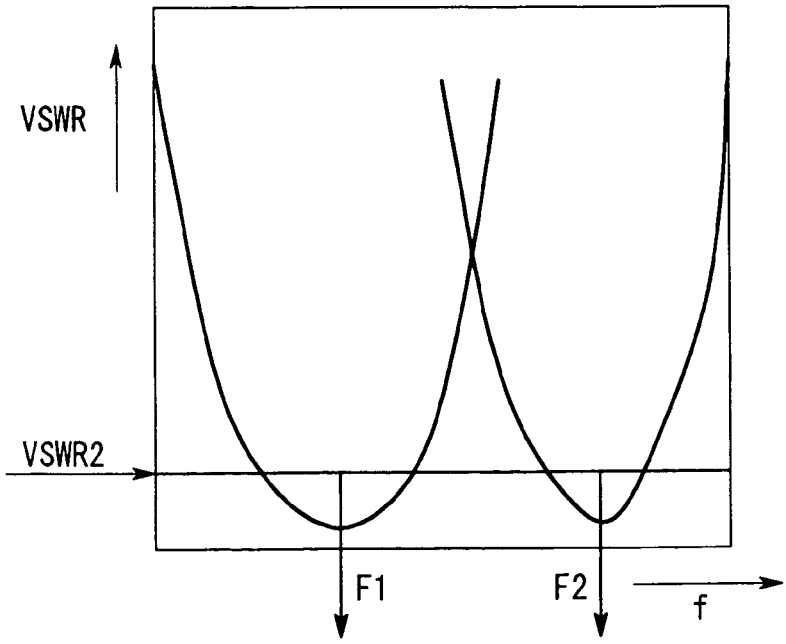

A relationship between the first resonance frequency and the second resonance frequency is determined according to an intended purpose of the dielectric antenna 1P. Specifically, as shown in FIG. 31*a*, when a resonance frequency F1 of the first linear element 11P and a resonance frequency F2 of the second linear element 91P are set close to each other so as to obtain, for example, a band F at VSWR2 or lower, provision of the second linear element 91P can make the frequency band of the entire dielectric antenna 1P to be a wider band as compared to the case of not providing the second linear element 91P. Further, as shown in FIG. 31*b*, by moderately separating the first resonance frequency F1 and the second resonance frequency F2, the dielectric antenna 1P becomes capable of resonating at two frequencies, that is, a dual band. According to an experiment performed by the inventor, when the first resonance frequency F1 in the former case was set to, for example, 1.98 GHz and the second resonance frequency was set to 2.10 GHz, the band at VSWR2 or lower became a wider band such as 1.92 GHz to 2.17 GHz. Similarly, in the latter case, the dual band was realized in which the first resonance frequency F1 was 2.45 GHz, which is used for wireless communication such as in notebook computer or LAN card, and the second resonance frequency F2 was 5.25 GHz.

Incidentally, on the back face (a face of backside of FIG. 30) of the lower substrate 5, a dummy electrode (not shown) for firmly soldering the dielectric antenna 1P on a parent substrate (not shown) is formed. When mounting on the parent substrate (not shown), the power supply terminal 19 is connected to a power supply portion P of the parent substrate and the ground terminal 21 is connected to a ground portion G thereof respectively by soldering.

Figure 32:
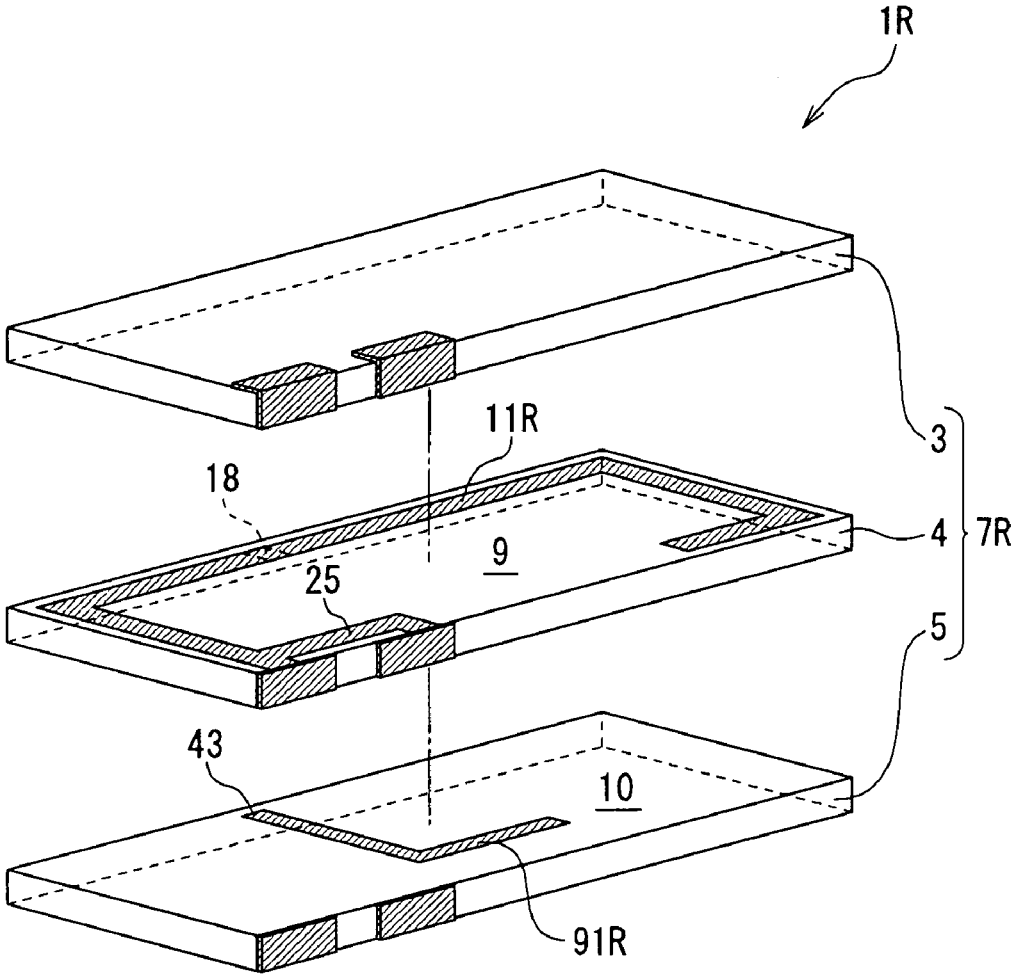
FIG. 32 is an exploded perspective view of a dielectric antenna according to a modification example of the fifth embodiment.
Figure 33:
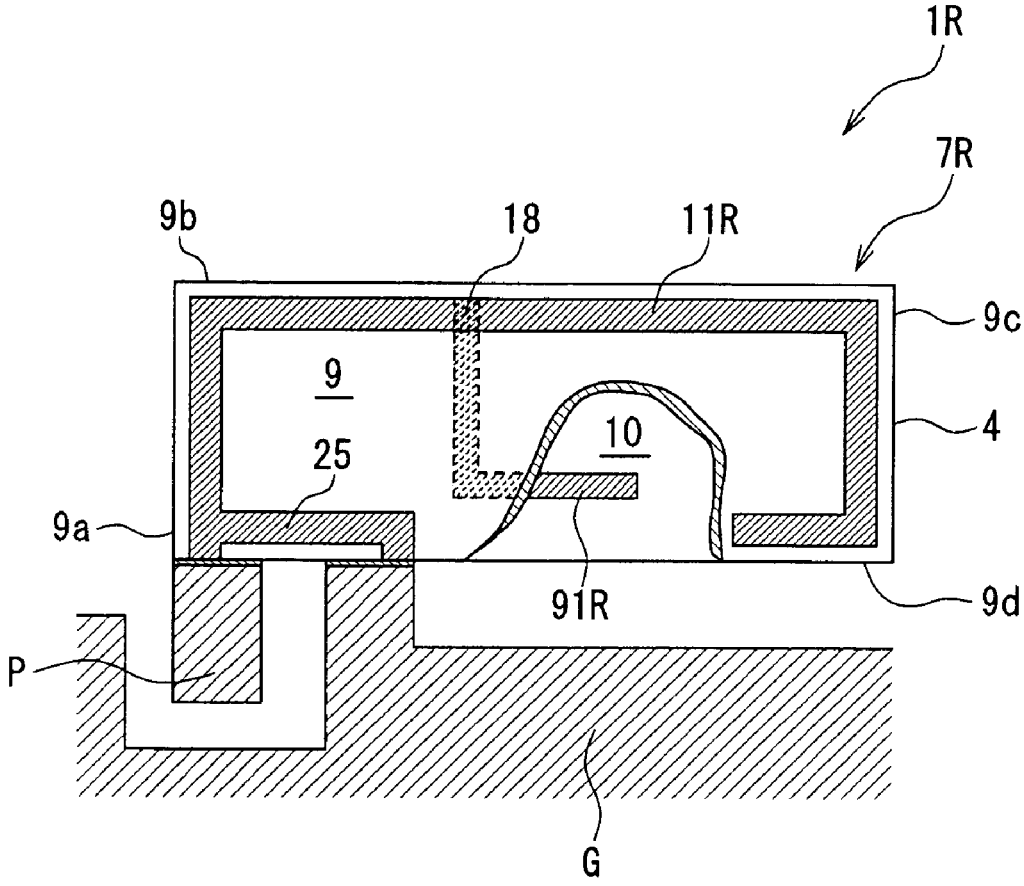
FIG. 33 is a plan view of the dielectric antenna shown in FIG. 32 in a state that un upper substrate thereof is omitted.
Figure 34:
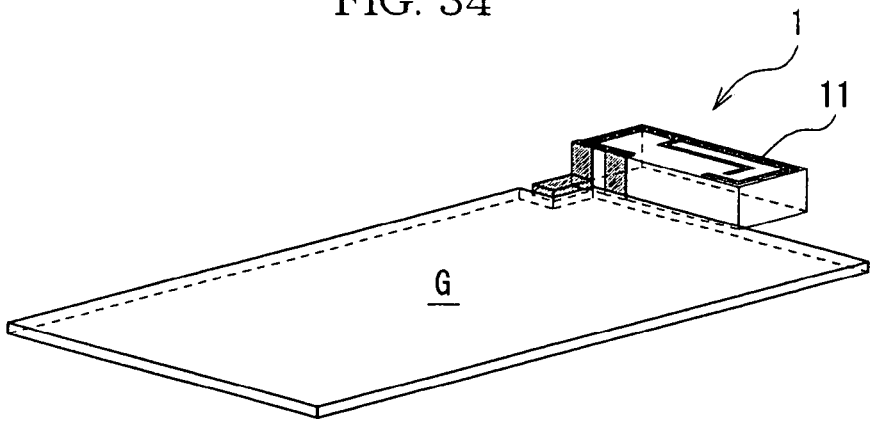
FIG. 34 is a perspective view showing a mounting form of a dielectric antenna.

A modification example of the fifth embodiment will be explained with reference to FIGS. 32 and 33. A dielectric antenna 1R according to this modification example is different from the dielectric antenna 1P shown in FIG. 29 in a connection form of elements. Here, the difference will be explained, and explanation of common points is omitted. Specifically, the dielectric antenna 1R has a dielectric base 7R formed by layering an upper substrate 3, a middle substrate 4, and a lower substrate 5, which are insulating and composed of a dielectric ceramic material. On a first antenna forming face 9 which the middle substrate 4 has, there is formed a first linear element 11R which is adjacent to (parallel to) peripheries, 9*a*, 9*b*, 9*c*, and 9*d* of the first antenna forming face 9. A reference numeral 25 shown in FIG. 32 denotes a linear conductor for matching impedance which is connected to the first linear element 11R.

On a second antenna forming face 10 which the lower substrate 5 has, a second linear element (linear sub-element) 91R is formed. A shape of the second linear element 91R may be different from that of the second linear element 91P (refer to FIG. 29) in this embodiment, but it is formed in the same form in this modification example. A base end portion 43 (refer to FIG. 32) of the second linear element 91R opposes a connecting portion 18 of the first linear element 11R, thereby forming a capacitor structure between the both through the middle substrate 4 which is a dielectric. In other words, a high frequency current supplied from a power supply portion P flows from the connecting portion 18 of the first linear element 11R through the middle substrate 4 to the second linear element. The size of an opposing dimension between the base end portion 43 and the connecting portion 18 affects matching of the both. Specifically, since the impedance changes by increasing/decreasing the length (dimension) of the base end portion 43 of the former, the connection of the both can be matched by setting the length to the appropriate value.

By the dielectric antenna of the present invention according to the above-described first to fifth embodiments, although being made in a small size, a radio wave can be efficiently radiated over a wide band by restraining the mutual interference between elements. Therefore, by a mobile communication device which includes such a dielectric antenna, the mobile communication device itself can be miniaturized, and comfortable mobile communication becomes possible through transmission/reception of radio wave in good quality.

An example of a mounting form of a dielectric antenna will be explained based on FIGS. 34 to 37. A dielectric antenna 1 shown in FIG. 34 (which is equivalent to the dielectric antenna according to any one of the first to fifth embodiments) is placed beside a ground portion G. In this case, since a linear element 11 (linear sub-element 91) is located farthest from the ground portion G, it has an advantage that it is hardly affected by the ground portion G.

Figure 35:
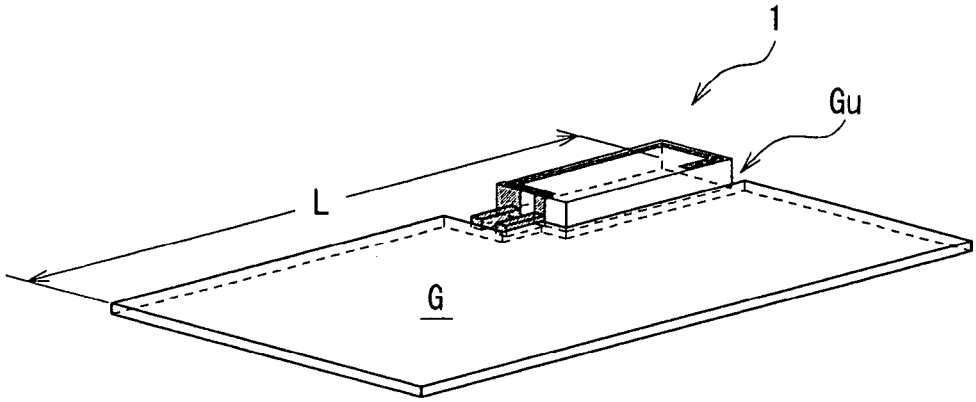
FIG. 35 is a perspective view showing a mounting form of a dielectric antenna.

A dielectric antenna 1 shown in FIG. 35 is fitted in a cut-out portion Gu formed at a shoulder portion of the ground portion G. In this case, since the dielectric antenna 1 does not protrude from the ground portion G, it contributes to miniaturization thereof in the point that the whole dielectric antenna can be fitted within a length L of the ground portion G.

Figure 36:
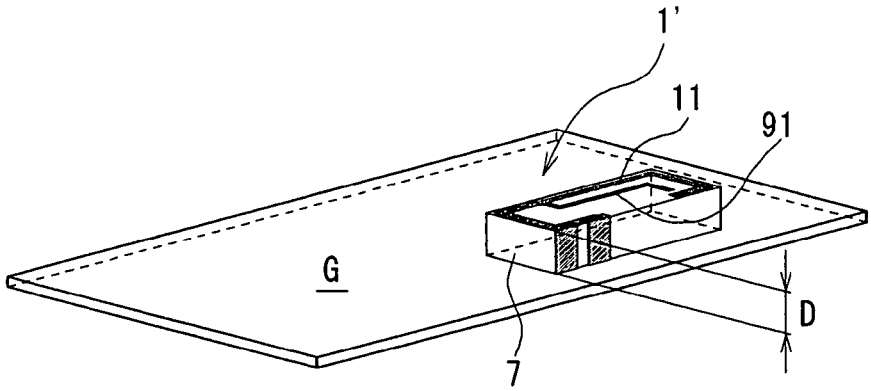
FIG. 36 is a perspective view showing a mounting form of a dielectric antenna.

A dielectric antenna 1' shown in FIG. 36 (which is equivalent to the dielectric antenna according to any one of the first to fifth embodiments) is mounted on the ground portion G. In this case, when separating a linear element 11 (linear sub-element 91) from the ground portion G, a thickness D of a dielectric base 7 may be thickened by increasing the number of layered substrates to the extent that an antenna characteristic is not affected.

Figure 37:
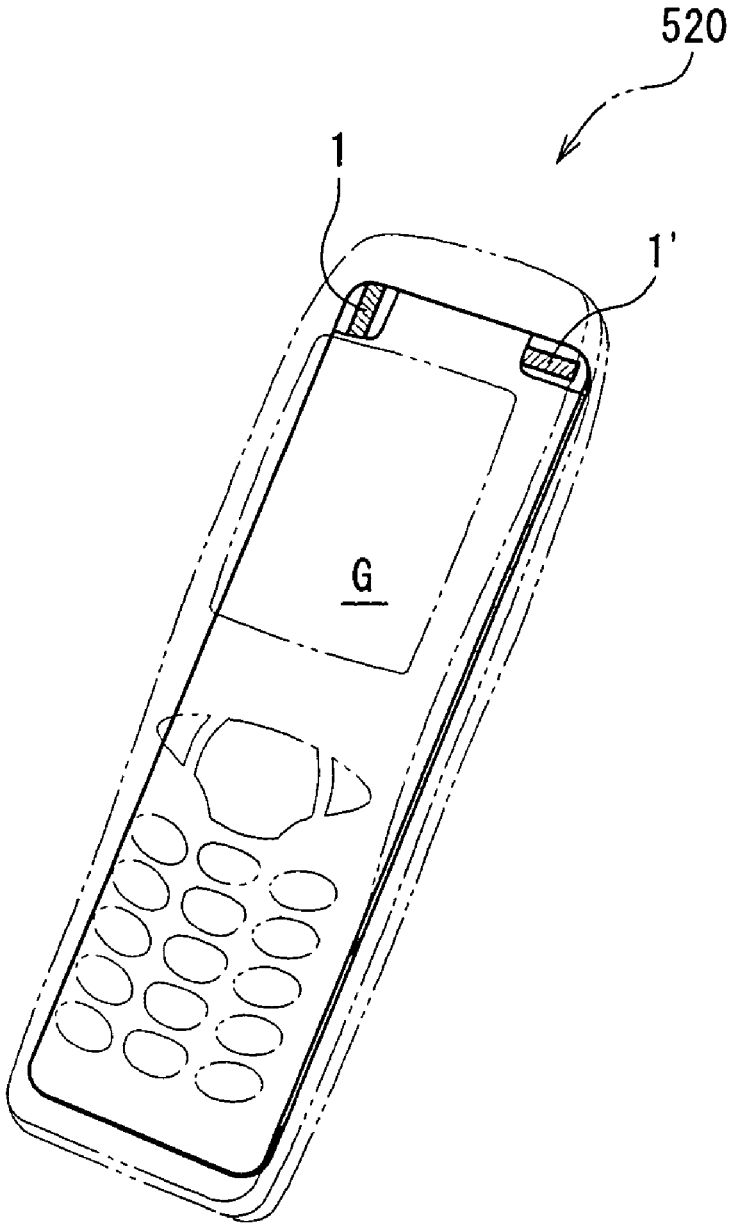
FIG. 37 is a perspective view of a cellular phone including a dielectric antenna.

It should be noted that the dielectric antennas 1 and 1' according to any one of the aforementioned first to fifth embodiments may be included in various types of mobile communication devices. Examples of the mobile communication devices include a wireless communication device for amateur/professional use, a cellular phone shown in FIG. 37 and the like. Shown in FIG. 37 is the dielectric antenna 1 (1') included in the cellular phone 520 that is one example of the mobile communication devices. Since the dielectric antenna of this invention is structured to be highly efficient and wide band although it is made in a small size as described above, the cellular phone 520 which includes the dielectric antenna can be miniaturized, and further, comfortable mobile communication becomes possible through transmission/reception of radio wave in good quality. In addition, other examples of the mobile communication devices which can include the dielectric antenna of the present invention include a small-sized computer (personal computer) and the like. Hereinafter, in relation with the small-sized computer, an embodiment of an antenna mounting substrate which includes the dielectric antenna according to any one of the aforementioned first to fifth embodiments.

Figure 38:
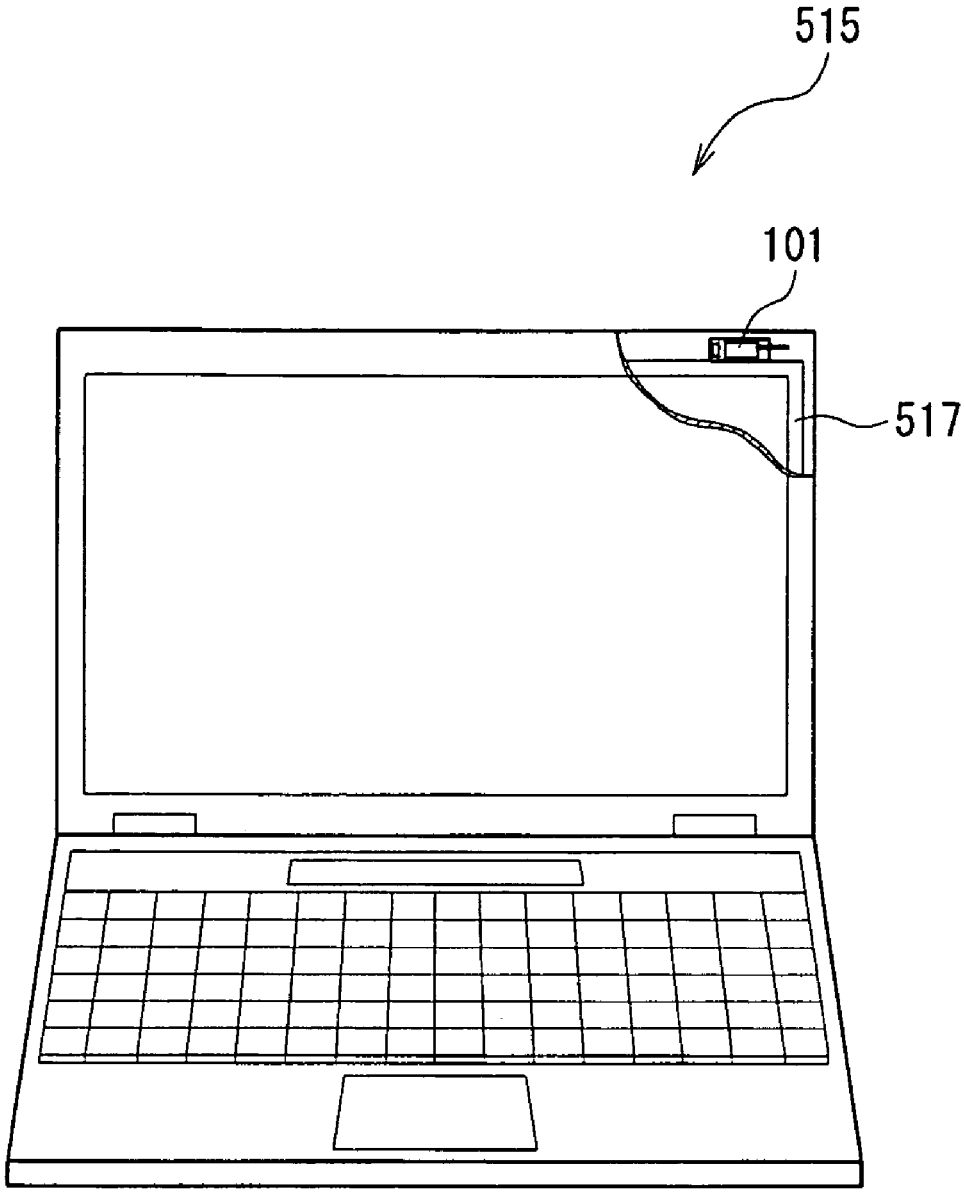
FIG. 38 is a front view of a small-sized computer having an antenna mounting substrate according to the first embodiment.
Figure 39:
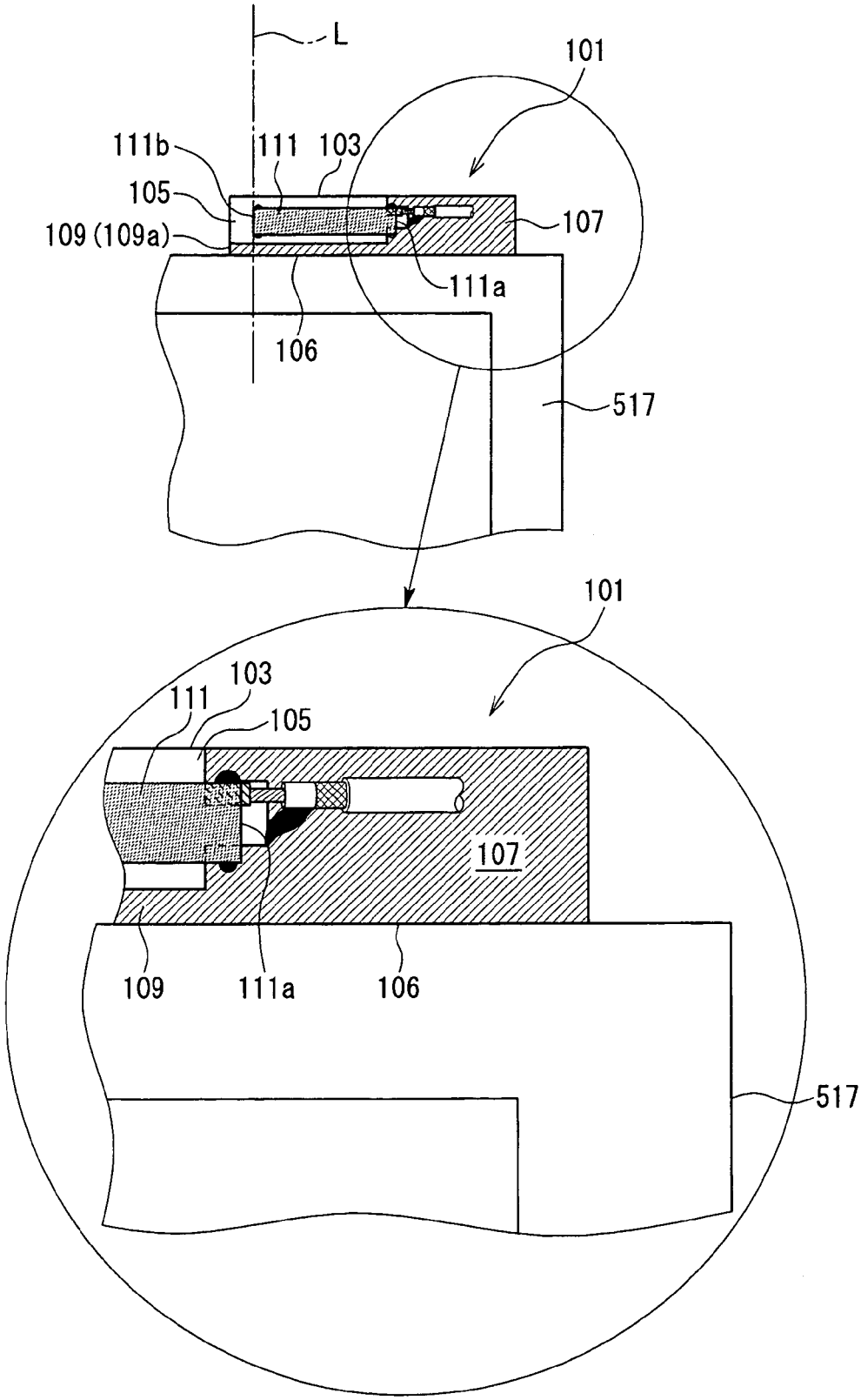
FIG. 39 is an enlarged view of the antenna mounting substrate shown in FIG. 38.
Figure 40:
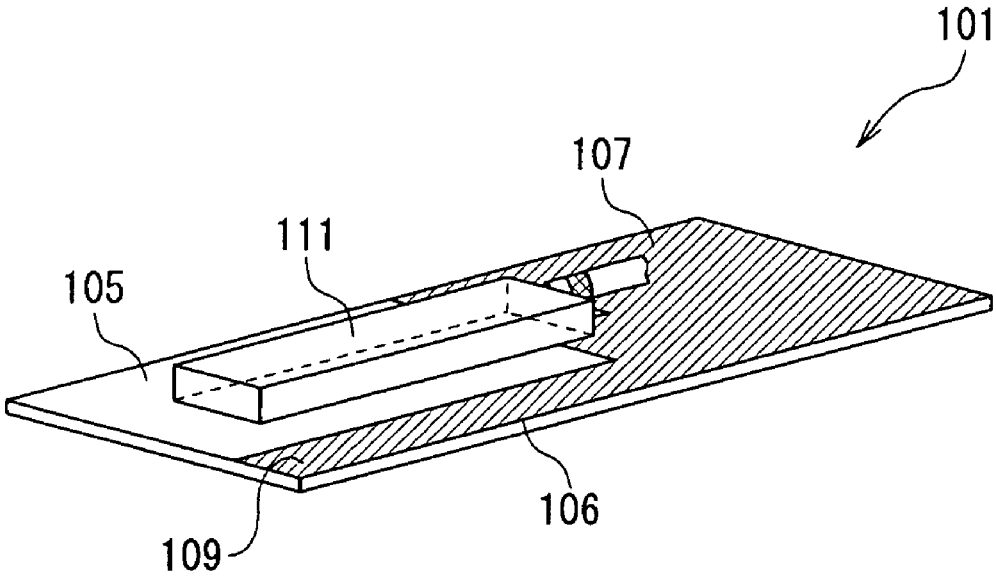
FIG. 40 is a perspective view of the antenna mounting substrate shown in FIG. 38.

A first embodiment of an antenna mounting substrate will be explained with reference to FIGS. 38 to 40. The antenna mounting substrate 101 has a substrate 103 made of ceramic or synthetic resin in a rectangle shape which is laterally long. On one face (a mounting face 105) of the substrate 103, a ground portion 107 and a linear conductor 109 are formed. A reference numeral 111 denotes a chip antenna. The chip antenna 111 in this embodiment is a dielectric antenna. The reason of adopting the dielectric antenna is that it is relatively advantageous for miniaturization, but antennas of other types may be adopted. The ground portion 107 and the linear conductor 109 are located adjacent to each other along a bottom side 106, in other words, in a lateral direction in FIG. 39.

The ground portion 107 and the linear conductor 109 are formed integrally by applying a conductive paste on the mounting face 105, but they may be formed by a method other than this conductive pattern, for example, a chemical method such as an etching. As a result of the integral formation, one end (a right end in FIG. 39) of the linear conductor 109 is connected only to the ground portion 107, and the other end thereof extends to an edge of the mounting face 105. The linear conductor 109 connected only to the ground portion 107 is convenient to integrally form by the above-described method in a point of decreasing labor, but they may be formed separately. When forming separately, one end of which is connected to the ground portion 107 and the other end is left open. Further, the linear conductor 109 may be formed by a method other than the conductive pattern. Instead of the conductive pattern, there is a method of providing a linear conductor such as a copper wire on the mounting face 105. A length (size) of the ground portion 107 is set to the same length as a ¼ wave length of a resonance frequency of the chip antenna 11.

The chip antenna 111 is formed in a rectangle shape including one end face 11*a* located on the side of the ground portion 107 and the other end face 111*b* located on the opposite side of the one end face 11*a*, and one end of the linear conductor 109 and the other end 109*a* located on the opposite side thereof are formed to cross a perpendicular line L drawn along the other end face 111*b* toward the bottom side 106. In other words, the antenna mounting substrate is structured in a state that there is only the linear conductor 109 exist between the chip antenna 111 and the bottom side 106. The reason of forming the linear conductor 109 is to connect the chip antenna 111 to this linear conductor 109, in other words, to interrupt the connection between the chip antenna 111 and a metal frame 517 in order to eliminate instability after mounting the chip antenna 111 as well as the antenna mounting substrate 101 on the metal frame 517. Specifically, by mounting the linear conductor 109, the chip antenna 111 is isolated from the metal frame 517, and by this isolation characteristic changes due to displacement of relative position between the both can be eliminated as much as possible. According to an experiment performed by the inventor, it is the best that the other end face 111*b* of the chip antenna 111 crosses the perpendicular line L as described above, but a limit in characteristic when a length of the linear element 109 was shortened (the perpendicular line L was moved in a rightward direction in FIG. 39) existed in the vicinity of the center of the chip antenna 111. For example, when the relative position of the antenna mounting substrate 101 to the metal frame 517 was changed due to degree of fastening of screws (not shown) or existence of play of mounting hole (not shown), a usable extent in characteristic change was there where the perpendicular line L was located in the vicinity of the center of the chip antenna 111 as described above.

Figure 41:
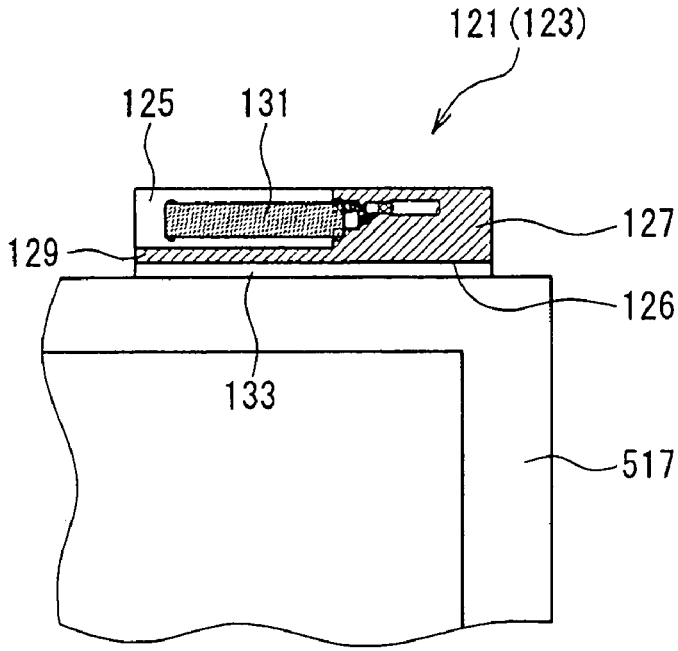
FIG. 41 is a front view showing an antenna mounting substrate according to the second embodiment.
Figure 42:
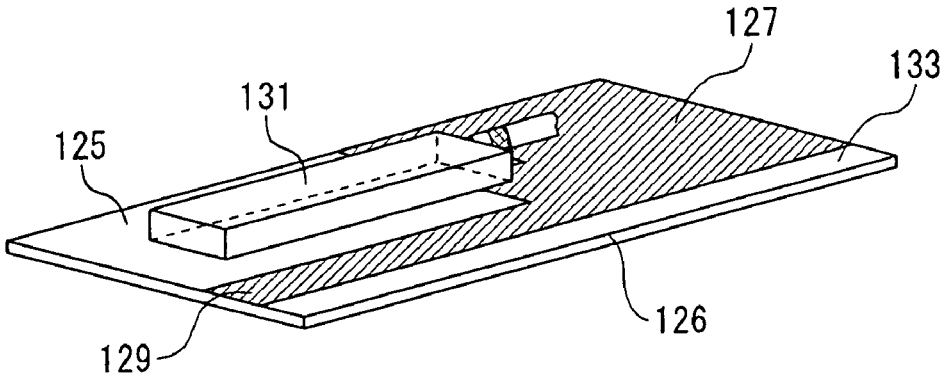
FIG. 42 is a perspective view of the antenna mounting substrate shown in FIG. 41.

A second embodiment of the antenna mounting substrate will be explained with reference to FIGS. 41 and 42. An antenna mounting substrate 121 according to the second embodiment is different from the antenna mounting substrate 101 according to the first embodiment in that the former has an exposure portion for insulation which the latter does not have. Here the difference will be explained, and explanation of common points is omitted. Specifically, the antenna mounting substrate 121 has a substrate 123 which is made of ceramic or synthetic resin in a rectangle shape that is laterally long, and on one face of the substrate 123, a ground portion 127 and a linear conductor 129 are formed. A reference numeral 131 denotes a chip antenna. Further, there is provided an exposure portion 133 for insulation formed by exposing in a linear shape a mounting face 125 along the entire length of a bottom side 126. The reason of forming the exposure portion 133 for insulation in a linear shape is to make a breadth thereof to be a necessary minimum so as to form the antenna mounting substrate 121 with a length size as small as possible, thereby lowering the height of the antenna mounting substrate 121 itself. On the other hand, when the height has a room, or the breadth is desired to be narrowed or widen according to a shape of the ground portion 127, it is not a problem to adopt a shape other than the linear shape.

The reason of providing the exposure portion 133 for insulation is not to let the linear conductor 129 or the ground portion 127 face the bottom side 126 of the mounting face 125, in order words, not to let them contact the metal frame 517. When the ground portion 127 or the linear conductor 129 electrically short-circuit with the metal frame that is an antenna mounting body, the entire antenna mounting substrate 121 may be unstable, so that, when mounting the aforementioned antenna mounting substrate 101, it is necessary to take a countermeasure for preventing the short-circuit such as mounting on the metal frame with a space therebetween. On the other hand, when mounting the antenna mounting substrate 121 on the metal frame 517, the existence of the exposure portion 133 for insulation allows the antenna mounting substrate 121 to be directly placed on the metal frame 517, and thus it is conveniently mounted as compared to the antenna mounting substrate 101.

The antenna mounting substrates 101 and 121 which have been explained are small-sized, and when mounted on a metal or the like, they are hardly affected by the metal. Therefore, it may be installed in a small gap of a top face, a side face or the like of the metal frame 517 of a small-sized computer (communication device) 515 shown in FIG. 38.

The aforementioned antenna mounting substrate, although being made in a small size, can be easily adjusted and can produce stable performance even when a mounting environment thereof is changed. Consequently, the antenna mounting substrate can be included in a communication device having a limited space, and it is hardly affected by metal when included therein. Therefore, stable communication becomes possible by such a communication device.

INDUSTRIAL AVAILABILITY

The present invention is effective for providing a dielectric antenna which is, although being made in a small size, capable of eliminating decrease of radiation efficiency of radio wave and hindrance to widening a band of radio wave as much as possible by restraining mutual interference between elements, an antenna mounting substrate and a mobile communication device including them.

The invention claimed is:

1. A dielectric antenna, comprising:

a dielectric base having an antenna forming face in a rectangular shape; a linear element extending on the antenna forming face adjacently only a periphery of the antenna forming face;

at least one bending portion included in said linear element; a power supply terminal connected to a base end portion of said linear element;

a linear conductor branching in the vicinity of the base end portion of said linear element on the antenna forming face; and a ground terminal connected to a tip of said linear conductor.

2. The dielectric antenna according to claim 1, wherein said bending portion comprises a first bending portion and a second bending portion which are located in order from the base end to the tip, wherein said linear element comprises a first portion located between the base end and the first bending portion, a second portion located between the first bending portion and the second bending portion, and a third portion located between the second bending portion and the tip, and wherein the first portion and the third portion oppose each other with a maximum length on the antenna forming face there between.

3. The dielectric antenna according to claim 1, wherein said bending portion comprises a first bending portion, a second bending portion, and a third bending portion which are located in order from the base end to a tip, wherein said linear element comprises a first portion located between the base end and the first bending portion, a second portion located between the first bending portion and the second bending portion, a third portion located between the second bending portion and the third bending portion, and a fourth portion located between the third bending portion and the tip, wherein the first portion and the third portion oppose each other with a maximum length on the antenna forming face there between, and wherein the second portion and the fourth portion oppose each other with a maximum length on the antenna forming face there between.

4. The dielectric antenna according to claim 1, wherein at least a portion of said linear conductor bends or meanders.

5. The dielectric antenna according to claim 1, wherein said dielectric base has four end faces, wherein said power supply terminal is formed on anyone of the four end faces, and wherein said ground terminal is formed on an end face which opposes the end face on which said power supply terminal is formed.

6. The dielectric antenna according to claim 1, further comprising:

a linear sub-element branching from the linear element and capable of resonating at a second resonance frequency which is different from a first resonance frequency at which the linear element is capable of resonating.

7. The dielectric antenna according to claim 6, wherein said linear sub-element is set to be capable of resonating at a ½ wave length of the second resonance frequency.

8. The dielectric antenna according to claim 6, wherein the antenna forming face of said dielectric base comprises a first antenna forming face, and a second antenna forming face which is different from the first antenna forming face, wherein said linear element is formed on the first antenna forming face, and wherein said linear sub-element is formed on the second antenna forming face.

9. The dielectric antenna according to claim 8, wherein a connecting portion is formed on the base end portion of said linear sub-element, and wherein only the connecting portion is connected to a mid-portion of said linear element through a capacitor structure.

10. The dielectric antenna according to claim 8, wherein a connecting portion is formed on the base end portion of said linear sub-element, and wherein only the connecting portion opposes a mid-portion of said linear element through a part or a whole of a thickness direction of said dielectric base.

11. The dielectric antenna according to claim 8, further comprising:

a connecting conductor which connects a base portion of said linear sub-element and a mid-portion of said linear element, wherein a part or a whole of said connecting conductor is arranged on anyone of the four end faces.

12. The dielectric antenna according to claim 11, wherein said first antenna forming face is formed in a rectangular shape, and wherein said linear element is formed adjacent to the periphery of the first antenna forming face.

13. The dielectric antenna according to claim 8, further comprising:

a connecting portion which connects the linear sub-element and the linear element, wherein an intersection between said linear element and said linear sub-element is only the connecting portion.

14. The dielectric antenna according to claim 13, wherein the connecting portion is formed by a base end portion of said linear sub-element, which opposes said linear element with a part or a whole of said dielectric base in a thickness direction intervening there between.

15. The dielectric antenna according to claim 13, wherein the connecting portion is formed by a connecting conductor which connects a base end portion of said linear sub-element and a mid-portion of said linear element, and wherein a part or a whole of the connecting conductor is arranged on anyone of the four end faces.

16. The dielectric antenna according to claim 8, wherein said dielectric base is formed of a single dielectric layer, and wherein the first antenna forming face is one face of the dielectric layer, and the second antenna forming face is an other face of the dielectric layer.

17. The dielectric antenna according to claim 8, wherein said dielectric base is a multi-layered body composed of plural dielectric layers, and wherein the first antenna forming face and the second antenna forming face are formed on a same dielectric layer or on different dielectric layers.

18. A dielectric antenna, comprising:

a dielectric base having an antenna forming face;

a linear element extending on the antenna forming face adjacent to a periphery of the antenna forming face and is capable of resonating at a first resonance frequency;

a power supply terminal connected to a base end portion of said linear element;

a linear conductor branching in the vicinity of the base end portion of said linear element;

a ground terminal connected to a tip of said linear conductor; and a linear sub-element formed on the antenna forming face and is capable of resonating at a second resonance frequency which is different from the first resonance frequency, wherein a base end of said linear sub-element is connected to a mid-portion of said linear element through a capacitor structure.

19. A mobile communication device, comprising:

an antenna mounting substrate connected to said mobile communication device; and a dielectric antenna connected to said antenna mounting substrate, said dielectric antenna comprising:

a dielectric base having an antenna forming face in a rectangular shape;

a linear element extending on the antenna forming face adjacently only a periphery of the antenna forming face;

at least one bending portion included in said linear element;

a power supply terminal connected to a base end portion of said linear element;

a linear conductor branching in the vicinity of the base end portion of said linear element on the antenna forming face; and a ground terminal connected to a tip of said linear conductor.

20. An antenna mounting substrate, comprising:

a mounting face which is laterally long and having a bottom side; and a chip antenna and a ground portion adjacent to each other along the bottom side on said mounting face, wherein said mounting face between said chip antenna and the bottom side is provided with a linear conductor having a predetermined length, the linear conductor connecting one end thereof only to said ground portion.

21. The antenna mounting substrate according to claim 20, wherein said chip antenna comprises one end face which faces said ground portion and an other end face located on the opposite side of the one end face, wherein one end of said linear conductor and an other end on the opposite side thereof are formed to cross a perpendicular line drawn along the other end face toward the bottom side.

22. The antenna mounting substrate according to claim 20, wherein said linear conductor is integrated with said ground portion.

23. The antenna mounting substrate according to claim 22, wherein said linear conductor and said ground portion are formed by a conductor pattern.

24. The antenna mounting substrate according to claim 20, further comprising:

an exposure portion for insulation formed by exposing in a predetermined shape said mounting face along an entire length of the bottom side.

25. The antenna mounting substrate according to claim 24, wherein said exposure portion for insulation is formed in a linear shape.

26. The antenna mounting substrate according to claim 20, wherein said chip antenna is a dielectric antenna composed by forming an element on a dielectric layer.

27. A communication device comprising:

a computer having a frame; and an antenna mounting substrate, comprising:

a mounting face which is laterally long and having a bottom side; and a chip antenna and a ground portion adjacent to each other along the bottom side on said mounting face, wherein said mounting face between said chin antenna and the bottom side is provided with a linear conductor having a predetermined length, the linear conductor connecting one end thereof only to said ground portion; and wherein said antenna mounting substrate is connected to said frame.

28. The communication device according to claim 27, wherein said communication device is a small-sized computer.

* * * * *